US012571383B2

(12) United States Patent
McCarthy

(10) Patent No.: US 12,571,383 B2
(45) Date of Patent: Mar. 10, 2026

(54) COMPRESSER FOR PUMPING FLUID HAVING CHECK VALVES ALIGNED WITH FLUID PORTS

(71) Applicant: I-JACK TECHNOLOGIES INCORPORATED, Moosomin (CA)

(72) Inventor: Dan McCarthy, Moosomin (CA)

(73) Assignee: I-JACK TECHNOLOGIES INCORPORATED, Moosomin (CA)

( * ) Notice: Subject to any disclaimer, the term of this patent is extended or adjusted under 35 U.S.C. 154(b) by 0 days.

(21) Appl. No.: 18/087,763

(22) Filed: Dec. 22, 2022

(65) Prior Publication Data

US 2023/0127613 A1 Apr. 27, 2023

Related U.S. Application Data

(63) Continuation-in-part of application No. 17/982,291, filed on Nov. 7, 2022, which is a continuation of application No. 17/483,452, filed on Sep. 23, 2021, now Pat. No. 11,519,403.

(51) Int. Cl.

| | |
|---|---|
| ***F04B 9/109*** | (2006.01) |
| ***F04B 5/02*** | (2006.01) |
| ***F04B 39/12*** | (2006.01) |

(52) U.S. Cl.

CPC ..... *F04B 39/123* (2013.01); *F04B 5/02* (2013.01); *F04B 9/109* (2013.01)

(58) Field of Classification Search

CPC ..... F04B 5/02; F04B 53/16; F04B 9/109

See application file for complete search history.

(56) References Cited

U.S. PATENT DOCUMENTS

| | | | |
|---|---|---|---|
| 1,619,475 | A | 3/1927 | Hubbard |
| 2,092,641 | A | 9/1937 | Doran |
| 2,303,597 | A | 12/1942 | Adelson |
| 2,946,316 | A | 7/1960 | Bruehl |
| 3,632,234 | A | 1/1972 | Lake |

(Continued)

FOREIGN PATENT DOCUMENTS

| | | | |
|---|---|---|---|
| CA | 2165063 | A1 | 3/1995 |
| CA | 2309970 | C | 7/1999 |

(Continued)

OTHER PUBLICATIONS

Handbook of Hydraulic Resistance (Year: 1966).*

(Continued)

*Primary Examiner* — Thomas Fink

(57) ABSTRACT

A compressor comprises a first cylinder for compressing a fluid and a second cylinder for driving a piston in the first cylinder. The first cylinder comprises a chamber configured to receive the fluid. The piston is reciprocally movable in the chamber for compressing the fluid. The chamber comprises four ports at the first end including two inlet ports and two outlet ports with a check valve is connected to each port. Each of the four ports is slanted such that the plurality of check valves and inlet and outlet conduits are spaced apart from the second cylinder. The compressor further comprises an inlet conduit to supply the fluid from a fluid source to the chamber through the inlet ports and an outlet conduit for receiving fluid from the chamber through the outlet ports.

19 Claims, 43 Drawing Sheets

(56) References Cited

U.S. PATENT DOCUMENTS

| | | | | |
|---|---|---|---|---|
| 3,801,230 | A | 4/1974 | Brown | |
| 4,008,012 | A | 2/1977 | Page | |
| 4,013,385 | A | 3/1977 | Peterson | |
| 4,380,150 | A | 4/1983 | Carlson | |
| 4,390,322 | A | 6/1983 | Budzich | |
| 4,512,151 | A | 4/1985 | Yamatani | |
| 4,515,516 | A | 5/1985 | Perrine et al. | |
| 4,516,473 | A | 5/1985 | Oneyama et al. | |
| 4,653,986 | A | 3/1987 | Ashton | |
| 4,761,118 | A | 8/1988 | Zanarini | |
| 4,861,239 | A | 8/1989 | Simmons et al. | |
| 4,949,805 | A | 8/1990 | Mather et al. | |
| 4,990,058 | A | 2/1991 | Eslinger | |
| 5,238,372 | A | 8/1993 | Morris | |
| 5,281,100 | A | 1/1994 | Diederich | |
| 5,450,901 | A | 9/1995 | Ellwood | |
| 5,481,873 | A | 1/1996 | Saruwatari et al. | |
| 5,584,664 | A | 12/1996 | Elliott et al. | |
| 5,622,478 | A | 4/1997 | Elliott et al. | |
| 5,743,716 | A | 4/1998 | Smith | |
| 5,782,612 | A | 7/1998 | Margardt | |
| 5,807,083 | A | 9/1998 | Tomoiu | |
| 5,868,122 | A | 2/1999 | Gram et al. | |
| 6,408,736 | B1 | 6/2002 | Holt et al. | |
| 6,422,313 | B1 | 7/2002 | Knight | |
| 6,435,843 | B1 * | 8/2002 | Hur | F04B 9/113 417/399 |
| 6,568,911 | B1 | 5/2003 | Brightwell et al. | |
| 6,652,241 | B1 | 11/2003 | Alder | |
| 6,966,367 | B2 | 11/2005 | Butler et al. | |
| 7,074,020 | B2 | 7/2006 | Navarro | |
| 7,255,540 | B1 | 8/2007 | Cooper | |
| 7,527,482 | B2 | 5/2009 | Ursan et al. | |
| 7,604,064 | B2 | 10/2009 | Irwin, Jr. | |
| 7,730,939 | B2 | 6/2010 | Merrick, III | |
| 7,762,321 | B2 | 7/2010 | Fesi et al. | |
| 7,766,079 | B2 | 8/2010 | Hoffarth | |
| 8,046,990 | B2 | 11/2011 | Bollinger et al. | |
| 8,047,820 | B2 | 11/2011 | Merrick, III | |
| 8,066,496 | B2 | 11/2011 | Brown | |
| 8,136,586 | B2 | 3/2012 | Merrick, III | |
| 8,147,218 | B2 | 4/2012 | Thrasher et al. | |
| 8,161,741 | B2 | 4/2012 | Ingersoll et al. | |
| 8,226,370 | B2 | 7/2012 | Wu et al. | |
| 8,297,362 | B1 | 10/2012 | Strider et al. | |
| 8,387,375 | B2 | 3/2013 | Blieske | |
| 8,851,860 | B1 | 10/2014 | Mail | |
| 9,109,511 | B2 | 8/2015 | Ingersoll et al. | |
| 9,359,876 | B2 | 6/2016 | Fink | |
| 9,605,805 | B2 | 3/2017 | Calvin et al. | |
| 9,745,975 | B2 | 8/2017 | Dancek | |
| 9,816,497 | B2 | 11/2017 | Strickland et al. | |
| 10,072,487 | B2 | 9/2018 | McCarthy | |
| 10,087,924 | B2 | 10/2018 | McCarthy | |
| 10,167,857 | B2 | 1/2019 | McCarthy | |
| 10,544,783 | B2 | 1/2020 | McCarthy | |
| 10,876,523 | B2 | 12/2020 | Bridges | |
| 2004/0162658 | A1 | 8/2004 | Newman | |
| 2005/0103576 | A1 | 5/2005 | Engstrom | |
| 2005/0173019 | A1 | 8/2005 | Navarro | |
| 2005/0175476 | A1 | 8/2005 | Patterson | |
| 2005/0180864 | A1 | 8/2005 | Ursan et al. | |
| 2006/0011264 | A1 | 1/2006 | Palmer | |
| 2007/0041847 | A1 | 2/2007 | Inoue et al. | |
| 2009/0194291 | A1 | 8/2009 | Fesi et al. | |
| 2009/0246049 | A1 | 10/2009 | Merrick, III | |
| 2010/0172771 | A1 | 7/2010 | Hoffarth | |
| 2012/0204548 | A1 | 8/2012 | Turnis et al. | |
| 2012/0224977 | A1 | 9/2012 | Sotz et al. | |
| 2012/0247785 | A1 | 10/2012 | Schmitt | |
| 2013/0094978 | A1 | 4/2013 | Hoffarth | |
| 2013/0259723 | A1 * | 10/2013 | Salven | F04B 53/16 417/559 |
| 2014/0093395 | A1 | 4/2014 | Leavy et al. | |
| 2014/0219830 | A1 | 8/2014 | Strickland et al. | |
| 2014/0231093 | A1 | 8/2014 | Hoell | |
| 2014/0294635 | A1 | 10/2014 | Rietkerk | |
| 2014/0353391 | A1 | 12/2014 | Burklin et al. | |
| 2014/0377081 | A1 * | 12/2014 | Bagagli | F04B 49/03 417/288 |
| 2015/0233368 | A1 | 8/2015 | Gallaway | |
| 2015/0240799 | A1 | 8/2015 | Obrejanu et al. | |
| 2015/0361970 | A1 | 12/2015 | White et al. | |
| 2016/0032911 | A1 | 2/2016 | McCoy | |
| 2016/0258426 | A1 | 9/2016 | Tao et al. | |
| 2017/0321526 | A1 | 11/2017 | McCarthy | |
| 2018/0030978 | A1 | 2/2018 | McCarthy | |
| 2018/0334894 | A1 | 11/2018 | Arlandis | |
| 2019/0257306 | A1 | 8/2019 | Blundell et al. | |
| 2019/0301446 | A1 | 10/2019 | Khaire et al. | |
| 2020/0040882 | A1 | 2/2020 | Kalmari et al. | |

FOREIGN PATENT DOCUMENTS

| | | | |
|---|---|---|---|
| CA | 2353391 | A1 | 6/2000 |
| CA | 2331931 | A1 | 7/2002 |
| CA | 2379766 | C | 10/2004 |
| CA | 2644346 | A1 | 5/2010 |
| CA | 2803208 | A1 | 2/2012 |
| CA | 2891110 | A1 | 5/2013 |
| CA | 2599447 | C | 7/2013 |
| CA | 2843321 | C | 2/2015 |
| CA | 2861781 | C | 3/2016 |
| CN | 2445111 | Y | 8/2001 |
| CN | 1326050 | A | 12/2001 |
| CN | 201103527 | Y | 8/2008 |
| CN | 201103528 | Y | 8/2008 |
| CN | 201225264 | Y | 4/2009 |
| CN | 202108682 | U | 1/2012 |
| CN | 202360325 | U | 8/2012 |
| CN | 202674817 | U | 1/2013 |
| DE | 202012104058 | U1 | 3/2014 |
| FR | 3003906 | A1 | 10/2014 |
| WO | 90/08897 | A1 | 8/1990 |
| WO | 2011/079267 | A1 | 6/2011 |
| WO | 2011/079271 | A2 | 6/2011 |
| WO | 2012/012896 | A1 | 2/2012 |
| WO | 2013/064748 | A1 | 5/2013 |
| WO | 2013/071134 | A1 | 5/2013 |
| WO | 2013/177268 | A1 | 11/2013 |
| WO | 2014/113545 | A1 | 7/2014 |
| WO | 2016/037500 | A1 | 3/2016 |

OTHER PUBLICATIONS

Brahma Compression Ltd., "CGR50 Casing Gas Recovery Unit", www.gascompressors.ca, before Apr. 21, 2016, 8 pages.

Brittania Industries 2009 Inc., "Casing Gas Compressor Packages", www.brittaniaindustries.com, before Apr. 21, 2016, 2 pages.

Broadwind Energy and Safe North America, "CNG Boost™ (Hydraulic Compressor) System Operation and Technology Overview", www.bwen.com and www.safegas.it/en/, before Apr. 21, 2016, 3 pages.

Karl Bratt; Jonathan Haines; Andrew Hall; and Brandon Koster, "Project Proposal & Feasibility Study NaturaFill: Fuel for Thought", © 2013, Karl Bratt, Jonathan Haines, Andrew Hall, Brandon Koster, and Calvin College, Updated: Dec. 9, 2013, 59 pages.

Karl Bratt; Jonathan Haines; and Brandon Koster, "Final Design Report NaturaFill: Fuel for Thought", © 2014, Karl Bratt, Jonathan Haines, Brandon Koster, and Calvin College, Updated: May 15, 2014, 112 pages.

Chemac Inc., "Hofer Piston compressors with hydraulic drive unit", www.chemacinc.com, before Apr. 21, 2016, 4 pages.

Corken, Inc. (A Unit of IDEX Corporation), "Sour Gas Compressors Oil & Natural Gas Applications", http://www.corken.com, Jul. 2015, 8 pages.

Hans Turck GmbH & Co. KG, "Inductive sensor BI5-EM18-Y1X-H1141", www.turck.com, before Apr. 21, 2016, 4 pages.

Compact Compression Inc., "Casing Gas Compression", http://www.compactcompression.com, before Apr. 21, 2016, 32 pages.

(56) References Cited

OTHER PUBLICATIONS

Permian Production Equipment, Inc., "The Hydraulic Beam Gas Compressor® Your Solution When More Production is the Question", www.hydraulic.beamgascompressor.com, before Apr. 21, 2016, 4 pages.
Linde Hydraulics GmbH & Co. KG, "HPV-02. Variable pumps for closed loop operation.", http://www.linde-hydraulics.com, before Apr. 21, 2016, 36 pages.
Hoerbiger, "Ring and packing Sealing systems for reciprocating compressors", http://www.hoerbiger.com, before Apr. 21, 2016, 24 pages.
Krzysztof Palka, "Understanding Sucker Rod Pump Operation with Hydraulic Jack", © Krzysztof Palka 2015, 27 pages.
Non-Final Office Action issued by the U.S. Patent and Trademark Office on Sep. 1, 2017 in connection with U.S. Appl. No. 15/656,252, 25 pages.
Final Office Action issued by the U.S. Patent and Trademark Office on Nov. 24, 2017 in connection with U.S. Appl. No. 15/656,252, 21 pages.
I-Jack Technologies Incorporated, "IJack DGAS Product Manual Publication No. 800-0030 Rev 2.1", before before May 31, 2017, 34 pages.
Non-Final Office Action issued by the U.S. Patent and Trademark Office on Feb. 20, 2018 in connection with U.S. Appl. No. 15/822,035, 27 pages.
Non-Final Office Action issued by the U.S. Patent and Trademark Office on Feb. 15, 2019 in connection with U.S. Appl. No. 15/659,229, 19 pages.
Non-Final Office Action issued by the U.S. Patent and Trademark Office on Oct. 18, 2018 in connection with U.S. Appl. No. 16/059,891, 8 pages.
Non-Final Office Action issued by the U.S. Patent and Trademark Office on Jan. 17, 2018 in connection with U.S. Appl. No. 15/786,369, 13 pages.
Non-Final Office Action issued by the U.S. Patent and Trademark Office on May 2, 2019 in connection with U.S. Appl. No. 16/147,188, 7 pages.

* cited by examiner

300

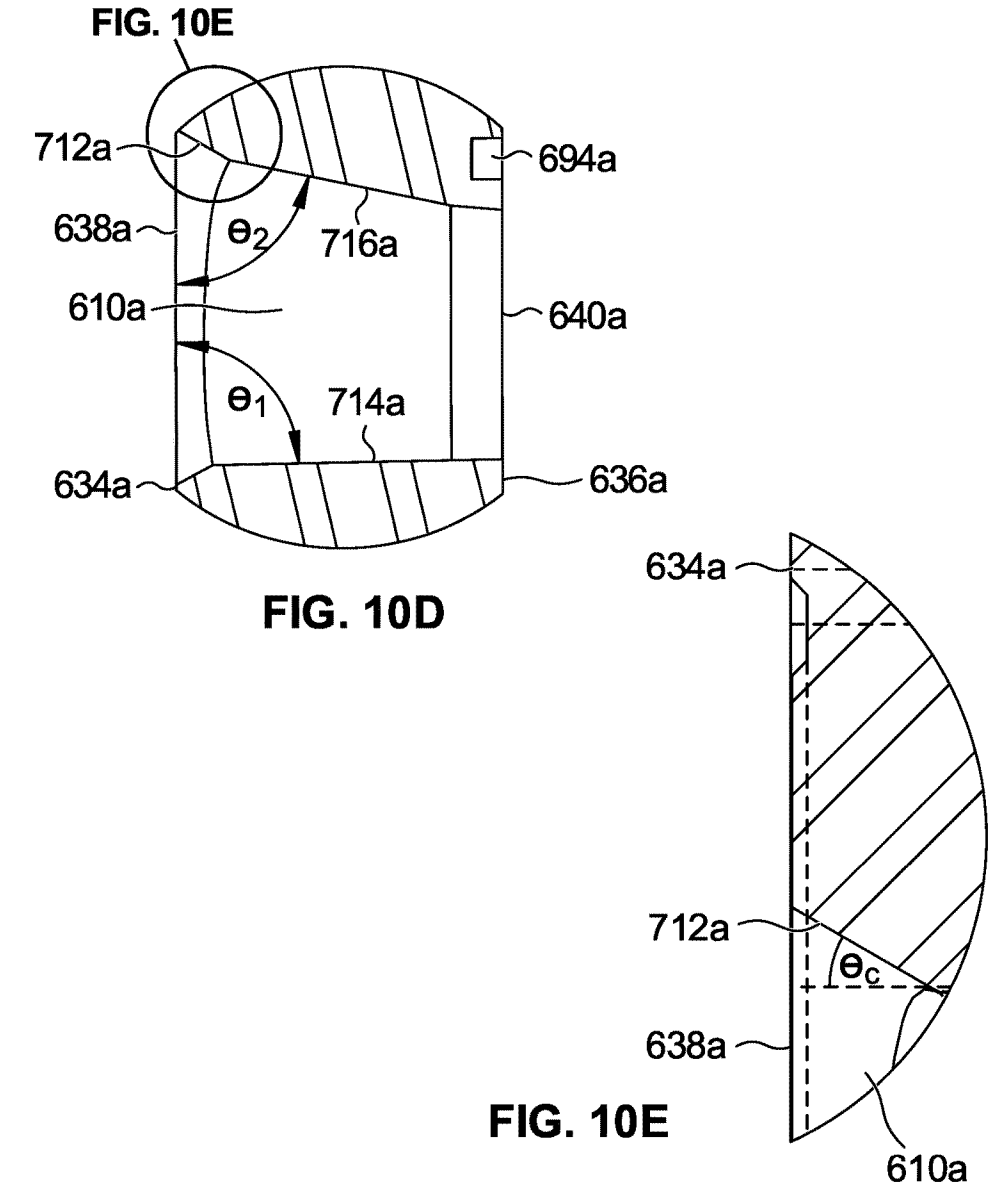
FIG. 10D
FIG. 10E
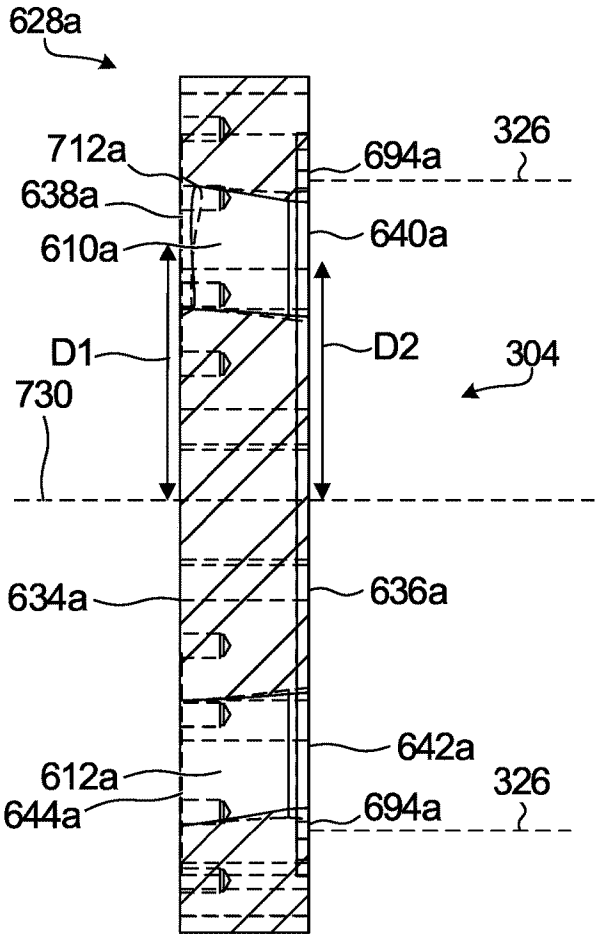
FIG. 10C

COMPRESSER FOR PUMPING FLUID HAVING CHECK VALVES ALIGNED WITH FLUID PORTS

CROSS-REFERENCE TO RELATED APPLICATIONS

This application is a Continuation-in-part of U.S. patent application Ser. No. 17/982,291 filed on Nov. 7, 2022, which is a Continuation of U.S. patent application Ser. No. 17/483,452 filed on Sep. 23, 2021 (now U.S. Pat. No. 11,519,403 issued on Dec. 6, 2022), the entire contents of both applications being hereby incorporated by reference herein.

FIELD

The present disclosure relates generally to fluid compression or pumping devices and systems, and specifically to fluid compressors having fluid ports and check valves connected to the ports.

BACKGROUND

Fluid compressors are useful for pumping fluids. A fluid compressor typically has a fluid chamber and a pair of fluid ports serving as an inlet or outlet of the fluid chamber. Check valves may be connected to the fluid ports for controlling fluid flow through the inlet or outlet ports.

For example, United States patent publication no. US20210270257, published on Sep. 2, 2021, disclosed fluid compressors for pumping multiphase fluids. A representative view of a compressor 100 disclosed therein is shown in FIG. 1. Compressor 100 includes a compression cylinder 102 having opposite ends 112*a*, 112*b*. The compression cylinder 100 has a double-acting compression piston for compressing a fluid towards one or the other of the two ends 112*a*, 112*b*. The compression piston is driven by two hydraulic cylinders each coupled to the compression cylinder at one of the ends 112*a*, 112*b* through a central port. Each end 112*a*, 112*b* also has two fluid ports 104*a*, 104*b* spaced from the central port, one of which is an inlet port and the other of which is an outlet port. The fluid to be pumped can flow in and out of compression cylinder 102 through ports 104*a* and ports 104*b*. Each port 104*a*, 104*b* is connected to a check valve 108*a*, 108*b* by an elbow connector 106*a*, 106*b*. The elbow connectors 106*a*, 106*b* are used and have sufficient size so that the check valves 108*a*, 108*b* are offset from the hydraulic cylinders at each end 112*a*, 112*b* of the compression cylinder 100. The check valves 108*a*, 108*b* are connected by flanges and pipes to the fluid input source and the output destination. The check valves 108*a*, 108*b* are configured and oriented to control the fluid flow at the ports 104*a*, 104*b*.

It is desirable to improve the efficiency or performance of such fluid compressors.

SUMMARY

In an embodiment, the present disclosure relates to a compressor that comprises a first cylinder for compressing a fluid. The first cylinder comprises a chamber configured to receive the fluid, a piston reciprocally movable in the chamber for compressing the fluid towards a first end of the chamber, a centrally located opening at the first end of the chamber; and four ports at the first end of the chamber, comprising two inlet ports and two outlet ports. The compressor further comprises a plurality of check valves each associated with one of the four ports for controlling fluid flow through the ports, including two inlet check valves connected to the two inlet ports and two outlet check valves connected to the two outlet ports. The compressor further comprises a centrally located second cylinder at the first end of the chamber, the second cylinder connected and configured to drive movement of the piston in the first cylinder through the centrally located opening, an inlet conduit connected to each one of the inlet check valves to supply the fluid from a fluid source to the chamber through the inlet ports, an outlet conduit connected to each one of the outlet check valves for receiving fluid from the chamber through the outlet ports. Each of the four ports is slanted such that the plurality of check valves and inlet and outlet conduits are spaced apart from the second cylinder.

In some embodiments, each of the inlet and outlet conduits comprises a first end comprising a first flange and a plurality of second ends each comprising a second flange, each of the second flanges of the inlet conduit for connecting the respective second end to the inlet check valves and each of the second flanges of the outlet conduit for connecting the respective second end to the outlet check valves.

In some embodiments, each one of the four ports comprises a first end located proximal to the chamber and a second end located distal to the chamber. The first ends of each of the four ports are also located proximal to an edge of an internal side wall of the chamber. In some embodiments, the first ends of each of the four ports are oval. In some embodiments, the first ends of each of the four ports are circular. In some embodiments, the second ends of each one of the inlet ports comprise a chamfered edge.

In some embodiments, the first ends of the chamber comprises a head plate, and each one of the check valves is secured to the head plate.

In some embodiments, the fluid is a multiphase fluid comprising a solid material.

In another embodiment, the present disclosure relates to a compressor that comprises a compression chamber. The compression chamber comprises a tubular wall extending between first and second ends along a central axis and an end plate attached to each one of the first and second ends, the end plate comprising an inner surface, an external surface, and a central opening and a plurality of peripheral fluid ports extending from the inner surface to the external surface. Each one of the peripheral fluid ports comprises an inner opening at the inner surface and an outer opening at the external surface and is inclined with respect to the central axis such that the outer opening is farther away from the central axis than the inner opening. The compressor further comprises a piston movably housed in the compression chamber and a piston rod for driving the piston to move within the compression chamber, the piston rod connected to the piston through the central opening of the end plate and extending along the central axis.

In some embodiments, the end plate has a thickness of 4 inches, and the outer opening is farther away from the central axis than the inner opening by between about 0.5 and about 2 inches.

In some embodiments, the plurality of the peripheral fluid ports comprises four ports.

In some embodiments, the inner opening is located 0 to about ⅜ inch from the tubular wall.

In some embodiments, the inner opening is circumferentially elongated with respect to the central axis.

In some embodiments, the inner opening is smaller than the outer opening.

In some embodiments, the outer opening comprises a chamfered edge.

In some embodiments, the compressor comprises a plurality of valves each connected to one of the peripheral fluid ports. In some embodiments, the valves comprise check valves. In some embodiments, the compressor comprises a plurality of conduits connecting the valves to an input line and an output line respectively. In some embodiments, each one of the conduits comprises a flange connected to a corresponding one of the valves. The flange is spaced away from the piston rod due to inclination of the peripheral fluid port connected to the corresponding valve. The valves may comprise check valves each compressed between a corresponding one of the head plates and a corresponding one of the flanges.

BRIEF DESCRIPTION OF THE DRAWINGS

In the figures, which illustrate example embodiments:

FIG. 100 is a cross sectional end view of the head plate of FIG. 10A, along the line A-A in FIG. 10A;

FIG. 10D is an enlarged view of a portion of FIG. 100;

FIG. 10E is an enlarged view of a portion of FIG. 10D;

DETAILED DESCRIPTION

Figure 1:
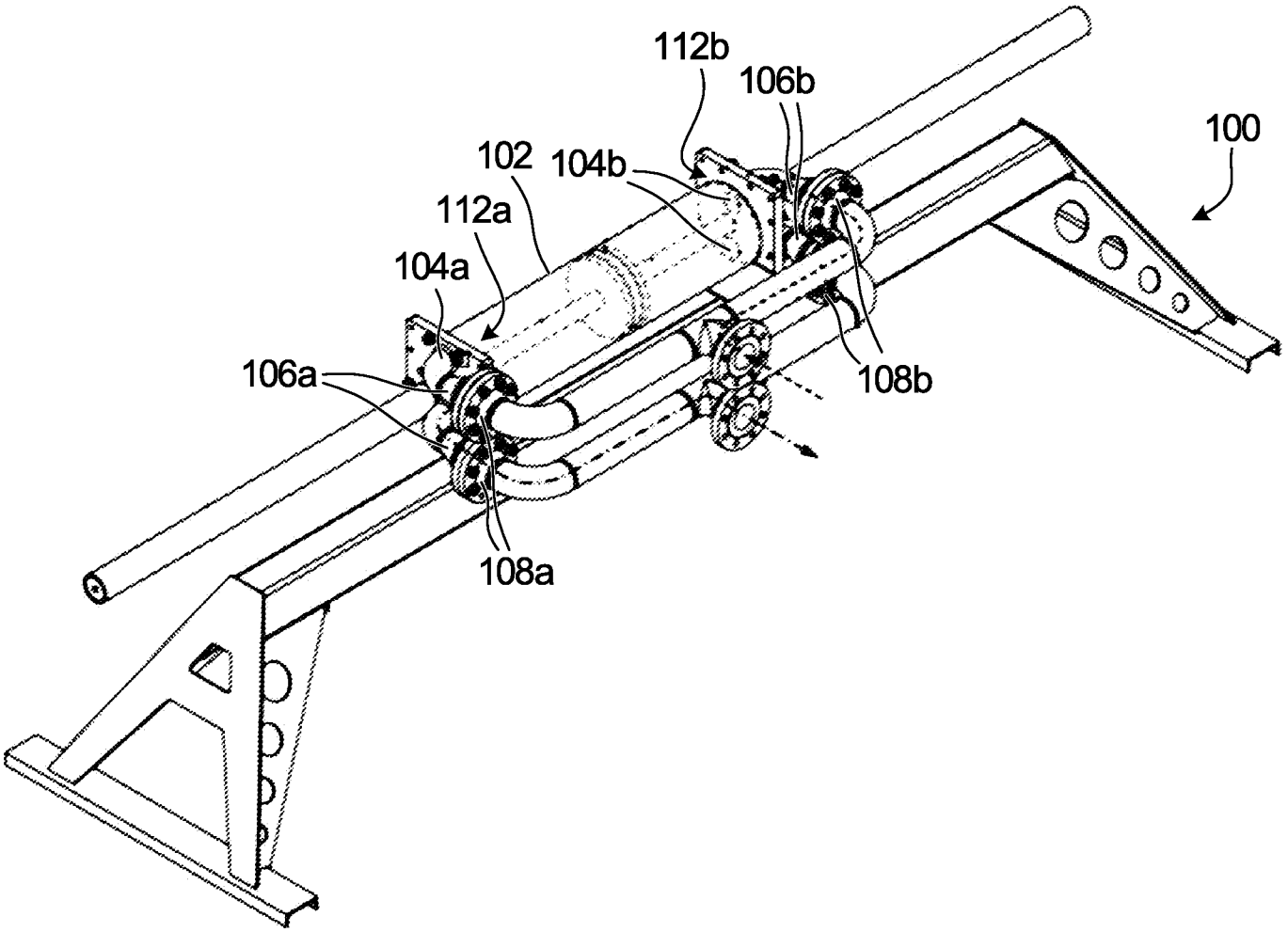
FIG. 1 PRIOR ART
FIG. 1 is a front perspective view of a comparison compressor.

It has been recognized that when the compression piston within the compression chamber of the compressor 100 as shown in FIG. 1 reaches an end of stroke position, a relatively large dead volume (or minimal chamber volume) still undesirably remains within the space between the piston face and the check valves 108*a* or 108*b*, particularly in the ports 104*a* or 104*b* and the elbow connectors 106*a* or 106*b*. This large dead volume leads to decreased pumping efficiency and performance. This problem would be exaggerated when the sizes of the elbow connectors 106*a*, 106*b* and the check valves 108*a*, 108*b* are increased to provide increased throughput or to pump certain liquids such as liquids produced from a well in oil and gas applications. It is thus desirable to provide a fluid compressor with reduced dead volume to increase the compression ratio of the compressor without reducing or limiting the pumping throughput.

The present inventor has discovered a number of solutions to address the above problem. First, connecting a check valve to an inlet/outlet port without an elbow connector therebetween can provide a straight, shortened fluid flow path between the port and the check valve, thus reducing the dead volume. The straight flow path will also improve the flow characteristics in the flow path, thereby increasing pumping efficiency.

As can be appreciated, when the elbow connector between the check valve and the port is eliminated or replaced with a straight connector, the check valve can be positioned closer to the port, reducing the path volume between the end of the piston and the check valve. This will beneficially reduce the dead volume (i.e., the volume of compressed fluid retained within the compressor at the end of each stroke) of the compressor. With a smaller dead volume, the compressor will be able to draw in, compress and expel a larger volume of liquid on each stroke, and provide a higher compression ratio on each stroke.

Due to the limited room at each end of the compression cylinder in the presence of the hydraulic cylinder coupled to the compression cylinder, the sizes of the inlet and outlet ports and the check valves are constrained, which in turn limits the fluid throughput. However, the present inventor realized that three or more fluid communication ports may be provided at each end of the compressor to increase the fluid throughput. For example, at least two of the end ports may be inlet ports, or at least two of the end ports may be outlet ports. In some embodiments, two inlet ports and two outlet ports may be provided at each end of the compressor. The multiple inlet or outlet ports can be sized and arranged so they are offset from the hydraulic cylinder at the same end.

Accordingly, an example embodiment herein relates to a compressor for receiving a fluid supply, compressing the fluid and then moving the fluid to another location. The fluid may be a gas, a liquid or a multiphase fluid that comprises 100% gas, 100% liquid, or any proportion of gas/liquid therebetween. The compressor may include a compression chamber configured to receive a fluid which is compressed towards a first end or a second end of the compression chamber by a piston that is reciprocally moveable along an axial direction. The first and second ends of the chamber may each include three or more ports for fluid communication. At least one first inlet port at the first end of the compression chamber and at least one second inlet port at the second end of the compression chamber are configured to allow fluid to enter the compression chamber. The compressor may also include at least one first outlet port at the first end of the compression chamber and at least one second outlet port at the second end of the compression chamber, both configured to allow fluid to exit the compression chamber. Movement of the piston may be driven by at least one second cylinder connected to the piston within the first cylinder. The compressor may also include a plurality of check valves, each connected to one of the inlet and outlet ports, inline with the respective port along the axial direction. The position and alignment of the check valves relative to their respective port reduces dead volume and provides a straight flow path for fluid in and out of the compression chamber.

In an embodiment the check valves are oriented to be aligned with the axial direction of movement of the piston within the compression chamber. In a further embodiment, the check valves are perpendicular to the axial direction of movement of the piston within the compression chamber.

In an embodiment, the compressor may have two first inlet ports at the first end of the compression chamber and two second inlet ports at the second end of the compression chamber. The compressor may also include two first outlet ports at the first end of the compression chamber and two second outlet ports at the second end of the compression chamber. These ports may advantageously increase space at each end of the compressor for additional components to be accommodated such as for example, different sizes of hydraulic cylinders to drive movement of the piston.

In an embodiment, a first compressor may be configured to be connected to a second compressor. The first compressor may compress a fluid to a first pressure P1 and the second compressor may further compress the fluid to a second higher pressure P2.

The compressors may be configured to be operable to transfer multiphase mixtures of substances that comprise 100% gas, 100% liquid, or any proportion of gas/liquid therebetween, wherein during operation, the ratio of gas/liquid is changing, either intermittently, periodically, or substantially continuously. The compressors can also handle fluids that may also carry abrasive solid materials such as sand without damaging important components of the compressor system such as the surfaces of various cylinders and pistons.

Figure 2A:
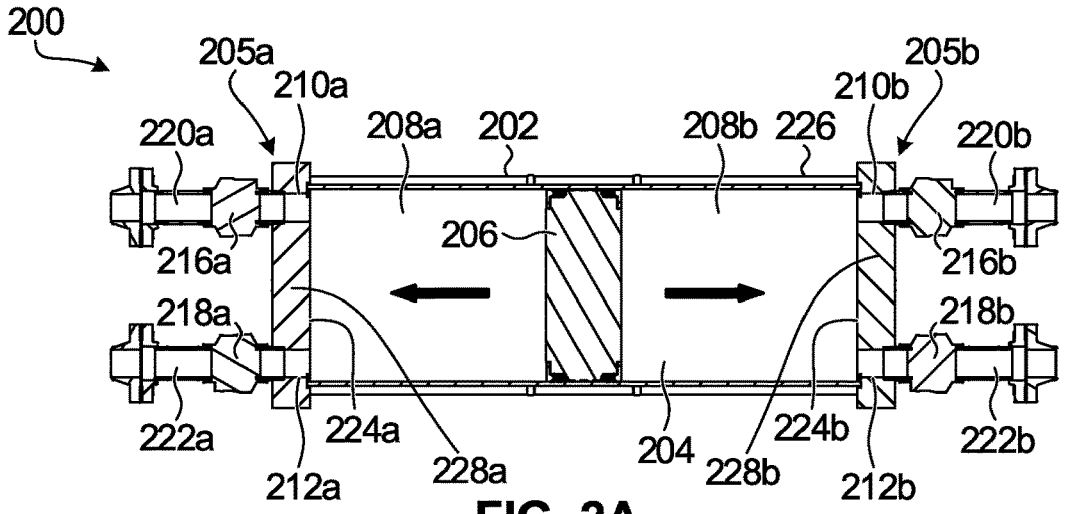
FIG. 2A is a schematic cross-sectional view of a simplified compressor, according to an example embodiment.

An example compressor 200 is schematically illustrated in FIG. 2A. As depicted, compressor 200 may include first cylinder 202 for compressing a fluid. First cylinder 202 may include tubular wall 226 with first and second end plates 228*a*, 228*b* at either end. The inner surface of tubular wall 226 and the inner surfaces of end plates 228*a*, 228*b* define compression chamber 204, which has first end 205*a* and second end 205*b*. Piston 206 may be reciprocally moveable within compression chamber 204 in an axial direction towards first end 205*a* or second end 205*b* as indicated by the arrows in FIG. 2A. Piston 206 divides compression chamber 204 into two adjacent first and second compression chamber sections 208*a*, 208*b*. At first end 205*a* of compression chamber 204 there may be two ports 210*a*, 212*a* configured to allow fluid to flow into and out of compression chamber section 208*a*. As shown in FIG. 2A, ports 210*a*, 212*a* may be cylindrical linear channels extending from the outer vertical side to the inner vertical side of plate 228*a*. At second end 205*b* there may be two ports 210*b*, 212*b* configured to allow fluid to flow into and out of compression chamber section 208*b*. As shown in FIG. 2A, ports 210*b*, 212*b* may be cylindrical linear channels extending from the outer vertical side to the inner vertical side of plate 228*b*. To each of ports 210*a*, 210*b*, 212*a*, 212*b*, respective check valves 216*a*, 216*b*, 218*a*, 218*b* may be connected. Check valves 216*a*, 216*b*, 218*a*, 218*b*, may be any suitable check valve, also known as a non-return valve, reflux valve, foot valve or one way valve, and are configured to move between an open configuration and a closed configuration. When in a closed configuration fluid flow is not permitted in either direction through the check valve. When in an open configuration, the check valves allow fluid to flow through in one direction only from an inlet side to an outlet side of the check valve. The check valve may switch from a closed configuration to an open configuration when the pressure is greater on the inlet side of the port than the outlet side, creating a pressure differential across the check valve. Once the pressure differential reaches a pre-determined value, known as the threshold pressure (also known as the cracking pressure), the check valves are configured to open, permitting fluid flow from the inlet side to the outlet side only. The check valves may be operable to be adjustable such that the threshold pressure that causes the check valve to open may be set at a desired value. The check valves are configured to switch from the open configuration back to the closed configuration, preventing fluid flow therethrough once the pressure differential drops to a lower pressure, known as the reseal pressure.

Check valves 216*a*, 216*b*, 218*a*, 218*b* may be any suitable type as is known in the art. For example, the check valves may be ball check valves, diaphragm check valves, swing check valves, lift check valves, in-line check valves or reed valves. In a specific embodiment, check valves 216*a*, 216*b*, 218*a*, 218*b* may be a threaded in-line check valve such as a 3" SCV Check Valve made by DFT Inc.

Check valves 216*a*, 216*b*, 218*a*, 218*b* may be connected to their respective ports 210*a*, 210*b*, 212*a*, 212*b* by any suitable method. For example, check valves 216*a*, 216*b*, 218*a*, 218*b* may have threaded fittings at either end configured to engage with corresponding threaded fittings at the outer end of ports 210*a*, 210*b*, 212*a*, 212*b*. In other embodiments, check valves 216*a*, 216*b*, 218*a*, 218*b* may be configured to be partially inserted into their respective ports 210*a*, 210*b*, 212*a*, 212*b* and secured by a suitable method such as welding.

The orientation of check valves 216*a*, 216*b*, 218*a*, 218*b* relative to ports 210*a*, 210*b*, 212*a*, 212*b* will determine if each port functions as an inlet port or an outlet port. As depicted in FIG. 2A, check valves 216*a*, 216*b* may be oriented such that ports 210*a*, 210*b* operate as inlet ports to supply fluid to compression chamber 204. This is achieved by connecting the outlet side of check valve 216*a* to the outer end of port 210*a* such that, when check valve 216*a* is in an open configuration, fluid is only permitted to flow into chamber section 208*a* through port 210*a*. Fluid is prevented from flowing out of chamber section 208*a* through check valve 216*a* at all times by the orientation of check valve 216*a*.

Similarly, the outlet side of check valve 216*b* may be connected to the outer end of port 210*b* such that, when check valve 216*b* is in an open configuration, fluid is only permitted to flow into chamber section 208*b* through port 210*b*. Fluid is prevented from flowing out of chamber section 208*b* through check valve 216*b* at all times by the orientation of check valve 216*b*.

Check valves 218*a*, 218*b* may be oriented such that ports 212*a*, 212*b* operate as outlet ports to remove fluid from compression chamber 204. The inlet side of check valve 218*a* may be connected to the outer end of port 212*a* such that, when check valve 218*a* is in an open configuration, fluid is only permitted to flow from chamber section 208*a* through port 212*a*. Fluid is prevented from flowing into chamber section 208*a* through check valve 218*a* at all times by the orientation of check valve 218*a*.

Similarly, the inlet end of check valve 218*b* may be connected to the outer end of port 212*b* such that, when check valve 218*b* is in an open configuration, fluid is only permitted to flow from chamber section 208*b* through port 212*b*. Fluid is prevented from flowing into chamber section 208*b* through check valve 218*b* at all times.

A pair of inlet conduits 220*a*, 220*b* may be connected to respective check valves 216*a*, 216*b* to supply fluid from a fluid source and a pair of outlet conduits 222*a*, 222*b* may be connected to respective check valves 218*a*, 218*b*, to receive compressed fluid from check valves 218*a*, 218*b*. In the embodiment shown in FIG. 2A, check valves 216*a*, 216*b*, 218*a*, 218*b* may be positioned inline with their respective ports 210*a*, 210*b*, 212*a*, 212*b* in the axial direction, which are in turn positioned inline with the axial direction of movement of piston 206.

Figure 2B:
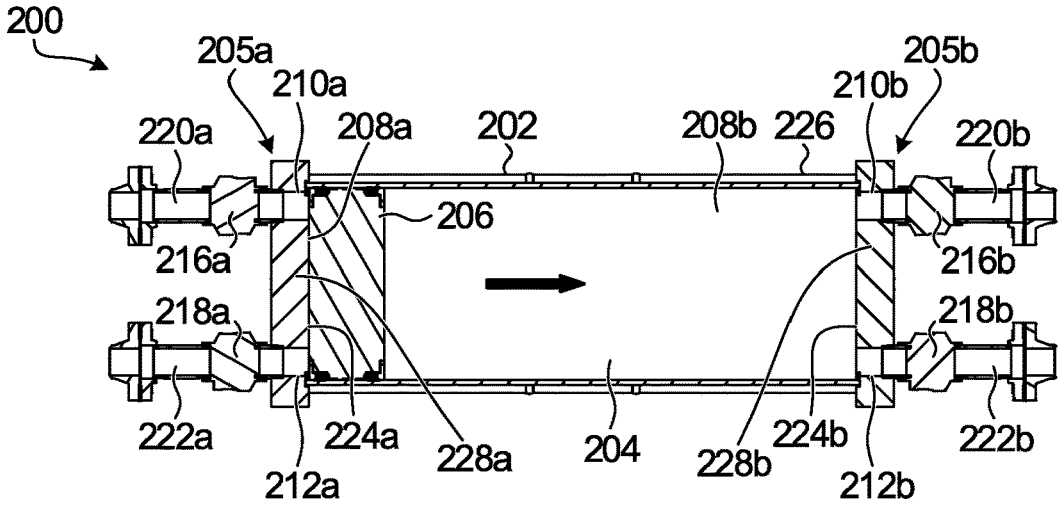
FIG. 2B is a schematic view of the compressor of FIG. 2A in operation at a first state.
Figure 2C:
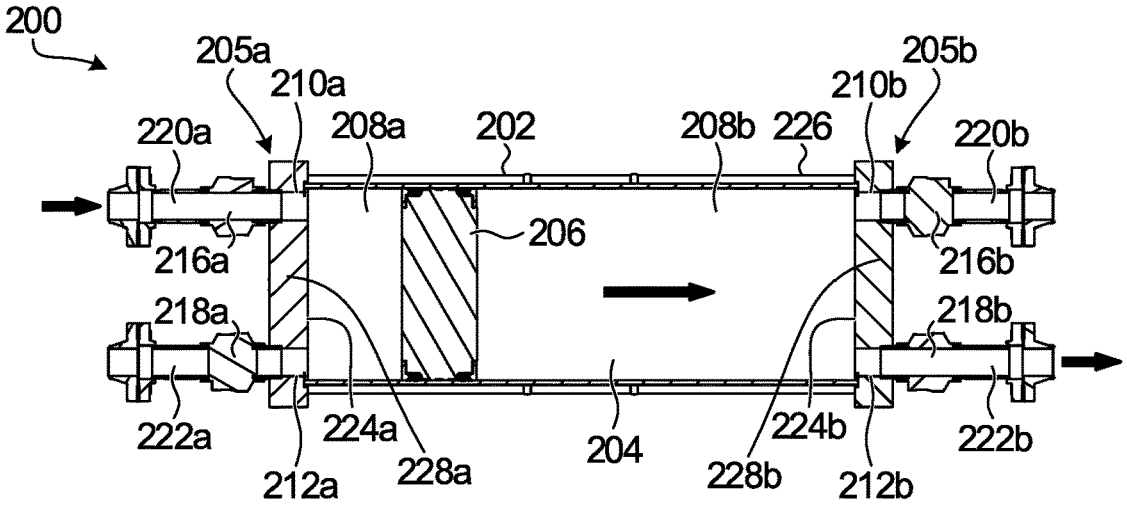
FIG. 2C is a schematic view of the compressor of FIG. 2A in operation at a second state.
Figure 2D:
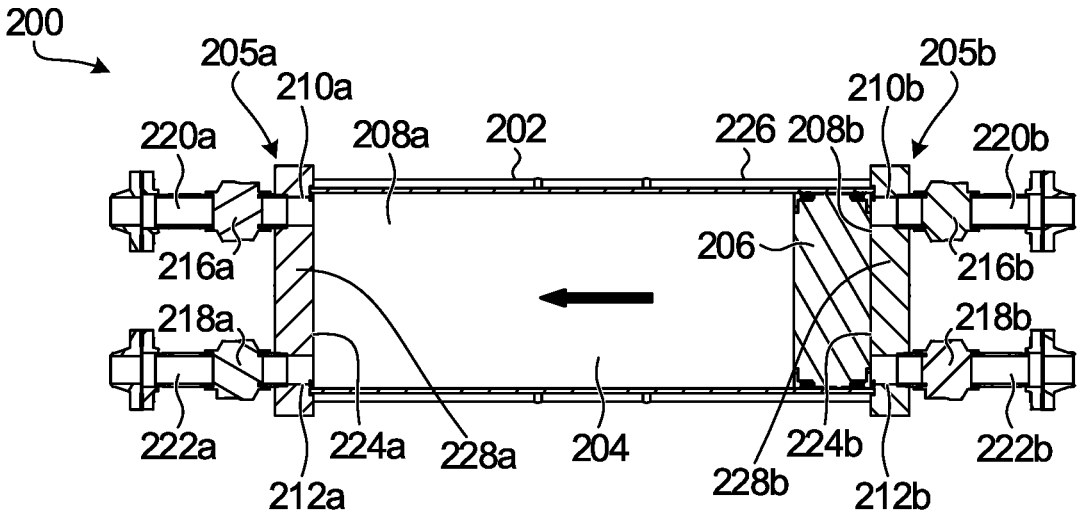
FIG. 2D is a schematic view of the compressor of FIG. 2A in operation at a third state.
Figure 2E:
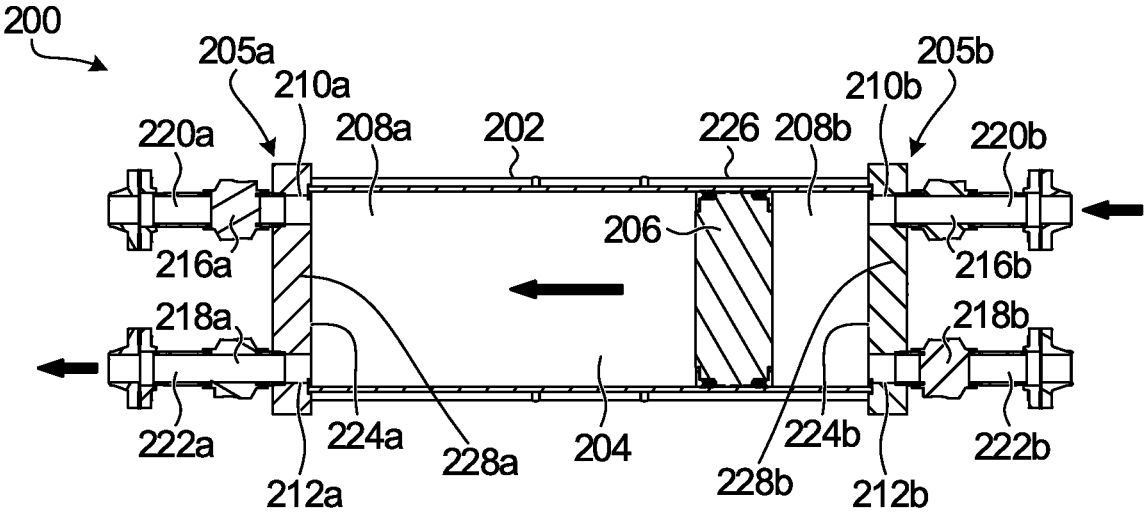
FIG. 2E is a schematic view of the compressor of FIG. 2A in operation at a fourth state.
Figure 3A:
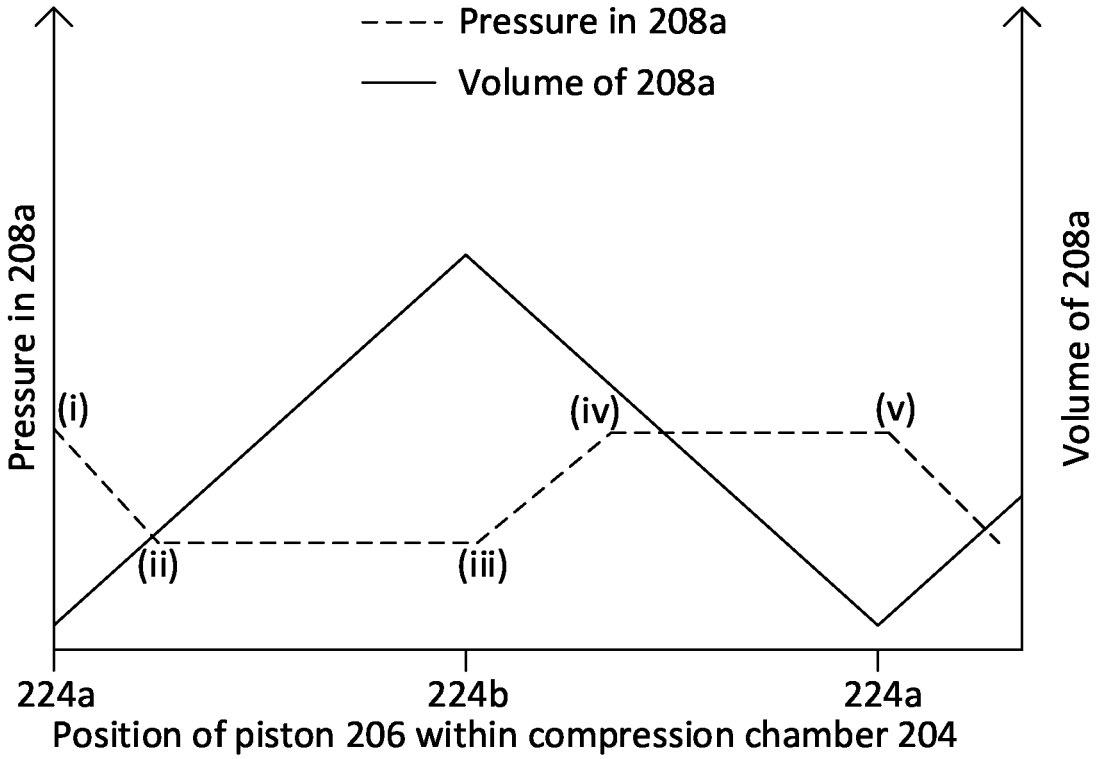
FIG. 3A is a line graph illustrating schematically the changes in the fluid volume and pressure between an end of the compression chamber and the piston during a piston stroke in the compressor of FIG. 2A.
Figure 3B:
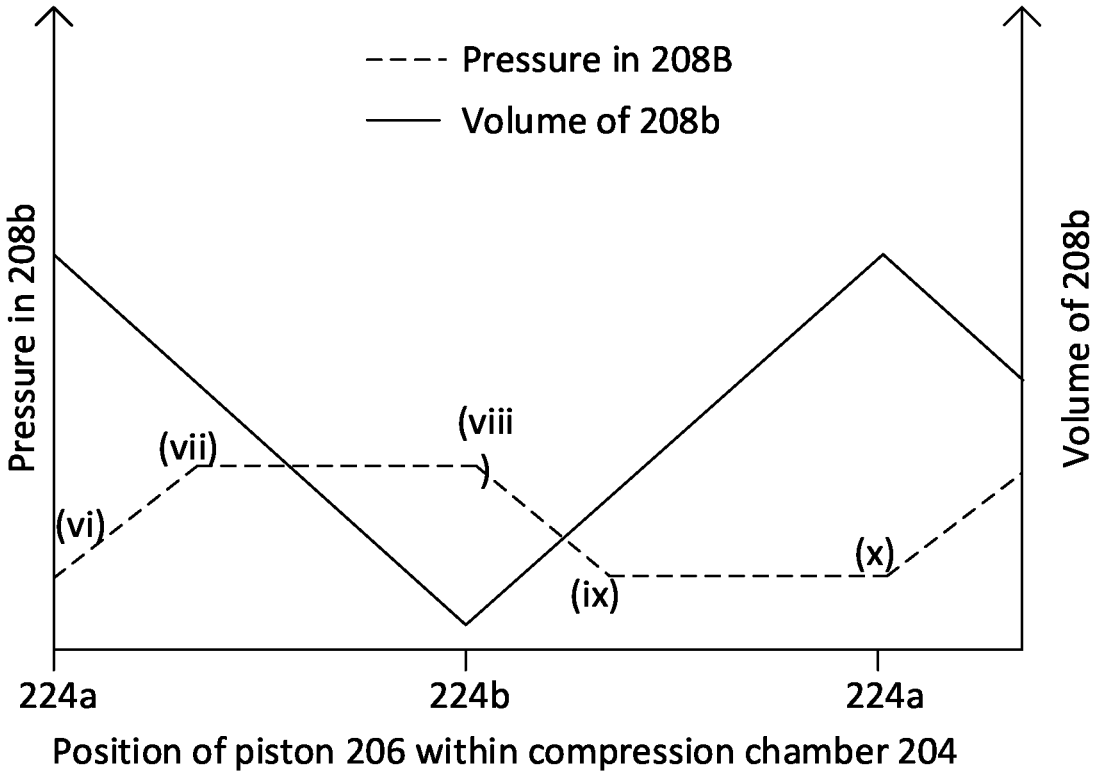
FIG. 3B is a line graph illustrating schematically the changes in the fluid volume and pressure between another end of the compression chamber and the piston during a piston stroke in the compressor of FIG. 2A.

With reference to FIGS. 2B to 2E, piston 206 may reciprocally move between first end of stroke position 224*a* at first end 205*a* of compression chamber 204 (shown in FIG. 2B) and second end of stroke position 224*b* at second end 205*b* of compression chamber 204 (shown in FIG. 2D). FIGS. 3A and 3B depict the change in volume of compression chamber sections 208*a*, 208*b* with the position of piston 206. With reference to FIG. 3A, when piston 206 is at position 224*a*, the volume of first compression chamber 208*a* is at a minimum volume (also referred to as the dead volume) and increases to a maximum volume once piston 206 reaches second end of stroke position 224*b*. As piston 206 returns to first end of stroke position 224*a*, the volume of first compression chamber will decease back to the minimum volume.

Similarly, as shown in FIG. 3B, the volume of second compression chamber 208*b* will increase from a minimum volume at the second end of stroke position 224*b* to a maximum volume at the first end of stroke position 224*a*.

As check valves 216*a*, 216*b*, 218*a*, 218*b* are positioned inline with their respective ports 210*a*, 210*b*, 212*a*, 212*b*, they may be positioned closer to their respective port. This will beneficially reduce the path volume between check valves 216*a*, 218*a* and piston 206 when piston 206 is first end of stroke position 224*a* and between check valves 216*b*, 218*b* and piston 206 when piston 206 is second end of stroke position 224*b*. As such, the dead volumes in the compressors shown in FIGS. 3A and 3B are less than that of the comparative compressor shown in FIG. 1.

As will be explained below, as piston 206 reciprocates within compression chamber 204, fluid may alternately enter, and exit each of the compression chamber sections 208*a*, 208*b*. Flow of fluid in and out of each compression chamber section 208*a*, 208*b* is controlled by the state of each of the check valves attached to the ports. One complete cycle of compressor 200 is illustrated in FIGS. 2B to 2D, with direction of fluid flow at each stage indicated. Piston 206 may start at first end of stroke position 224*a* shown in FIG. 2B and move, via the intermediate position shown in FIG. 2C to second stroke position 224*b* shown in FIG. 2D. Piston 206 may then reverse direction from second end of stroke position 224*b* and return to first end of stroke position shown in FIG. 2B, via the intermediate position shown in FIG. 2E. The change in volume and representative examples for the variation in pressure of first and second compression chambers 208*a*, 208*b* are shown in FIGS. 3A and 3B respectively.

Turning first to FIG. 2B, piston 206 is shown at first end of stroke position 224*a*. Check valves 216*a*, 216*b*, 218*a*, 218*b* are all closed such that fluid cannot flow into or out of first or second compression chamber sections 208*a*, 208*b*. Fluid will already be located in first and second compression chamber sections 208*a*, 208*b* having previously been drawn in during previous strokes.

As piston 206 moves in direction indicated by the arrow in FIG. 2B, the pressure in first compression chamber section 208*a* will drop as the volume increases (as shown between (i) and (ii) of FIG. 3A), causing a pressure differential to develop between the outer and inner sides of inlet check valve 216*a*. Once the differential pressure reaches the threshold pressure of valve 216*a*, valve 216*a* will open and fluid will flow from conduit 220*a* into first compression chamber section 208*a*, via inlet port 210*a* as shown in FIG. 2C. Once valve 216*a* is open, the pressure within first compression chamber section 208*a* will remain generally constant until piston 206 reaches the second end of stroke position 224*b*, (as shown between (ii) and (iii) of FIG. 3A). Once piston 206 reaches second end of stroke position 224*b* (FIG. 2D), valve 216*a* will close when the pressure differential between the outer and inner sides of valve 216*a* drops and reaches the reseal pressure of valve 216*a*.

At the same time, movement of piston 206 decreases the volume of second compression chamber 208*b* and increases the pressure within chamber section 208*b* as the fluid within chamber section 208*b* is compressed (as shown between (vi) to (vii) of FIG. 3B). This will cause a pressure differential to develop between the inner and outer side of outlet check valve 218*b*. Once the pressure differential reaches the threshold pressure of valve 218*b*, valve 218*b* will open and will flow out of second compression chamber section 208*b* and into conduit 222*b*, via outlet port 212*b*. Once valve 218*b* is open, the pressure within second compression chamber section 208*b* will remain generally constant (as shown between (vii) to (viii) of FIG. 3B) until piston 206 reaches second end of stroke position 224*b*. Once piston 206 reaches second end of stroke position 224*b* (FIG. 2D), valve 218*b* will close due to the pressure differential between the outer and inner sides of valve 218*b* dropping and reaching the reseal pressure of valve 218*b*.

Next, compressor 200 is configured for the return drive stroke. At second end of stroke position 224*b* shown in FIG. 2D, all check valves will be closed and with reference to (iii) of FIG. 3A, first compression chamber 208*a* will be at a maximum volume and contain fluid drawn in during the previous stroke. At the same time, with reference to (viii) of FIG. 3B, second compression chamber 208*b* will have its minimum volume and contain a volume of pressurised fluid (i.e. fluid at a higher pressure than the fluid in first compression chamber 208*a*).

As piston 206 moves in the direction indicated by the arrow in FIG. 2D, the pressure in second compression chamber section 208*b* will drop as the volume increases (as shown between (viii) and (ix) of FIG. 3B), causing a pressure differential to develop between the outer and inner sides of inlet check valve 216*b*. Once the differential pressure reaches the threshold pressure of valve 216*b*, valve 216*b* will open and fluid will flow from conduit 220*b* into first compression chamber section 208*b*, via inlet port 210*b* (FIG. 2E). Once valve 216*b* is open, the pressure within second compression chamber will remain generally constant until piston 206 reaches the first end of stroke position 224*a*, (as shown between (ix) and (x) of FIG. 3B). Once piston 206 reaches first end of stroke position 224*a* (FIG. 2B), valve 216*b* will close when the pressure differential between the outer and inner sides of valve 216*b* drops and reaches the reseal pressure of valve 216*b*.

At the same time, movement of piston 206 decreases the volume of first compression chamber 208*a* and increases the pressure in chamber section 208*a* as the fluid within is compressed (as shown between (iii) to (iv) of FIG. 3A). This will cause a pressure differential to develop between the inner and outer side of outlet check valve 218*a*. Once the pressure differential reaches the threshold pressure of valve 218*a*, valve 218*a* will open and will flow out of first compression chamber section 208*a* and into conduit 222*a*, via outlet port 212*a*. Once valve 218*a* is open, the pressure within first compression chamber section 208*a* will remain generally constant (as shown between (iv) to (v) of FIG. 3A) until piston 206 reaches first end of stroke position 224*a*. Once piston 206 reaches first end of stroke position 224*a* (FIG. 2B), valve 218*a* will close due to the pressure differential between the outer and inner sides of valve 218*a* dropping, reaching the reseal pressure of valve 218*a*.

The foregoing movement and compression of fluid within compression chamber 204 will continue as piston 206 continues to move between the first and second end of stroke positions 224*a*, 224*b*.

Figure 4:
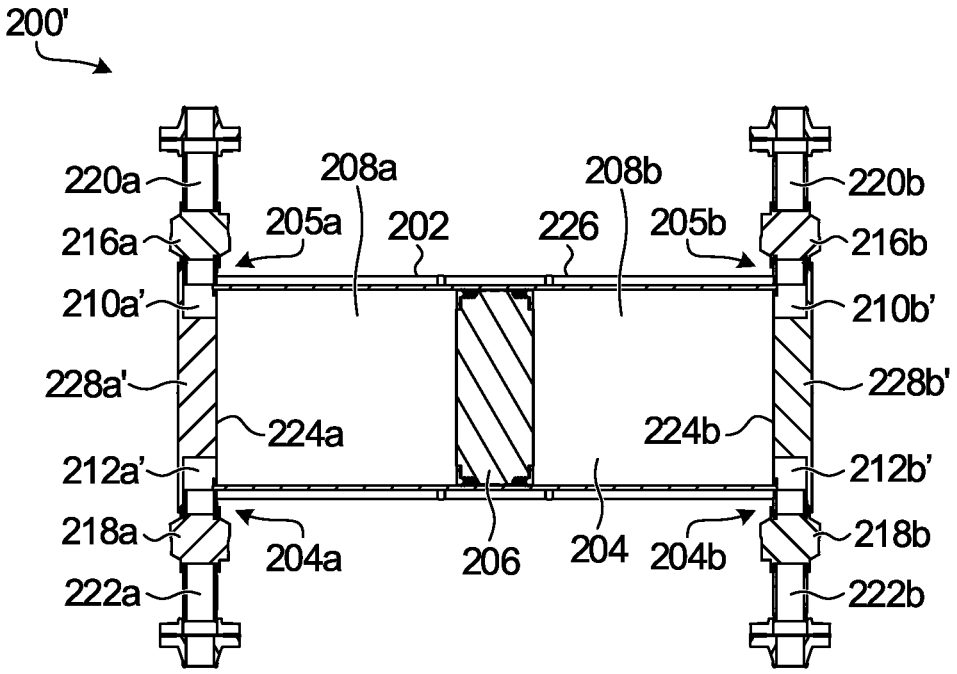
FIG. 4 is a schematic cross-sectional view of a simplified compressor, according to another example embodiment.

Turning to FIG. 4, an example compressor 200' according to another embodiment is shown schematically. Compressor 200' may be generally similar to compressor 200 as described above but in this embodiment, at either end of tubular wall 226 are first and second end plates 228*a*', 228*b*'. At first end 205*a* there may be two ports 210*a*', 212*a*' configured to allow fluid to flow into and out of first compression chamber section 208*a*. Ports 210*a*', 212*a*' may be cylindrical channels within plate 228*a*' extending from an outer side to an inner side of second end plate 228*a*'. Port 210*a*' may extend from the upper horizontal face to the inner vertical face of first end plate 228*a*'. Port 212*a*' may extend from the lower horizontal face to the inner vertical face of first end plate 228*a*'.

Similarly, at second end 205*b* there may be two ports 210*b*', 212*b*' configured to allow fluid to flow into and out of second compression chamber section 208*b*. Ports 210*b*', 212*b*' may be cylindrical channels within plate 228*b*' extending from an outer side to an inner side of second end plate 228*b*'. Port 210*b*' may extend from the upper horizontal face to the inner vertical face of first end plate 228*b*'. Port 212*b*' may extend from the lower vertical face to the inner vertical face of second end plate 228*b*'.

Similar to compressor 200, to each of ports 210*a*', 210*b*', 212*a*', 212*b*' respective check valves 216*a*, 216*b*, 218*a*, 218*b* may be connected. As the outer ends of ports 210*a*', 212*a*' are on the respective upper and lower faces of first end plate 228*a*' and the outer ends of ports 210*b*', 212*b*' are on the respective upper and lower faces of second end plate 228*b*', check valves 216*a*, 216*b*, 218*a*, 218*b* are positioned perpendicular to the axial direction of movement of piston 206.

As shown in FIG. 4, ports 210*a*', 210*b*', 212*a*', 212*b*' extend vertically though the respective end plate, before turning at 90 degrees inwards. In other embodiments, ports 210*a*', 210*b*', 212*a*', 212*b*' may follow any other suitable path, such as a curved path.

Figure 5A:
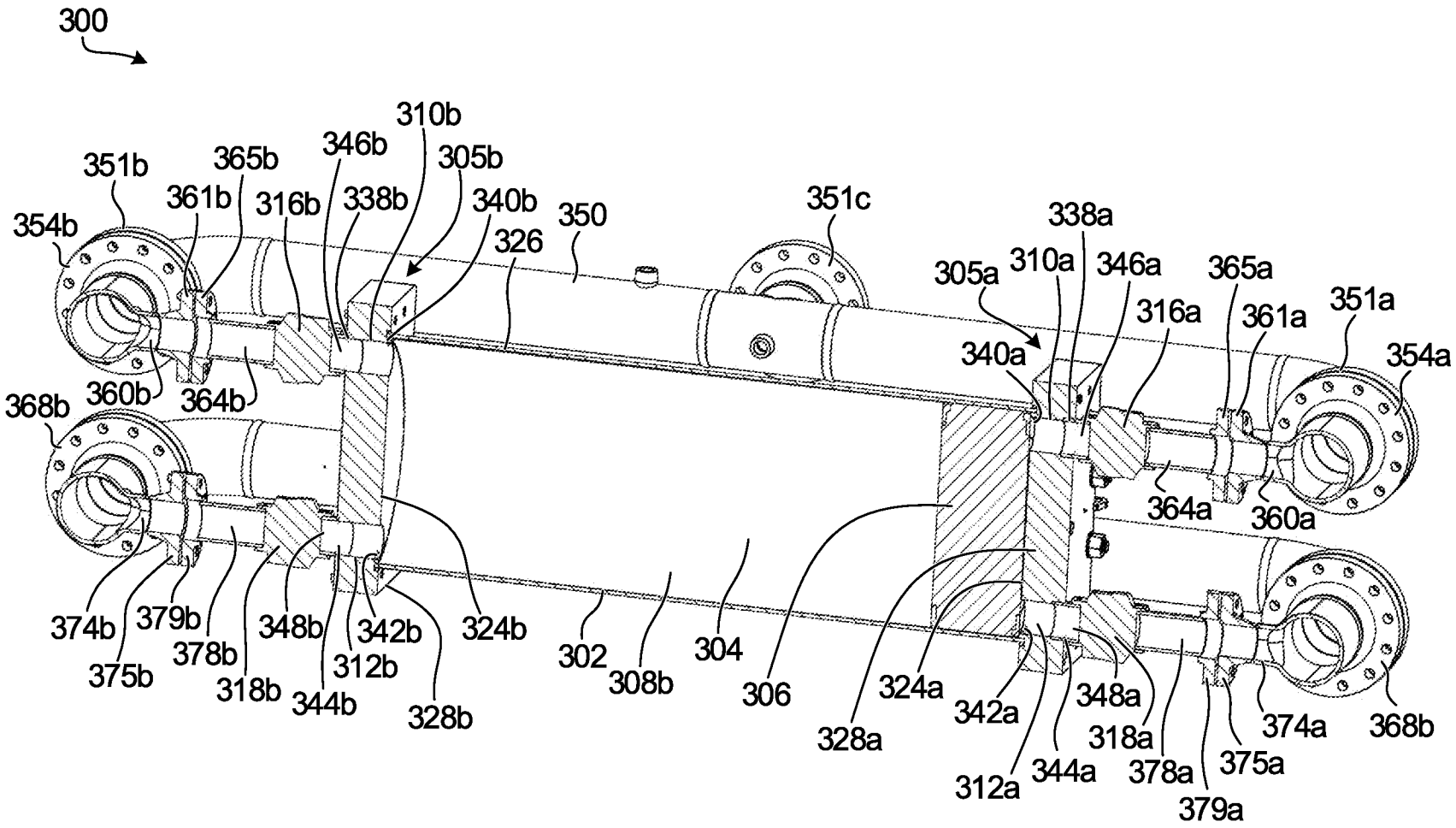
FIG. 5A is a cross-sectional rear perspective view of a compressor according to a further example embodiment.
Figure 5B:
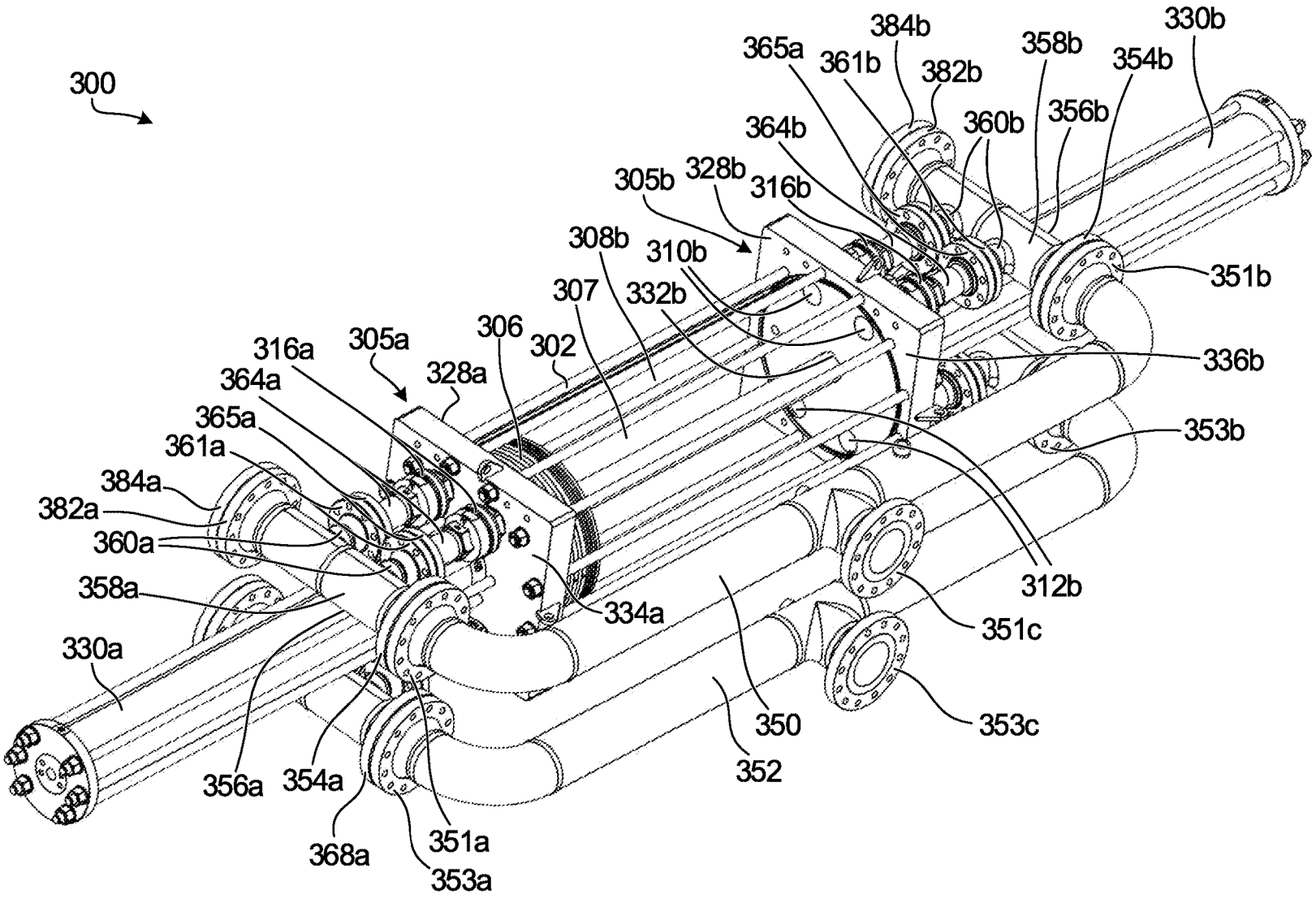
FIGS. 5B and 5C are partially transparent, front perspective views of the compressor of FIG. 5A.
Figure 5C:
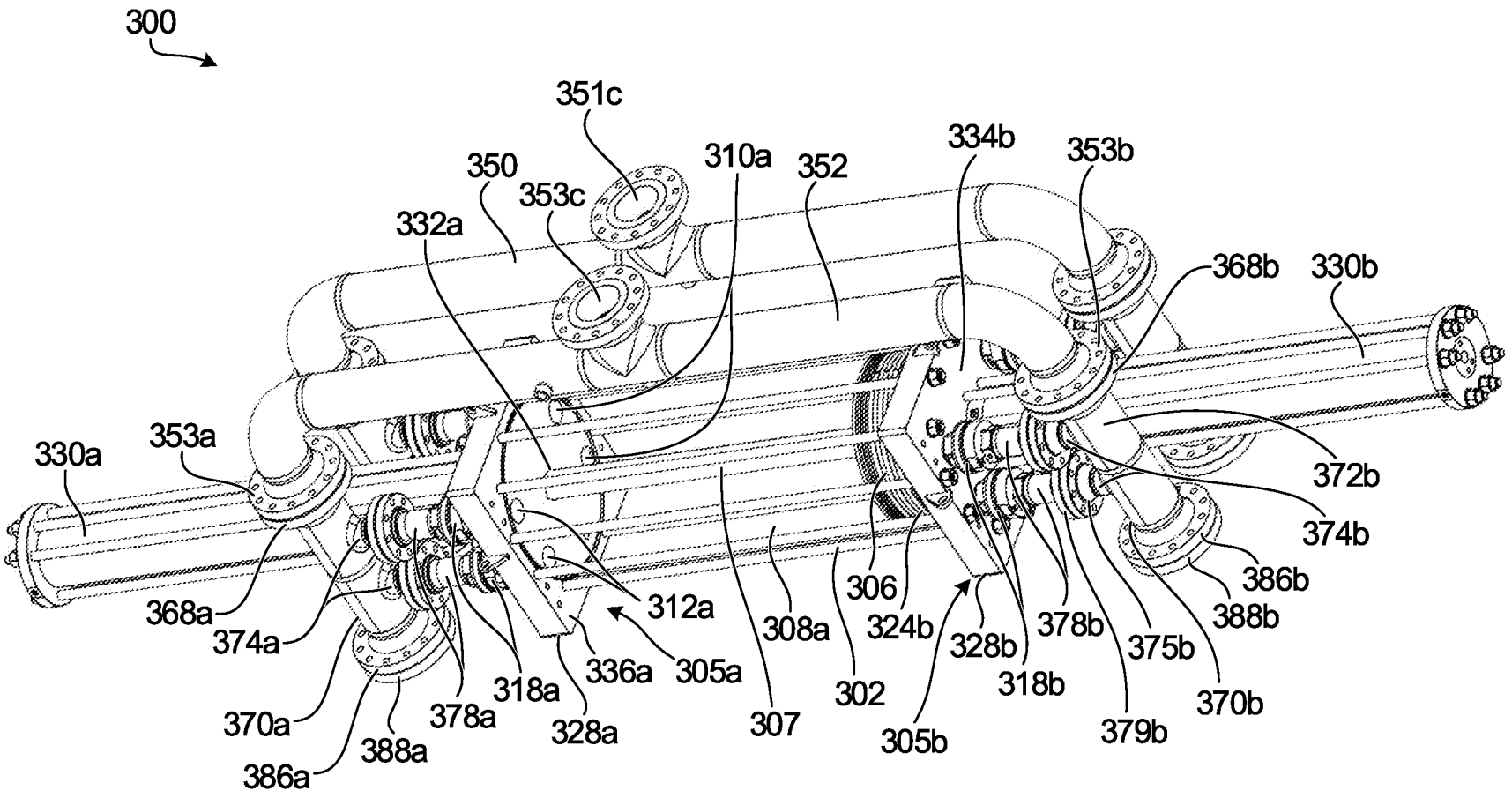

FIGS. 5A to 5I illustrate a compressor 300, which is an example embodiment of compressor 200. Compressor 300 may include first cylinder 302 for compressing a fluid within compression chamber 304 having first end 305*a* and second end 305*b* (FIG. 5A). First cylinder 302 may include cylinder barrel/tubular wall 326 positioned between first and second cylinder head plates 328*a*, 328*b* at respective first and second ends 305*a*, 305*b* of compression chamber 304. First cylinder 302 may also include piston 306, reciprocally moveable within compression chamber 304 in an axial direction towards first end 305*a* or second end 305*b*. Piston 306 may divide compression chamber 302 into two adjacent compression chamber sections 308*a* (FIG. 5C), 308*b* (FIG. 5B). First compression chamber section 308*a* may be defined by the interior surface of tubular wall 326, a surface of piston 306 and the inner face 336*a* of first head plate 328*a* (FIG. 5C). Second compression chamber section 308*b* may be formed on the opposite side of piston 306 to first compression chamber section 308*a* and may be defined by the interior surface of tubular wall 326, a surface of piston 306 and the inner face 336*b* of second head plate 328*b* (FIG. 5B).

Piston 306 may be reciprocally moveable within first cylinder 302 between a first end of stroke position 324*a* (FIGS. 5A and 5B) and second end of stroke position 324*b* (FIG. 5C). The end of stroke positions may be a physical end of stroke positions whereby for a physical first end of stroke position, the surface of piston 306 will contact the inner face 336*a* of first head plate 328*a*. Likewise, for a physical second end of stroke position, the surface of piston 306 will contact the inner face 336*b* of second head plate 328*b*. More desirably, for example to reduce noise and wear on components of compressor 300 during operation, the end of stroke positions are pre-defined end of stroke positions selected such that when piston 306 is almost at the physical end of stroke position, but not yet in contact with first or second head plates 328*a*, 328*b*. For example, in an embodiment, a pre-defined end of stroke position may be 0.5" away from first or second head plates 328*a*, 328*b*.

Compressor 300 may also include first and second, one way acting, hydraulic cylinders 330*a*, 330*b* (FIG. 5B) positioned at opposite ends of compressor 300. Hydraulic cylinders 330*a*, 330*b* may each include a hydraulic piston therewithin, each connected to opposite ends of piston rod 307 and each configured to provide a driving force that acts in an opposite direction to each other, both acting inwardly towards each other and towards first cylinder 302, thus driving reciprocal movement of piston 306.

First cylinder 302 and hydraulic cylinders 330*a*, 330*b* may have generally circular cross-sections although alternately shaped cross sections are possible in some embodiments.

With reference to FIG. 5C, first head plate 328*a* may have a generally square or rectangular shape with a pair of upper first inlet ports 310*a*, a pair of lower first outlet ports 312*a* and centrally located piston rod opening 332*a*. First inlet ports 310*a* and first outlet ports 312*a* may be circular openings that extend through first head plate 328*a* from outer face 334*a* to inner face 336*a* of first head plate 328*a*. Similarly, with reference to FIGS. 5B and 5H, second head plate 328*b* may have a generally square or rectangular shape with a pair of upper second inlet ports 310*b*, a pair of lower second outlet ports 312*b* and centrally located piston rod opening 332*b*. Second inlet ports 310*b* and second outlet ports 312*b* may be circular openings that extend through first head plate 328*b* from outer face 334*b* to inner face 336*b* of first head plate 328*b*.

First inlet ports 310*a* are configured to receive fluid at outer first end 338*a* and communicate fluid to inner second end 340*a* inside first chamber section 308*a* (FIG. 5A). Similarly, second inlet ports 310*b* are configured to receive fluid at outer first end 338*b* and communicate fluid to an inner, second end 340*b* inside second chamber section 308*b* (FIG. 5A).

First outlet ports 312*a* are configured to receive fluid from first chamber section 308*a* at inner first end 342*a* and communicate fluid to outer second end 344*a*. Similarly, second outlet ports 312*b* are configured to receive fluid from second chamber section 308*b* at inner first end 342*b* and communicate fluid to outer second end 344*b*.

Connected to each of first ends 338*a*, 338*b* of inlet ports 310*a*, 310*b* may be respective inlet check valves 316*a*, 316*b* configured to ensure that fluid may flow into compression chamber 304 from inlet ports 310*a*, 310*b* (i.e., fluid only travels from first ends 338*a*, 338*b* to second ends 340*a*, 340*b*). In some embodiments, inlet check valves 316*a*, 316*b* may be connected directly to first ends 338*a*, 338*b* of inlet ports 310*a*, 310*b*. In the embodiment shown in FIG. 5A, short conduits 346*a*, sized to be partially received within first ends 338*a* of inlet ports 310*a*, may be disposed between inlet check valve 316*a* and first inlet ports 310*a* to facilitate connection of check valves 316*a*. Similarly, short conduits 346*b*, sized to be partially received within first ends 338*b* of inlet ports 310*b*, may be disposed between inlet check valve 316*b* and second inlet port 310*b* to facilitate connection of check valve 316*b*.

Similarly, connected to each of the second ends 344*a*, 344*b* of outlet ports 312*a*, 312*b* may be respective outlet check valves 318*a*, 318*b* configured to ensure that fluid may only flow from compression chamber 304 into outlet ports 312*a*, 312*b*, (i.e., fluid only travels in the direction from first ends 342*a*, 342*b* to second ends 344*a*, 344*b*). In some embodiments, outlet check valves 318*a*, 318*b* may be connected directly to second ends 344*a*, 344*b* of outlet ports 312*a*, 312*b*. In the embodiment shown in FIG. 5A, short conduits 348*a*, sized to be partially received within second ends 344*a* of outlet ports 312*a*, may be disposed between outlet check valve 318*a* and first outlet port 312*a* to facilitate connection of check valve 318*a*. Similarly, short conduits 348*b*, sized to be partially received within second ends 344*b* of outlet ports 312*b*, may be disposed between outlet check valve 318*b* and second outlet port 312*b* to facilitate connection of check valve 318*b*.

Connections between ports 310*a*, 310*b*, 312*a*, 312*b*, conduits 346*a*, 346*b*, 348*a*, 348 and check valves 316*a*, 316*b*, 318*a*, 318*b* may be facilitated by any suitable method, such as welding or by providing complementary threaded ends between adjoining components.

In operation, compressor 300 may operate in a similar manner to as previously described for compressor 200. Similar to as described above for compressor 200, check valves 316*a*, 316*b*, 318*a*, 318*b* are operable to move between open and closed configurations depending on the pressure differential across each check valve. When in a closed configuration, fluid is not permitted to flow in either direction through the check valve. When in an open configuration, fluid is permitted to flow in one direction only through the check valve. As shown in FIG. 2A, check valves 316*a*, 316*b*, 318*a*, 318*b* are all in a closed configuration and fluid may not enter or leave compression chamber 304.

Figure 5D:
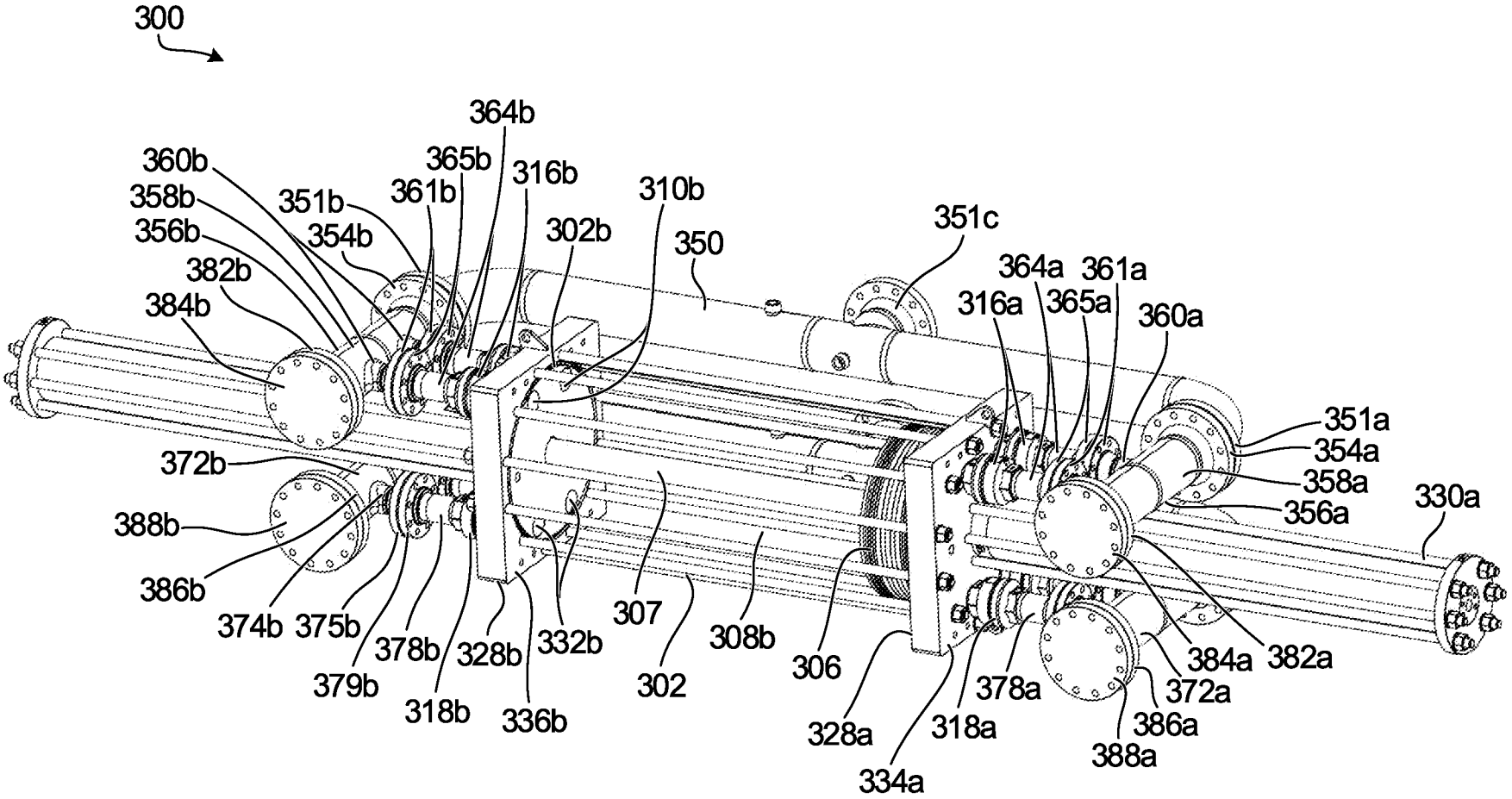
FIG. 5D is a partially transparent, rear perspective view of the compressor of FIG. 5A.
Figure 5E:
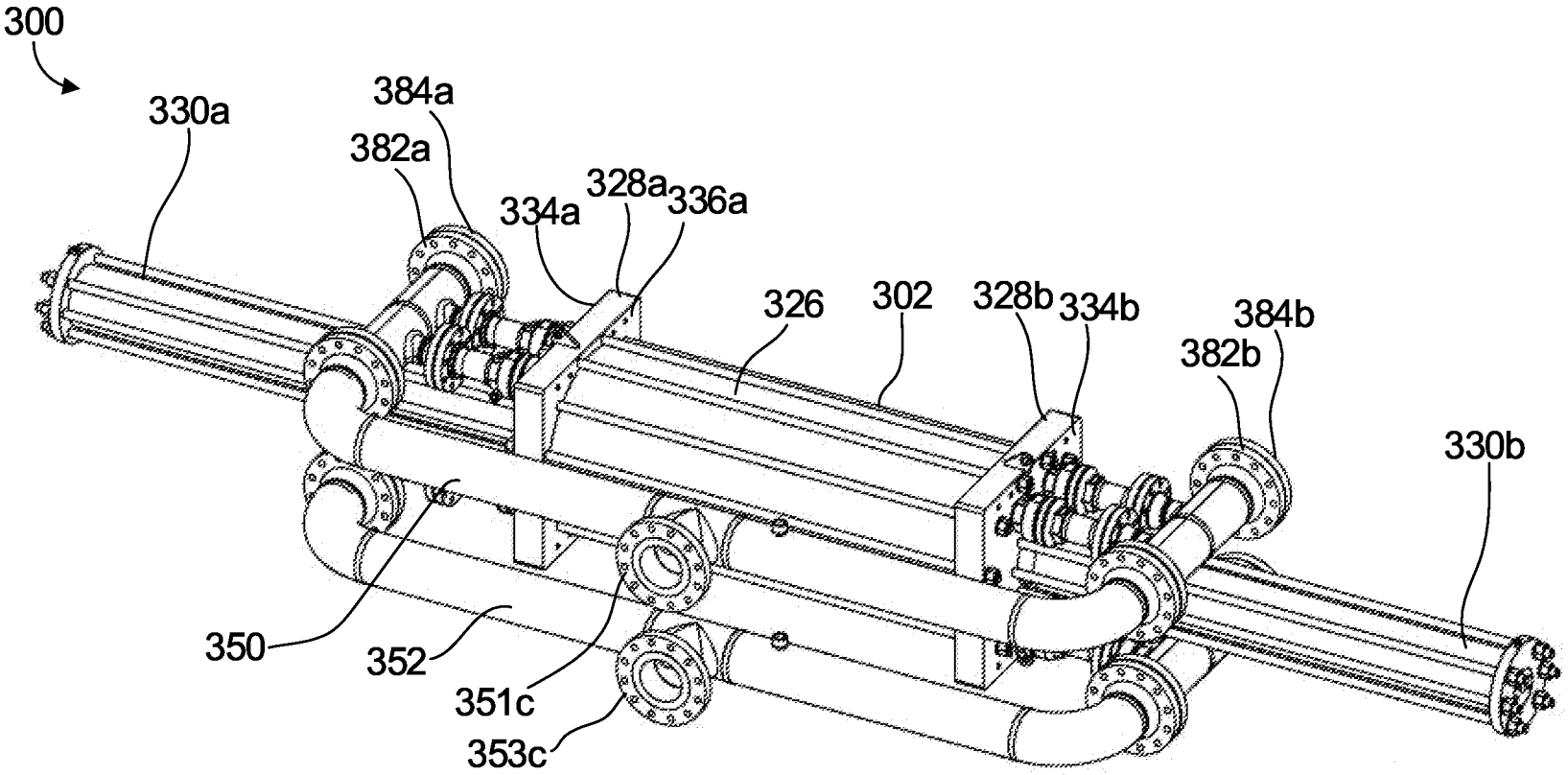
FIGS. 5E and 5F are front perspective and top plan views of the compressor of FIG. 5A.
Figure 5F:
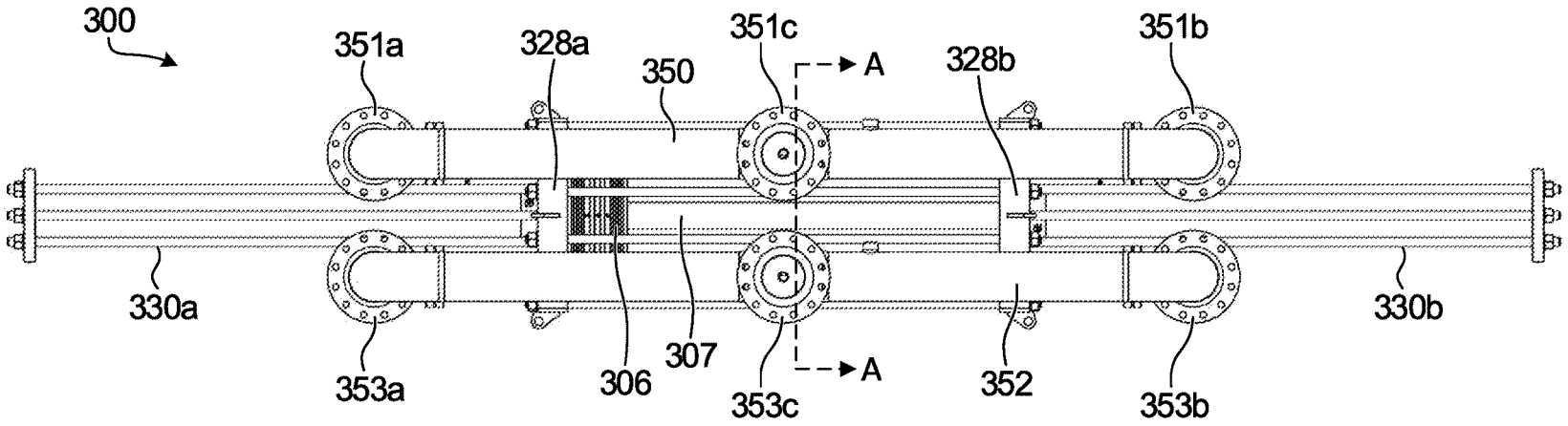
Figure 5G:
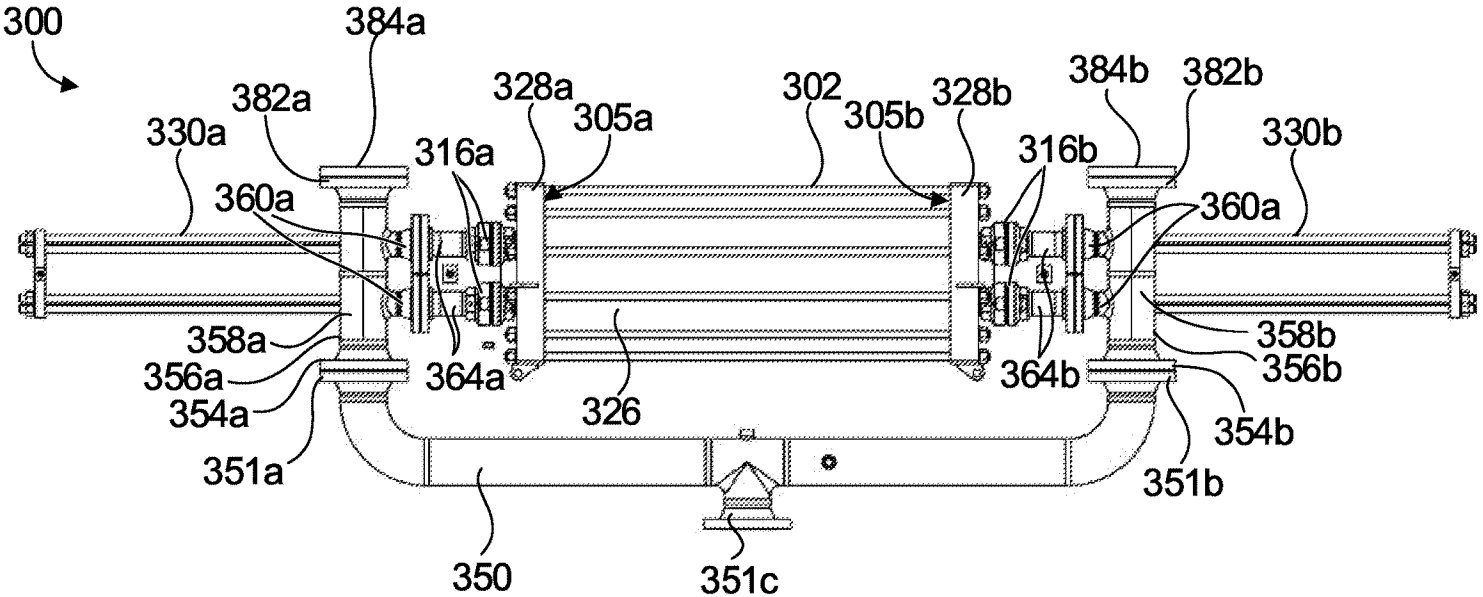
FIG. 5G is a partially transparent front view of the compressor of FIG. 5A.
Figure 5H:
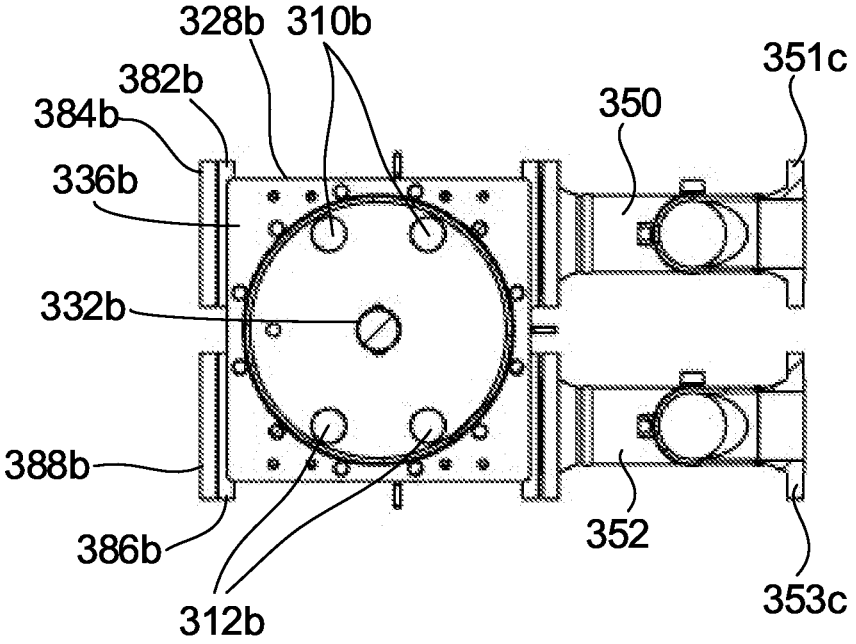
FIG. 5H is a cross sectional end view of the compressor of FIG. 5A, along the line A-A in FIG. 5G.
Figure 5I:
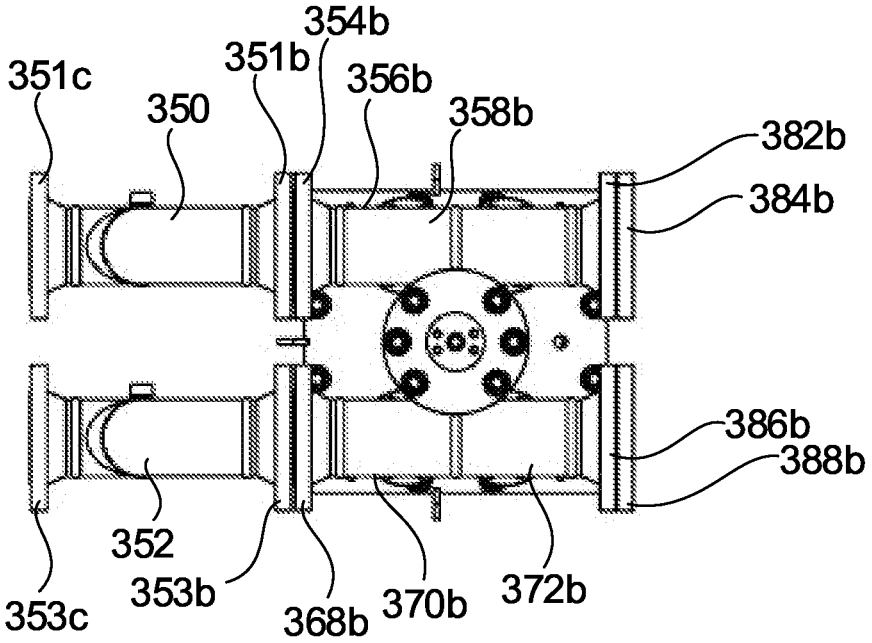
FIG. 5I is an end view of the compressor of FIG. 5A.
Figure 5J:
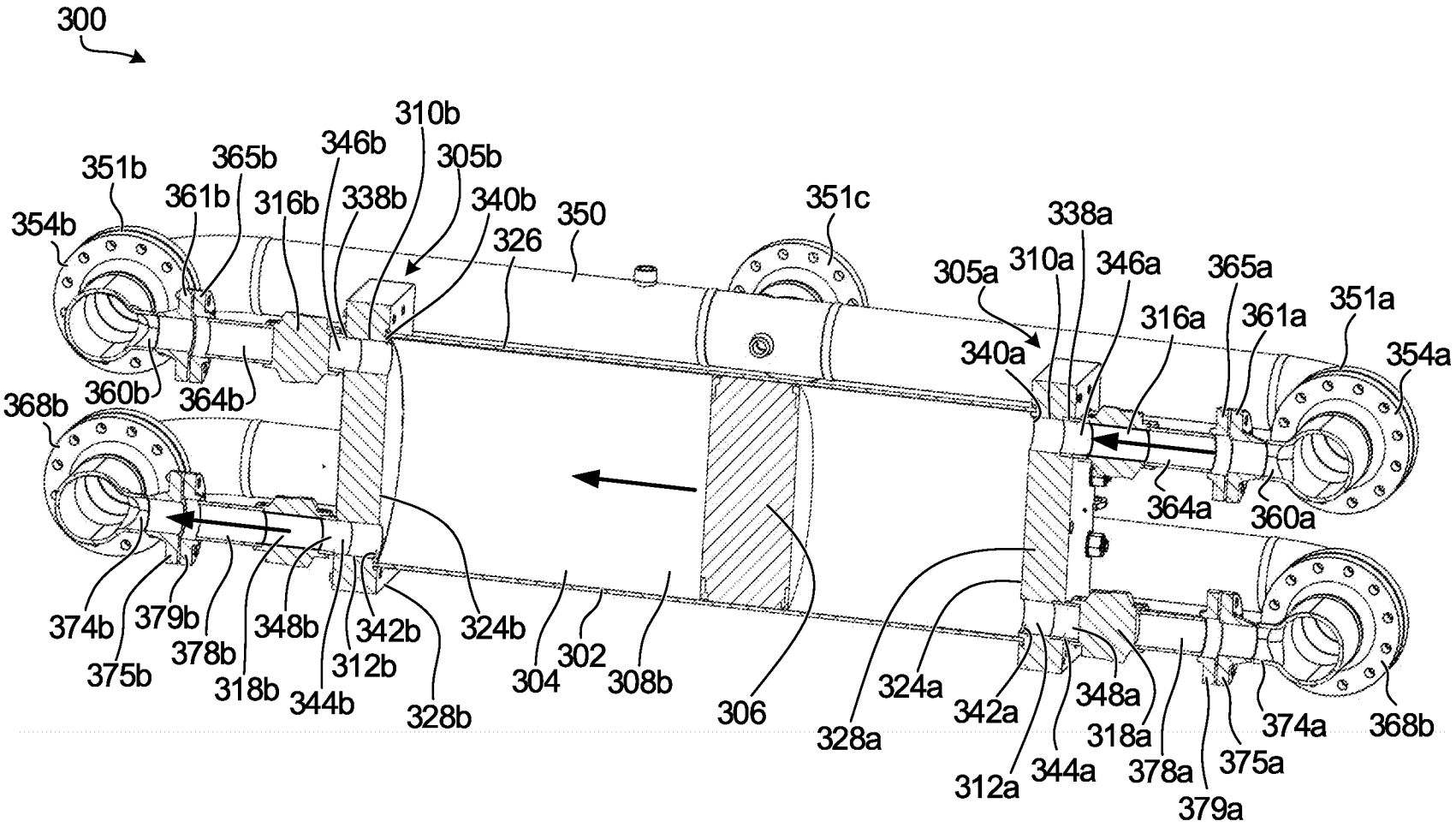
FIG. 5J is a cross-sectional rear perspective view of the compressor of FIG. 5A, with some check valves in an open configuration.

With reference to FIG. 5J, inlet check valve 316*a* and outlet check valve 318*b* are shown in the open configuration. This configuration is similar to as shown in FIG. 2C for compressor 200 and may occur when piston 306 is moving from first end of stroke position 324*a* to second end of stroke position 324*b* and the pressure differential across check valves 316*a*, 318*b* has reached the threshold pressure of the valves. With inlet check valves 316*a* in an open configuration, fluid can flow as indicated through secondary conduits 360*a*, inlet check valve connectors 364*a*, inlet check valves 316*a*, conduits 346*a* and into first compression chamber section 308*a* through first inlet ports 310*a*. With outlet check valves 318*b* in an open configuration, fluid can flow as indicated from second compression chamber section 308*b*, through second outlet ports 312*b*, conduits 348*b*, outlet check valves 318*b*, and into outlet check valve connectors 378*b*.

Figure 5K:
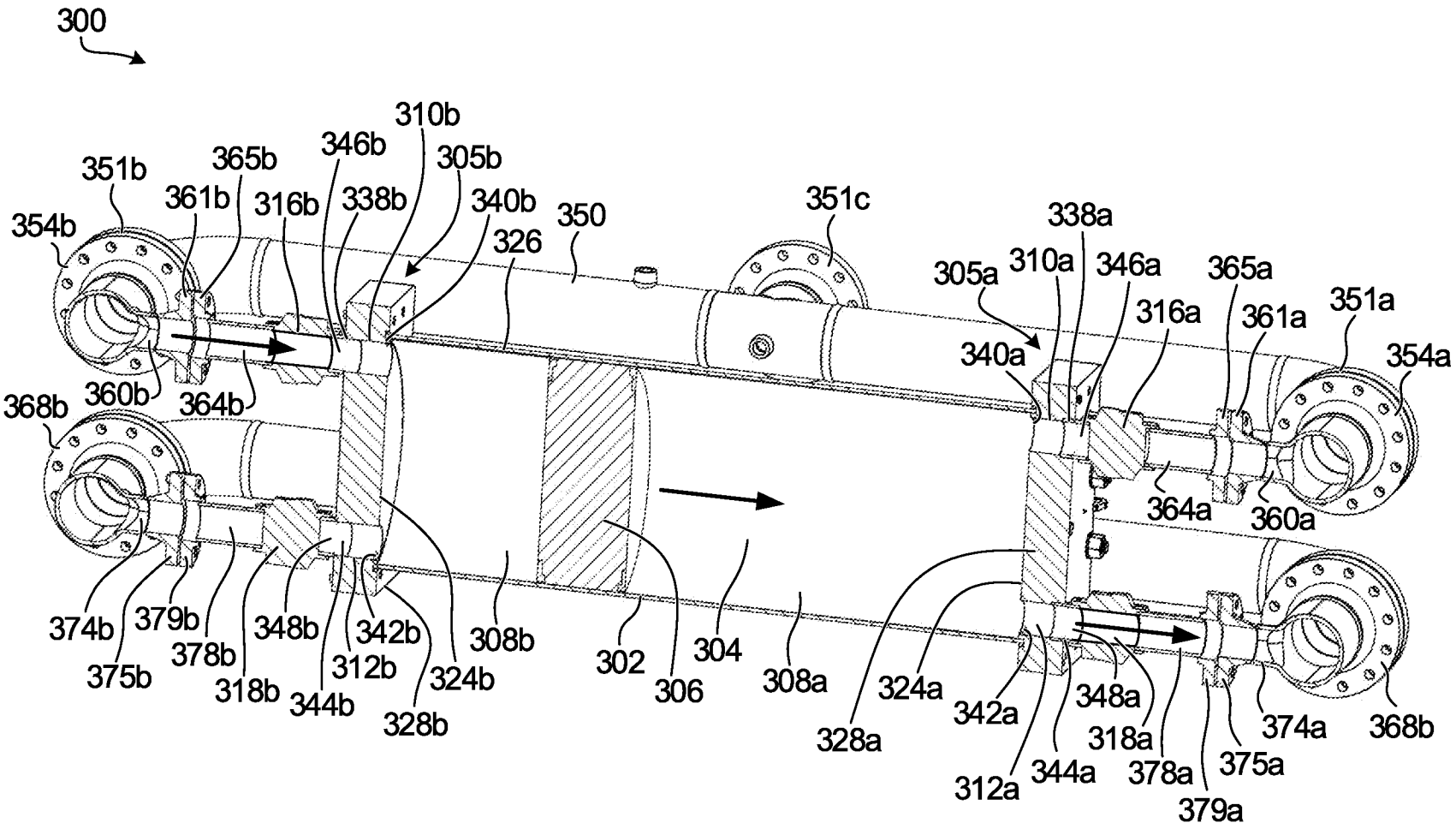
FIG. 5K is a cross-sectional rear perspective view of the compressor of FIG. 5A, with some check valves in an open configuration.

With reference to FIG. 5K, inlet check valve 316*b* and outlet check valve 318*a* are shown in the open configuration. This configuration is similar to as shown in FIG. 2E for compressor 200 and may occur when piston 306 is moving from second end of stroke position 324*b* to first end of stroke position 324*a* and the pressure differential across check valves 316*b*, 318*a* has reached the threshold pressure of the valves. With inlet check valves 316*b* in an open configuration, fluid can flow as indicated through secondary conduits 360*b*, inlet check valve connectors 364*b*, inlet check valves 316*b*, conduits 346*b* and into second compression chamber section 308*b* through first inlet ports 310*b*. With outlet check valves 318*a* in an open configuration, fluid can flow as indicated from first compression chamber section 308*a*, through first outlet ports 312*a*, conduits 348*a*, outlet check valves 318*a*, and into outlet check valve connectors 378*a*.

By providing multiple, smaller inlet and outlet ports on each of first and second head plates 328*a*, 328*b* (and corresponding smaller check valves and connectors) as opposed to single larger ports on each head plate, larger hydraulic cylinders may be used with compressor 300, which may be desirable in some applications such as when compressing a fluid with a high proportion of liquid.

With reference to FIGS. 5B-D in particular, the fluid communication system is shown, which provides fluid to compressor 300 to be compressed within compression chamber 304, may include suction intake manifold 350 and pressure discharge manifold 352.

On the fluid intake side of compressor 300, suction intake manifold 350 may have two manifold outlets 351*a* and 351*b* and a single manifold inlet 351*c*. A flange associated with outlet 351*a* is connected to first flange 354*a* of inlet connector 356*a*. Inlet connector 356*a* may include primary conduit 358*a*, which may have the same interior channel diameter as manifold 350, and a pair of smaller, spaced apart secondary conduits 360*a* extending orthogonally from primary conduit 358*a* (FIG. 5B). Flanges 361*a* associated with secondary conduits 360*a* are each connected to flanges 365*a* associated with inlet check valve connectors 364*a* which are in turn configured to connect to input check valves 316*a*. As such, inlet connector 356*a* and inlet check valve connectors 364*a* may provide fluid communication from outlet 351*a* of suction intake manifold 350 to inlet check valves 316*a*.

Similarly, a flange associated with outlet 351*b* is connected to first flange 354*b* of inlet connector 356*b*. Inlet connector 356*b* may include a primary conduit 358*b*, which may have the same interior channel diameter as manifold 350, and a pair of smaller, spaced apart secondary conduits 360*b* extending orthogonally from primary conduit 358*b* (FIGS. 5B, 5D). Flanges 361*b* associated with secondary conduits 360*b* are connected to flanges 365*b* associated with check valve connectors 364*b*, configured to connect to input check valves 316*b*. As such, inlet connector 356*b* and inlet check valve connectors 364*b* may provide fluid communication from outlet 351*b* of suction intake manifold 350 to inlet check valves 316*b*.

With reference to FIG. 5C, on the fluid pressure discharge side of compressor 300, pressure discharge manifold 352 may have two manifold inlets 353*a* and 353*b* and a single manifold outlet 353*c*. A flange associated with inlet 353*a* is connected to first flange 368*a* of outlet connector 370*a*. Outlet connector 370*a* may include primary conduit 372*a*, which may have the same interior channel diameter as manifold 352 and a pair of smaller, spaced apart secondary conduits 374*a* extending orthogonally from primary conduit 372*a*. Flanges 375*a* associated with secondary conduits 374*a* are connected to flanges 379*a* associated with outlet check valve connectors 378*a*, which are configured to connect to outlet check valves 318*a*. As such, outlet connector 370*a* and outlet check valve connectors 378*a* may provide fluid communication from outlet check valves 318*a* to manifold inlet 353*a* of pressure discharge manifold 352.

Similarly, a flange associated with inlet 353*b* is connected to a first flange 368*b* of outlet connector 370*b*. Outlet connector 370*a* may include a primary conduit 372*b*, which may have the same interior channel diameter as manifold 352 and a pair of smaller, spaced apart secondary conduits 374*b* extending orthogonally from primary conduit 372*b*. Flanges 375*b* associated with secondary conduits 374*b* are connected to flanges 379*b* associated with outlet check valve connectors 378*b*, which are configured to connect to outlet check valves 318*b*. As such, outlet connector 370*b* and outlet check valve connectors 378*b* may provide fluid communication from outlet check valves 318*b* to manifold inlet 353*b* of pressure discharge manifold 352.

Inlet connector 356*a* may also include second flange 382*a* at the opposite end of conduit 358*a* to first flange 354*a* and inlet connector 356*b* may also include second flange 382*b* at the opposite end of conduit 358*b* to first flange 354*b* (FIG. 5B). Blanking plates 384*a*, 384*b* may be secured to second flanges 382*a*, 382*b* respectively.

Outlet connector 370*a* may also include second flange 386*a* at the opposite end of conduit 372*a* to first flange 368*a* and outlet connector 370*b* may also include a second flange 386*b* at the opposite end of conduit 372*b* to first flange 368*b* (FIG. 5C). Blanking plates 388*a*, 388*b* may be secured to second flanges 386*a*, 388*b* respectively.

Second flanges 382*a*, 382*b*, 386*a*, 386*b*, may be operable to facilitate connections between multiple compressors, a representative example of which will be discussed later.

The manifolds, conduits and connectors described above may be sized dependent upon the required output/discharge pressures and output flow rates to be produced by compressor 300 and may be sized in order to achieve a desired maximum required flow velocity through compressor 300. In an embodiment the maximum flow velocity is 23 feet per second. For example, in some embodiments, suction intake manifold 350, pressure discharge manifold 352 and primary conduits 358*a*, 358*b*, 372*a*, 372*b* may all have approximately the same interior channel diameter, such as in the range of 4-6 inches or even greater. Secondary conduits 360*a*, 360*b*, 374*a*, 374*b*, check valve connectors 364*a*, 364*b*, 378*a*, 378*b* and conduits 346*a*, 346*b*, 348*a*, 346*b* may all have approximately the same interior channel diameter, such as in the range of 2-4 inches or even greater. Connections between the manifolds, check valves and conduits described above may be secured by any suitable method, such as by welding or by using threaded connections.

As shown in FIGS. 5A to 5I, compressor 300 is configured with inlet ports 310*a*, 310*b* at the top and outlet ports 312*a*, 312*b* at the bottom of cylinder heads 328*a*, 328*b*. This configuration may be beneficial, for example when compressor 300 is handling a fluid that contains a significant proportion of solids and/or debris which will migrate to the bottom of compression chamber 304 due to gravity and will be pumped out of chamber 304 during reciprocal movement of piston 306. This may increase the reliability of compressor 300 as the accumulation of solids and/or debris within compression chamber 304 is reduced.

However, the configuration of inlet and outlet ports may be selected according to the particular application of compressor 300 and may depend on a number of factors such as the desired inlet (suction) pressure, outlet pressure, gas and liquid volume fraction of the fluid and the proportion of solids and other debris in the fluid.

In other embodiments, the upper two ports on each of cylinder heads 328*a*, 328*b* may be outlet ports whilst the lower two ports may be inlet ports. This configuration may be beneficial, for example, when handling a fluid with a higher gas volume fraction and when a lower inlet pressure is desired.

Compressor 300 may be in hydraulic fluid communication with a hydraulic fluid supply system which may provide an open loop or closed loop hydraulic fluid supply circuit. The hydraulic fluid supply system may be configured to supply a driving fluid to drive the hydraulic pistons in hydraulic cylinders 330*a*, 330*b*.

Compressor 300 may also include a controller to control the operation of compressor 300, such as by changing the operational mode of the hydraulic fluid supply system. The control system may include a number of sensors such as proximity sensors in order to detect the position of components such as piston 306 within first cylinder 302 or pistons within hydraulic cylinders 330*a*, 330*b* in order to determine when piston 306 is approaching or has reached either of the end of stroke positions 324*a*, 324*b*. The controller may use information from the sensors to control the hydraulic fluid system in order to control and adjust the reversal of piston 306 in either direction. Examples of hydraulic cylinders, hydraulic fluid supply system and a control system suitable for use with compressor 300 are disclosed in U.S. Pat. No. 10,544,783, and US 20210270257, the entire contents of each of which are incorporated herein by reference.

Figure 6A:
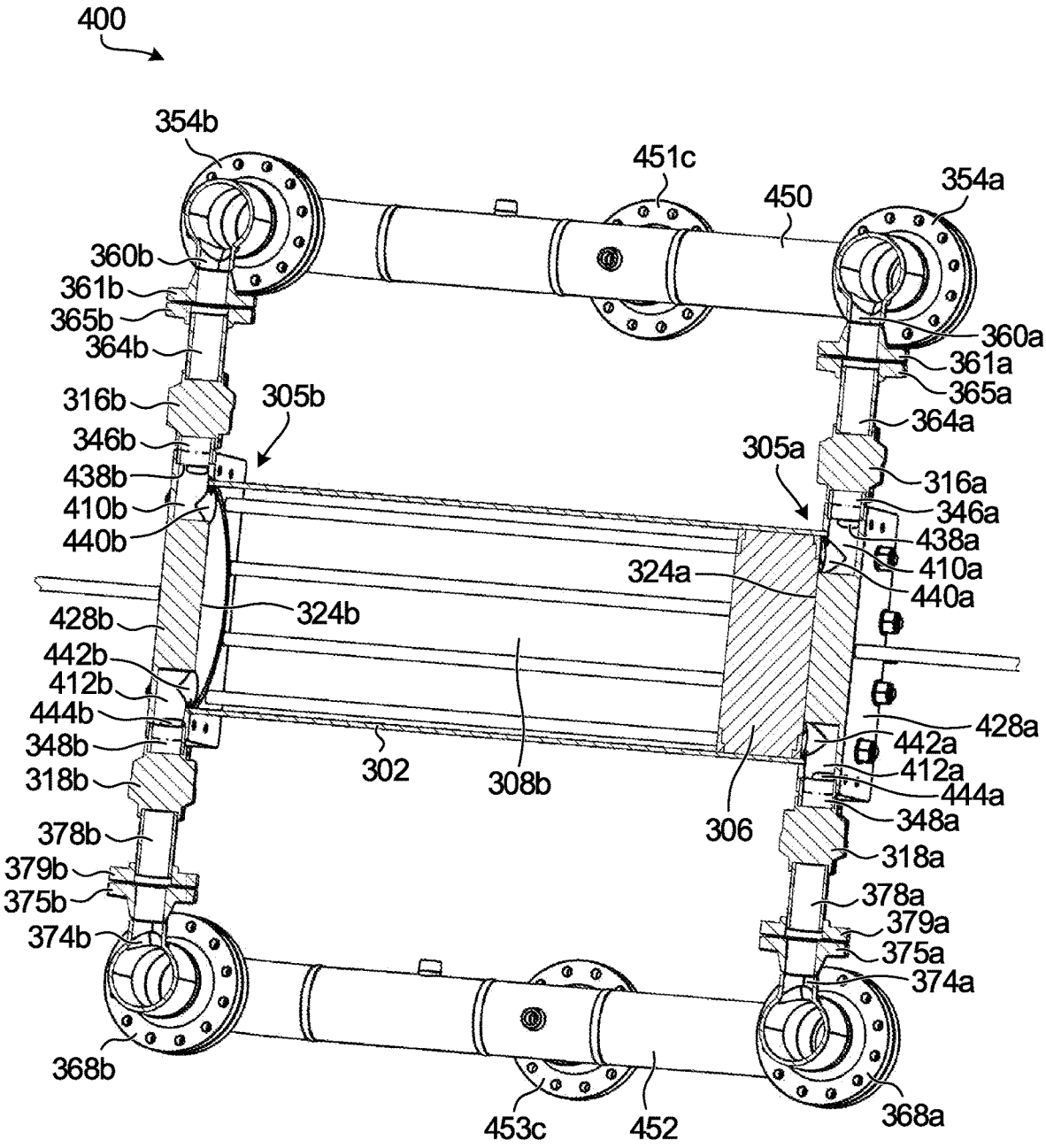
FIG. 6A is a partially transparent, cross-sectional rear perspective view of a compressor according to a further embodiment.
Figure 6B:
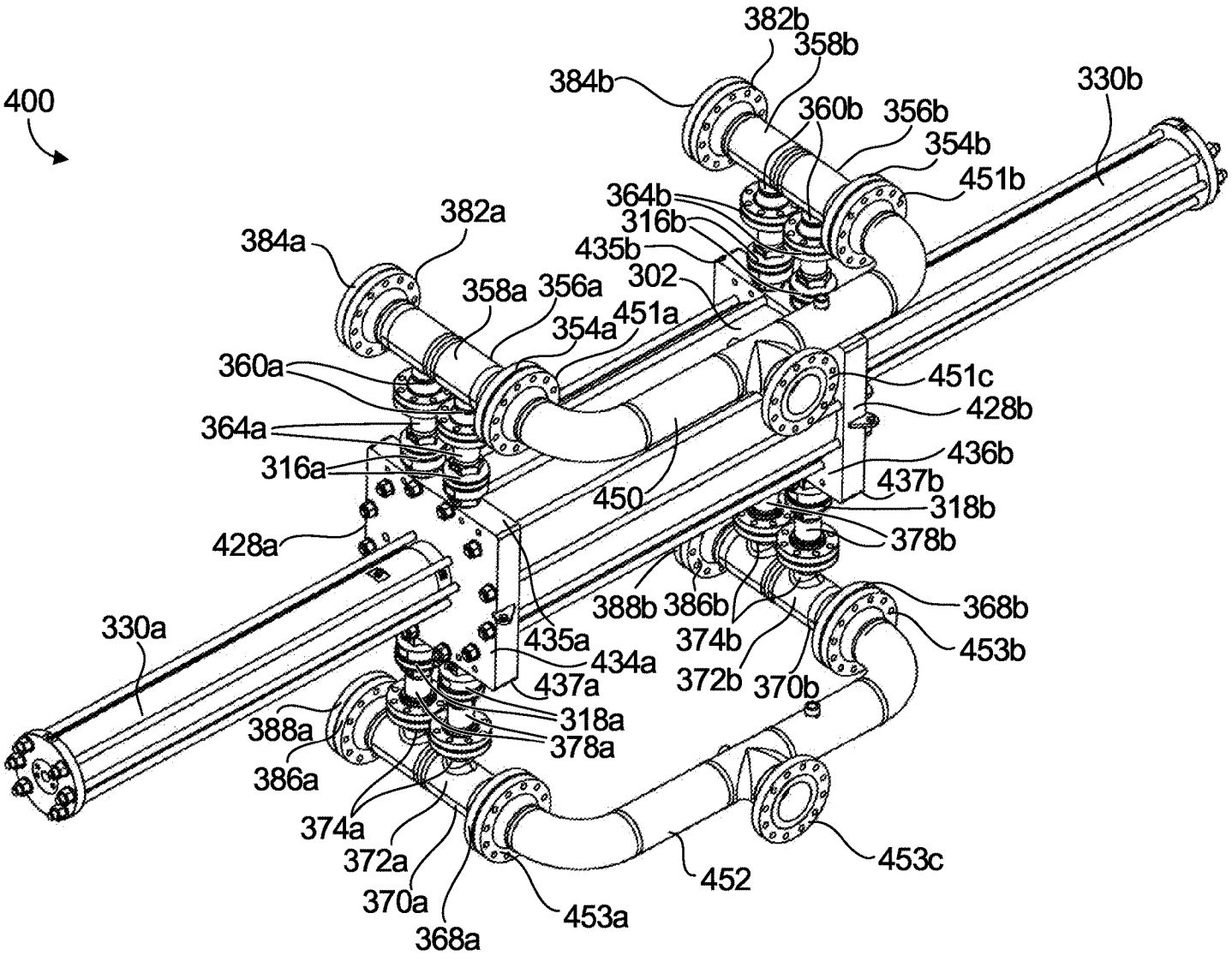
FIGS. 6B and 6C are front perspective views of the compressor of FIG. 6A.
Figure 6C:
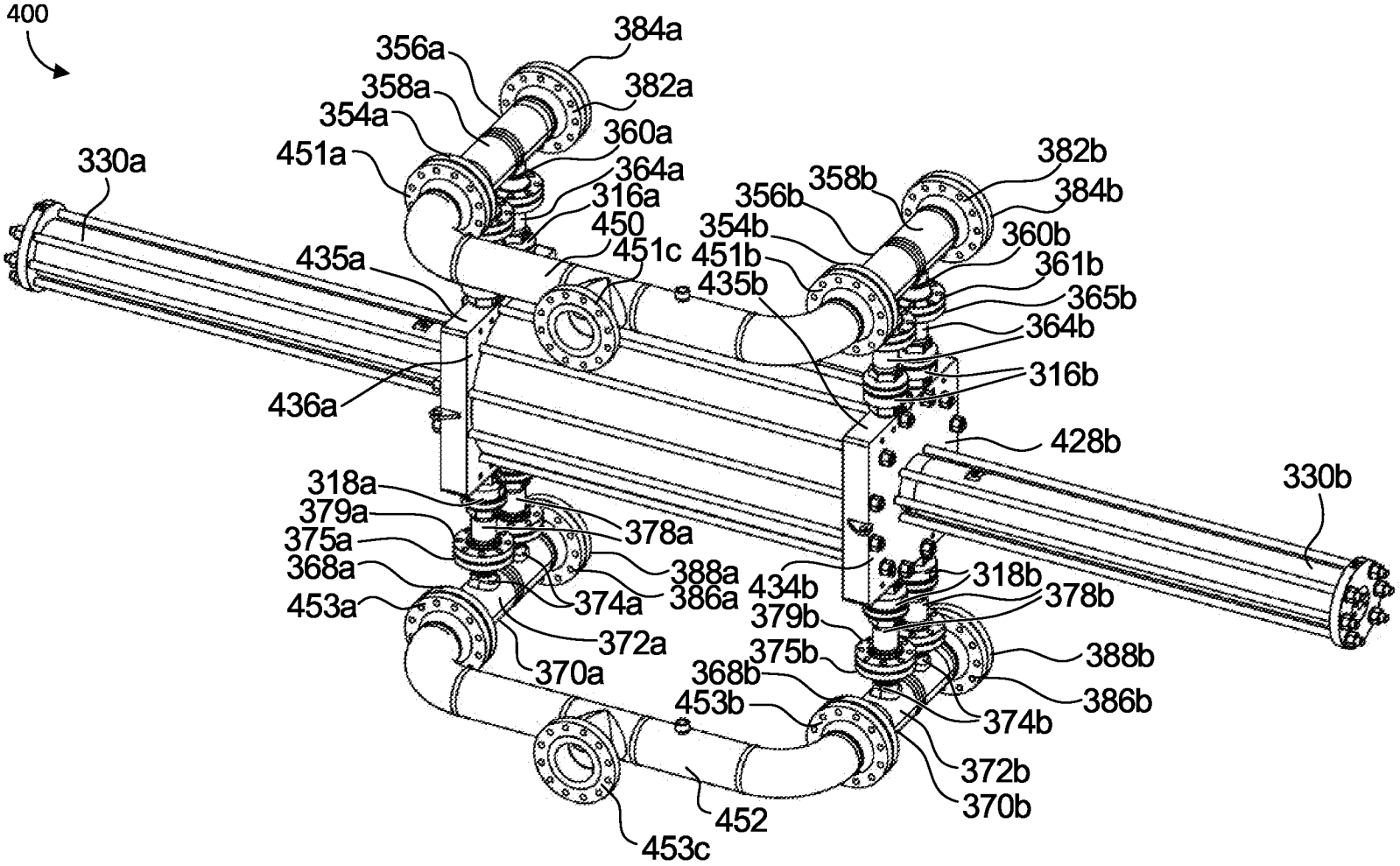
Figure 6D:
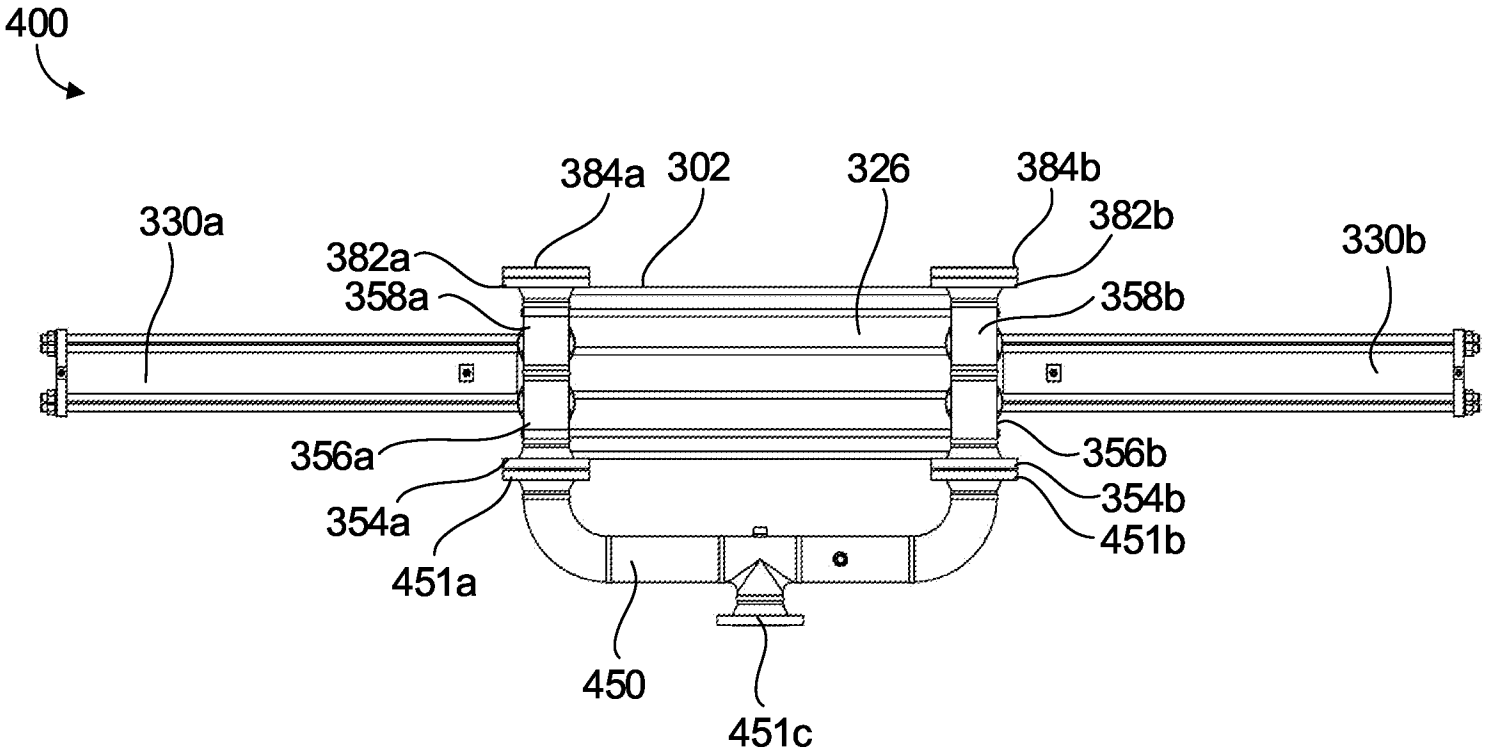
FIGS. 6D and 6E are top plan and front views of the compressor of FIG. 6A.
Figure 6E:
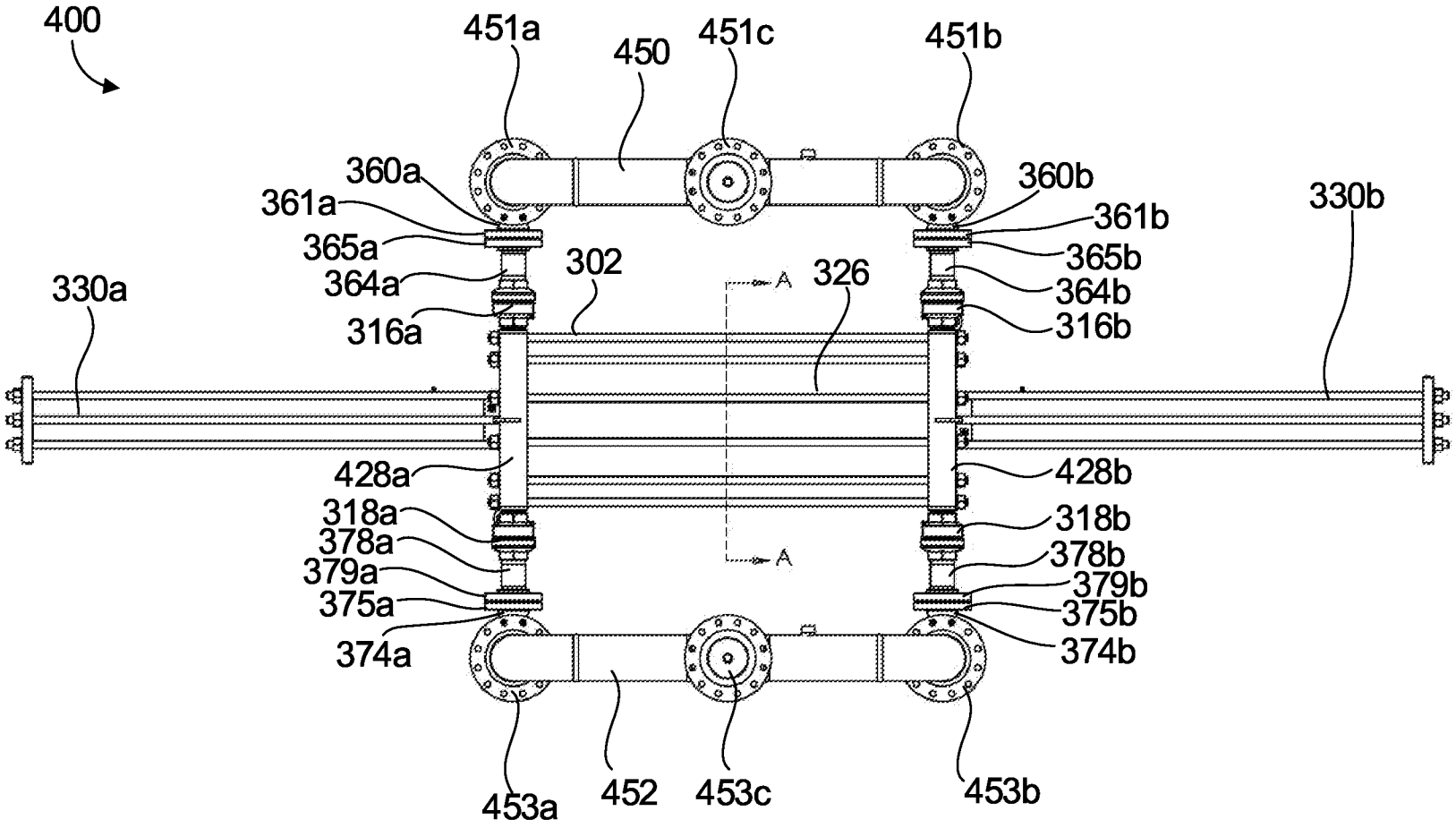
Figure 6G:
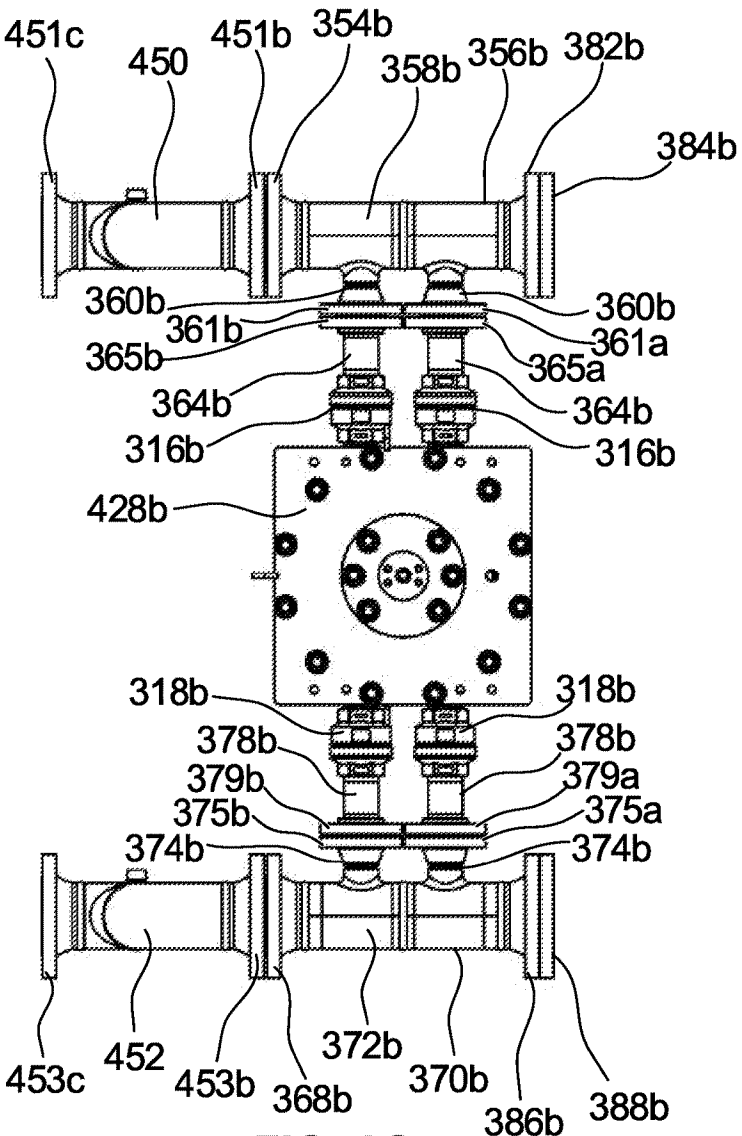
FIG. 6G is an end view of the compressor of FIG. 6A.

Turning to FIGS. 6A to 6G, another embodiment of a compressor 400 is shown, which is an example embodiment of the compressor 200' shown in FIG. 4. First cylinder 302 of compressor 400 may include cylinder barrel/tubular wall 326 positioned between first and second cylinder head plates 428*a*, 428*b* at respective first and second ends 305*a*, 305*b* of compression chamber 304. First head plate 428*a* may have a generally square or rectangular shape with a pair of upper first inlet ports 410*a*, a pair of lower first outlet ports 412*a* and a centrally located piston rod opening 432*a* (not shown). As shown in FIG. 6A, first inlet ports 410*a* may extend within first head plate 428*a* in a downwards direction from first ends 438*a* in top face 435*a* before turning at 90 degrees inwards to second ends 440*a* in inner face 436*a* of first head plate 428*a*. First outlet ports 412*a* may extend in an outwards direction from first ends 442*a* in inner face 436*a* of first head plate 428*a* before turning at 90 degrees downwards to second ends 444*a* in bottom face 437*a* of first head plate 428*a*.

Figure 6F:
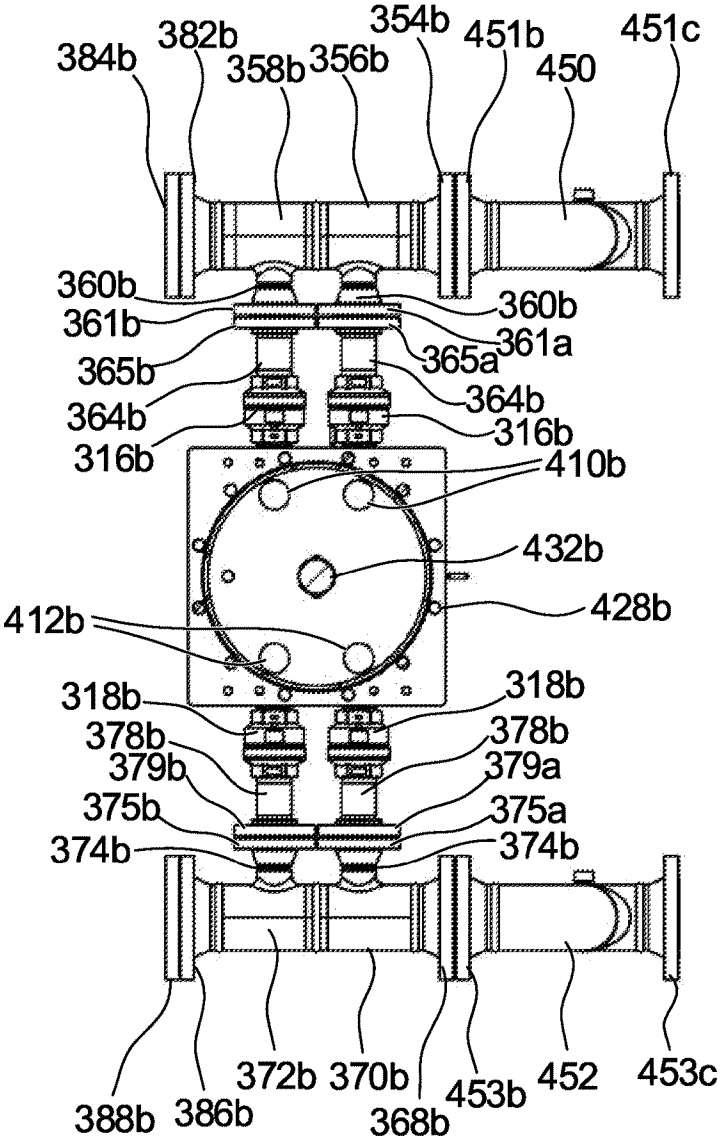
FIG. 6F is a cross sectional end view of the compressor of FIG. 6A, along the line A-A in FIG. 6E.

Similarly, second head plate 428*b* may have a generally square or rectangular shape with a pair of upper second inlet ports 410*b*, a pair of lower second outlet ports 412*b* and a centrally located piston rod opening 432*b* (FIG. 6F). Second inlet ports 410*b* may extend within second head plate 428*b* in a downwards direction from first ends 438*b* in top face 435*b* before turning at 90 degrees inwards to second ends 440*b* in inner face 436*a* of second head plate 428*a*. Second outlet ports 412*a* may extend in an outwards direction from first ends 442*b* in inner face 436*a* of second head plate 428*b* before turning at 90 degrees downwards to second ends 444*b* in bottom face 437*b* of second head plate 428*b*.

Connected to each of the first ends 438*a*, 438*b* of inlet ports 410*a*, 410*b* may be respective inlet check valves 316*a*, 316*b* configured to ensure that fluid may flow into compression chamber 304 from inlet ports 410*a*, 410*b* (i.e., fluid only travels in the direction from first ends 438*a*, 438*b* to second ends 440*a*, 440*b* of inlet ports 410*a*, 410*b*). In some embodiments, inlet check valves 316*a*, 316*b* may be connected directly to first ends 438*a*, 438*b* of inlet ports 410*a*, 410*b*. In the embodiment shown in FIG. 6A, short conduits 346*a*, sized to be partially received within first ends 438*a* of inlet ports 410*a*, may be disposed between inlet check valves 316*a* and first inlet ports 410*a*. Similarly, short conduits 346*b*, sized to be partially received within first ends 438*b* of inlet ports 410*b*, may be disposed between inlet check valves 316*b* and second inlet ports 410*b*.

Similarly, connected to each of the second ends 444*a*, 444*b* of outlet ports 412*a*, 412*b* may be respective outlet check valves 318*a*, 318*b* configured to ensure that fluid may flow into outlet ports 412*a*, 412*b*, from compression chamber 304 (i.e., fluid only travels in the direction from first ends 442*a*, 442*b* to second ends 444*a*, 444*b* of outlet ports 412*a*, 412*b*). In some embodiments, outlet check valves 318*a*, 318*b* may be connected directly to second ends 444*a*, 444*b* of outlet ports 412*a*, 412*b*. In the embodiment shown in FIG. 6A, short conduits 348*a*, sized to be partially received within second ends 444*a* of outlet ports 412*a*, may be disposed between outlet check valves 318*a* and first outlet ports 412*a*. Similarly, short conduits 348*b*, sized to be partially received within second ends 444*b* of outlet ports 412*b*, may be disposed between outlet check valves 318*b* and second outlet ports 412*b*.

Configuring compressor 400 such that the inlet and outlet ports are on the upper and lower faces of cylinder heads 428*a*, 428*b* provides additional space on the outer faces 434*a*, 434*b* of cylinder heads 428*a*, 428*b*. This may provide space for accommodating larger diameter hydraulic cylinders on compressor 400 as desired.

In other embodiments of compressor 400, the upper ports on each of cylinder heads 428*a*, 428*b* may be outlet ports whilst the lower ports may be inlet ports.

Referring to FIGS. 6B to 6E, the fluid communication system that provides fluid to compressor 400 may be generally similar to the fluid communication system of compressor 300, but is sized to connect to the differently positioned check valves 316*a*, 316*b*, 318*a*, 318*b* on compressor 400. The fluid communication system may include suction intake manifold 450 and pressure discharge manifold 452. Suction intake manifold 450 may have two manifold outlets 451*a* and 451*b* and a single manifold inlet 451*c*. A flange associated with outlet 451*a* is connected to a first flange 354*a* of inlet connector 356*a*, which is in turn connected to first inlet check valves 316*a* through inlet check valve connectors 364*a*. A flange associated with outlet 451*b* is connected to a first flange of inlet connector 356*b* which is in turn connected to second inlet check valves 316*b* through check valve connectors 364*b*.

On the fluid pressure discharge side of compressor 400, pressure discharge manifold 452 may have two manifold inlets 453*a* and 453*b* and a single manifold outlet 453*c*. A flange associated with inlet 453*a* is connected to first flange 368*a* of outlet connector 370*a* which is in turn connected to first outlet check valves 318*a* through outlet check valve connectors 378*a*. A flange associated with inlet 453*b* is connected to a first flange 368*b* of outlet connector 370*b* which is in turn connected to second outlet check valves 318*a* through outlet check valve connectors 378*b*.

Providing first and second inlet and first and second outlet ports through each of first and second head plates 428*a*, 428*b* as opposed to a larger single inlet and single outlet port in each head plate may be desirable in order to reduce the thickness of head plates 428*a*, 428*b*. For example, the pair of first inlet ports 410*a* may each have a diameter of around 2 inches. In order to achieve a similar flow velocity of fluid, a single inlet port to replace ports 410*a* would be required to have a larger diameter, for example about 4 inches. This would undesirably significantly increase the thickness of head plate 428*a* in order to accommodate the larger port within, increasing the size, weight and cost (through the extra material required for the thicker cylinder head) of the compressor.

Turning to FIGS. 7A to 7G, another embodiment of a compressor 500 is shown, which is another example embodiment of compressor 200 shown in FIG. 2A.

Figure 7A:
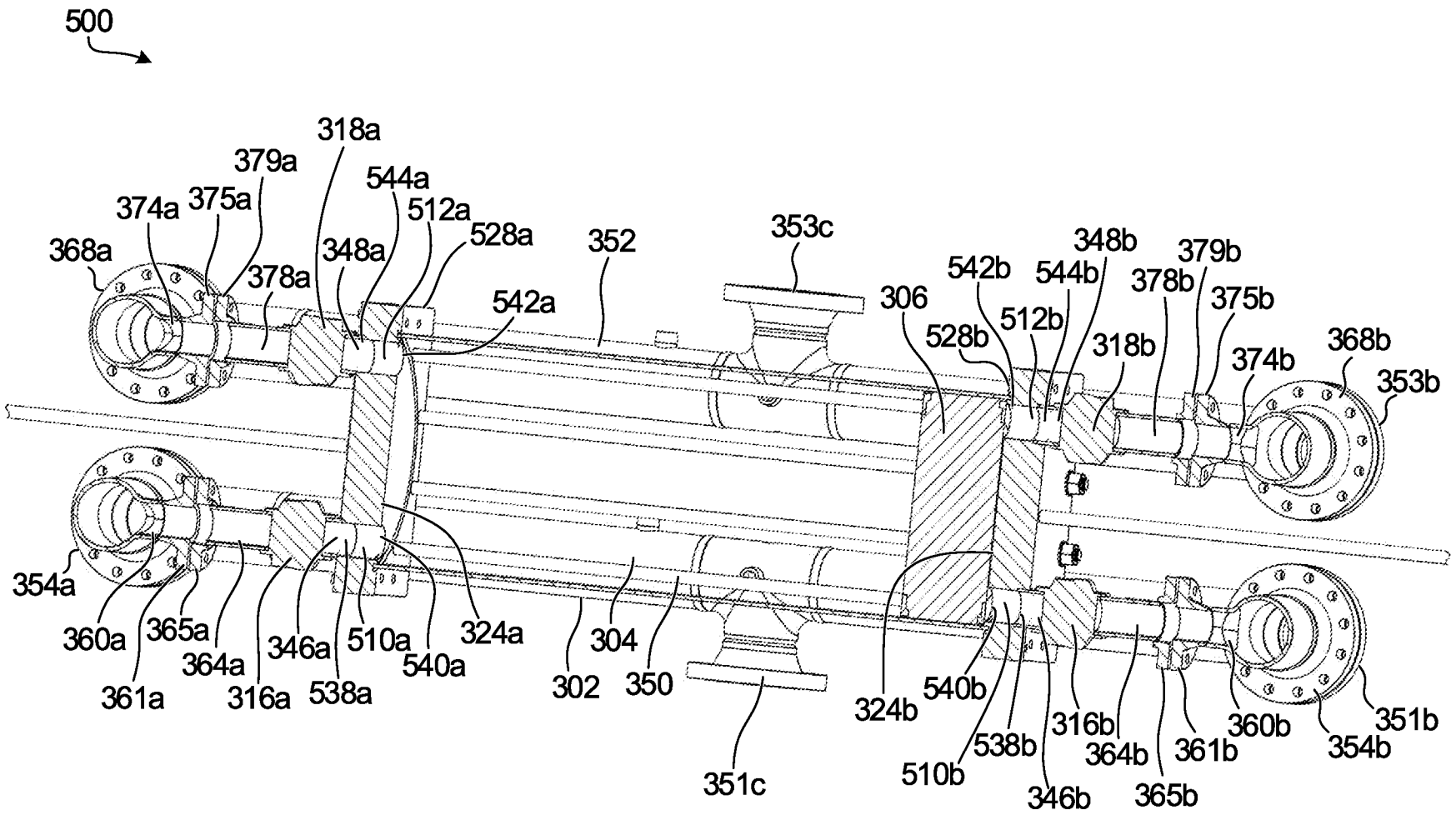
FIG. 7A is a partially transparent, cross-sectional top perspective view of a compressor according to a further embodiment.
Figure 7B:
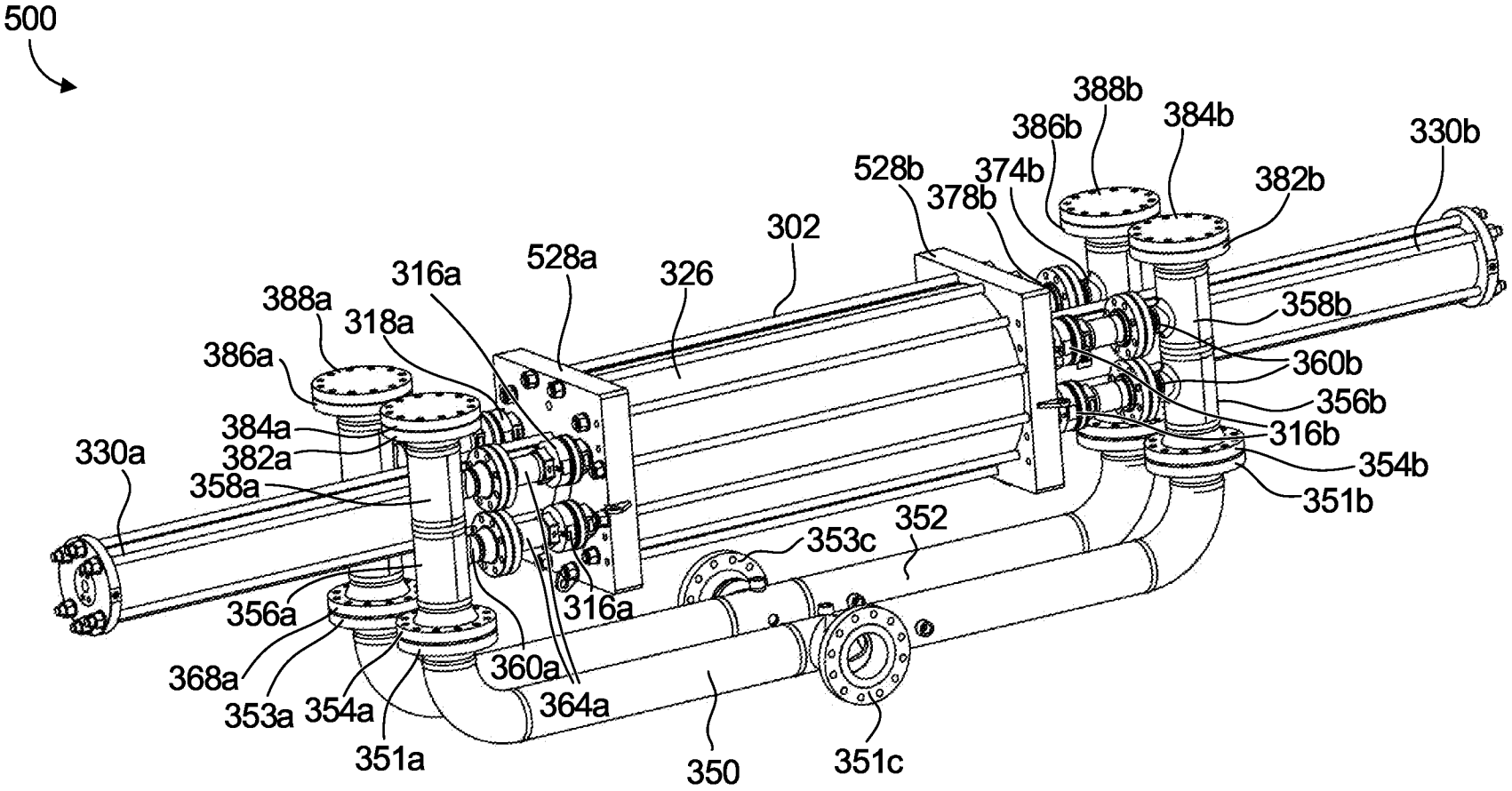
FIGS. 7B and 7C are front perspective views of the compressor of FIG. 7A.
Figure 7C:
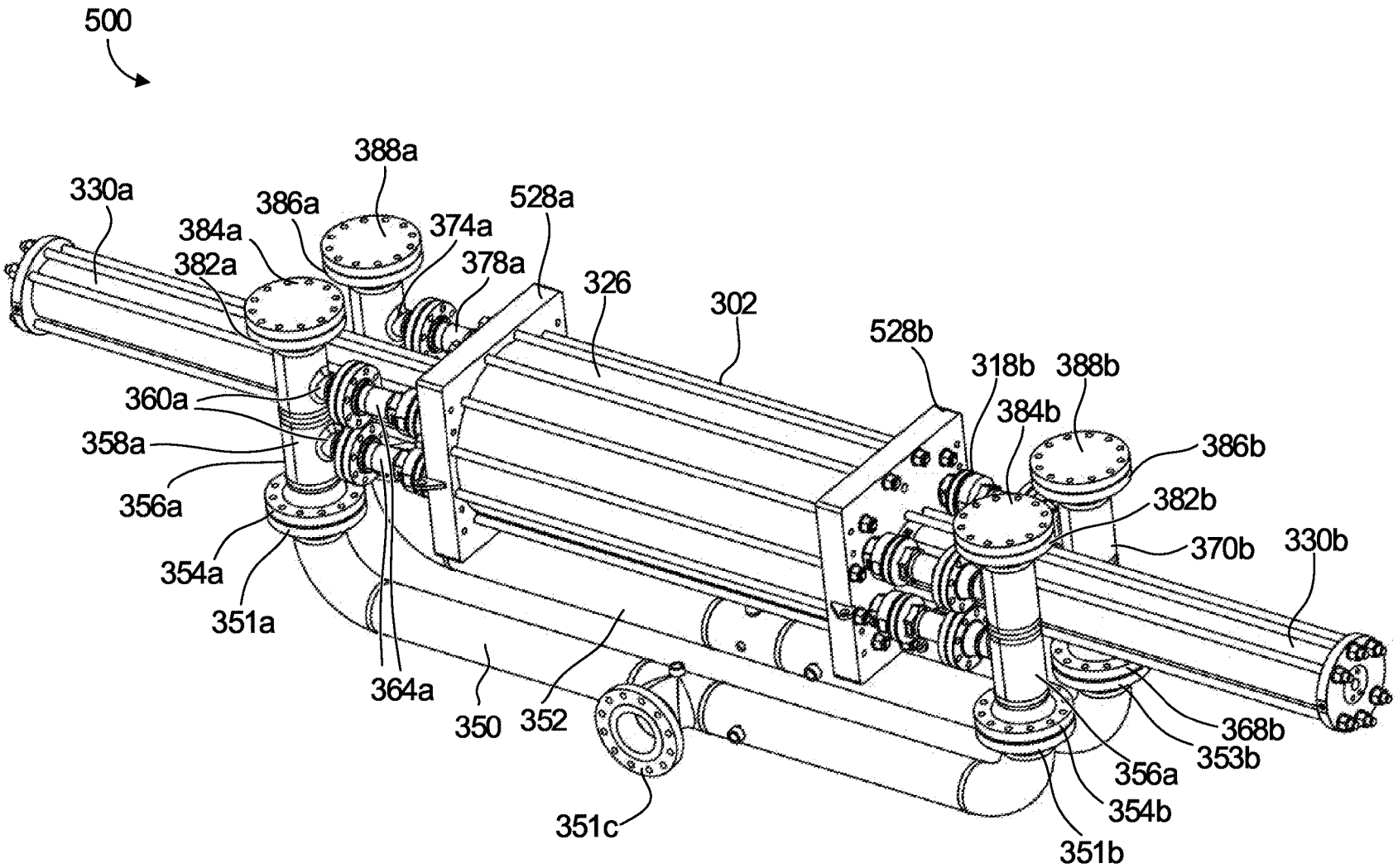
Figure 7D:
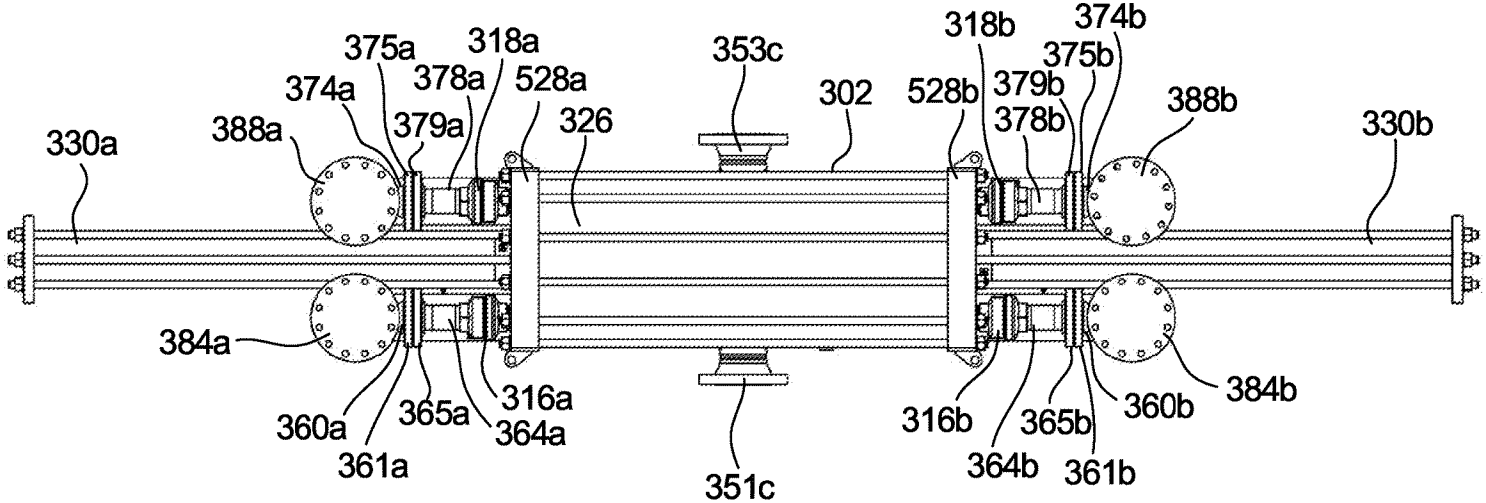
FIGS. 7D and 7E are top plan and front views of the compressor of FIG. 7A.
Figure 7E:
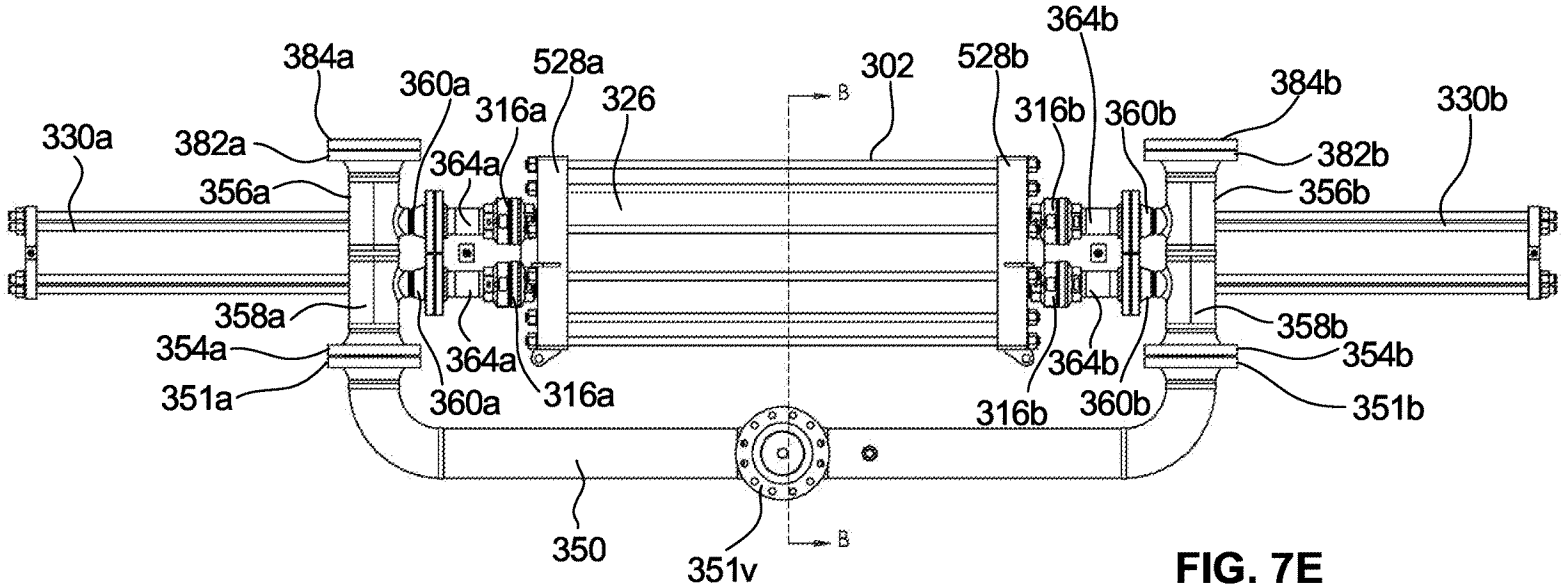
Figure 7G:
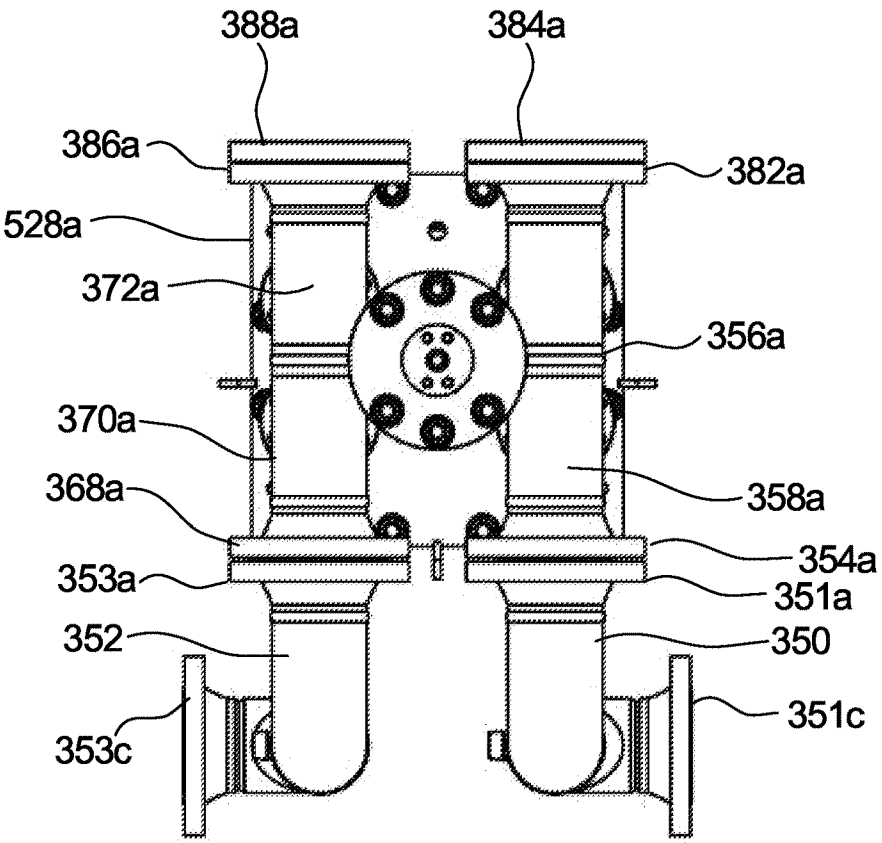
FIG. 7G is an end view of the compressor of FIG. 7A.
Figure 7F:
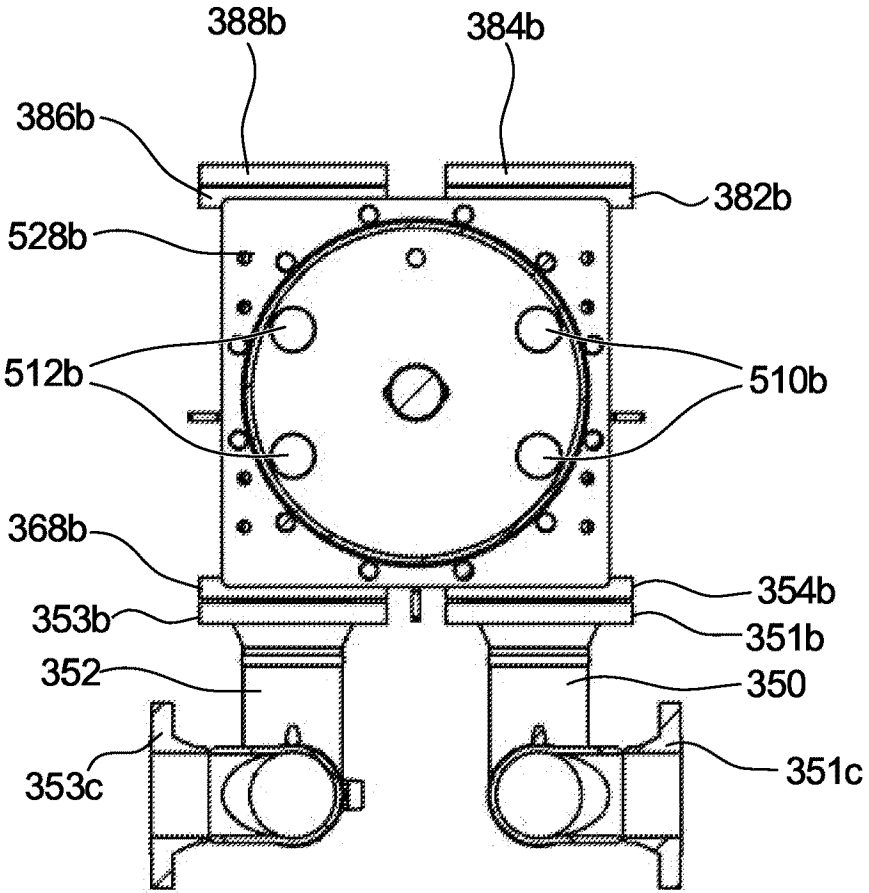
FIG. 7F is a cross sectional end view of the compressor of FIG. 7A, along the line B-B in FIG. 7E.

In comparison to compressor 300 described above, first head plate 528*a*, whilst generally similar to first head plate 328*a*, may be configured with a pair of first inlet ports 510*a* vertically spaced from each other on a first side of first head plate 528*a*. Similar to first inlet ports 310*a*, first inlet ports 510*a* may extend through first head plate 528*a* and are configured to receive fluid at an outer, first end 538*a* and communicate fluid to an inner, second end 540*a* inside first chamber section 308*a* (FIG. 7A). First head plate 528*a* may also be configured with a pair of first outlet ports 512*a*, vertically spaced from each other on the opposite side of first head plate 528*a* to first inlet ports 510*a*. Similar to first outlet ports 312*b*, first outlet ports 512*b* may extend through first head plate 528*a* and are configured to receive fluid at an inner, first end 542*a* inside first chamber section 308*a* and communicate fluid to an outer, second end 544*a*.

Second head plate 528*b* may be generally similar to first head plate 328*b* and may be configured with a pair of second inlet ports 510*b* vertically spaced from each other on a first side of second head plate 528*b*. Similar to second inlet ports 310*b*, second inlet ports 510*b* may extend through second head plate 528*b* and are configured to receive fluid at an outer, first end 538*b* and communicate fluid to an inner, second end 540*b* inside second chamber section 308*b* (FIG. 7A). Second head plate 528*b* may also be configured with a pair of first outlet ports 512*b*, vertically spaced from each other on the opposite side of second head plate 528*b* to first inlet ports 510*a*. Similar to second outlet ports 312*b*, second outlet ports 512*b* may extend through second head plate 528*b* and are configured to receive fluid at an inner, first end 542*b* inside second chamber section 308*b* and communicate fluid to an outer, second end 544*b*.

First and second inlet ports 510*a*, 510*b* may be connected to suction intake manifold 350 in a similar manner to as described above for compressor 300 through inlet connectors 356*a*, 356*b*, inlet check valve connectors 364*a*, 364*b* and inlet check valves 316*a*, 316*b* for supplying fluid to compression chamber 304, with inlet connectors 356*a*, 356*b* and intake manifold 350 oriented to accommodate the different inlet port configuration of compressor 500.

First and second outlet ports 512*a*, 512*b* may be connected to pressure discharge manifold 352 in a similar manner to as described above for compressor 300 through outlet check valves 318*a*, 318*b*, outlet check valve connectors 378*a*, 378*b* and outlet connectors 370*a*, 370*b* for receiving fluid from compression chamber 304, with outlet connectors 370*a*, 370*b* and pressure discharge manifold 352 oriented to accommodate the different outlet port configuration of compressor 500.

Figure 8:
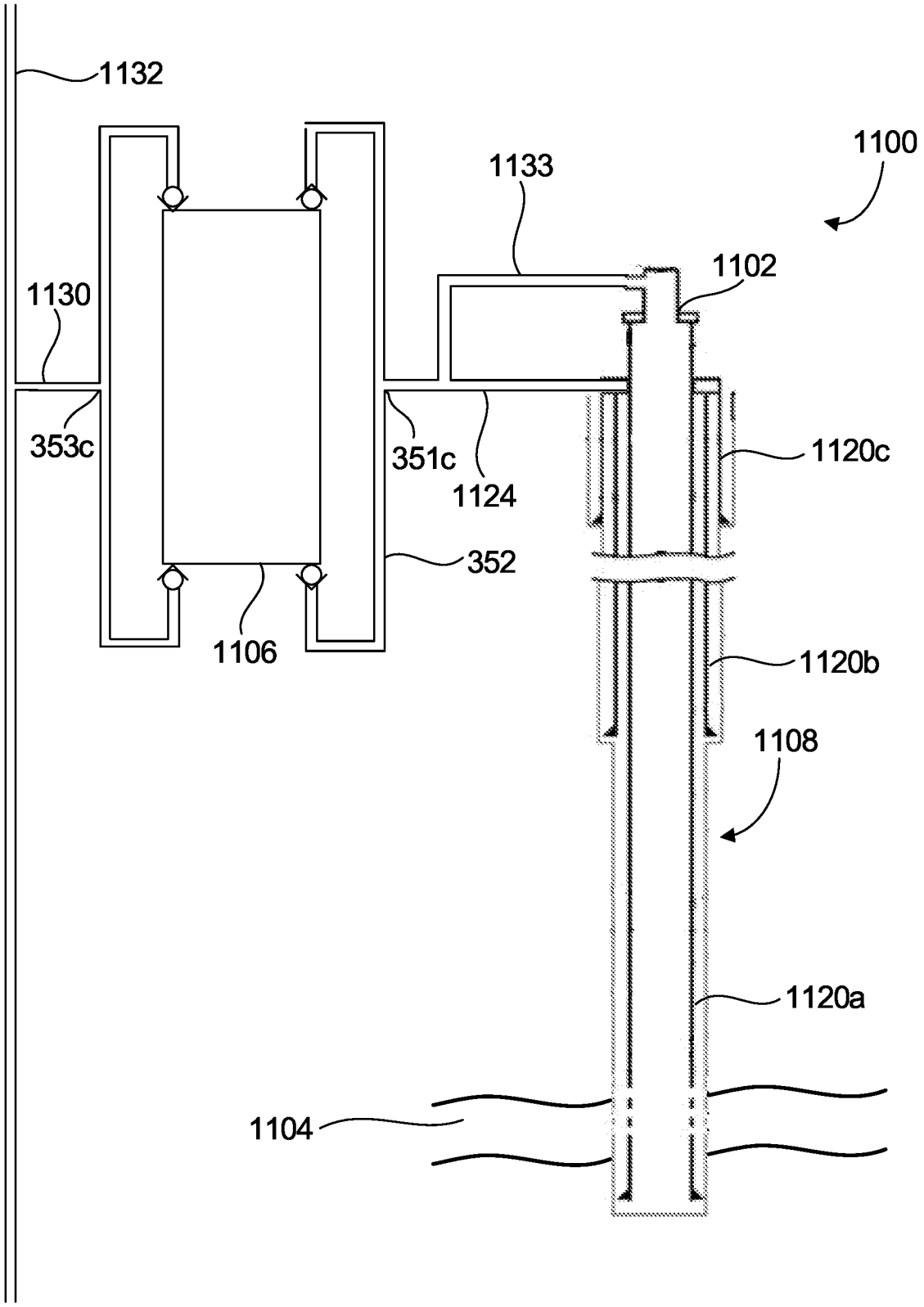
FIG. 8 is a schematic view of an oil and gas producing well system.

With reference to FIG. 8 an example oil and gas producing well system 1100 is illustrated, which utilises a compressor 1106, which may be any compressors described above. Oil and gas producing well system 1100 is illustrated schematically and may be installed at, and in, a well shaft (also referred to as a well bore) 1108 and may be used for extracting liquid and/or gases (e.g., oil and/or natural gas) from an oil and gas bearing reservoir 1104.

Extraction of liquids including oil as well as other liquids such as water from reservoir 1104 may be achieved by methods such as the use of a down-well pump, which operates to bring a volume of oil toward the surface to a well head 1102. An example of a suitable down-well pump is disclosed in U.S. patent application Ser. No. 16/147,188, filed Sep. 28, 2018 (now U.S. Pat. No. 10,544,783, issued Jan. 28, 2020), the entire contents of which is hereby incorporated herein by reference.

Well shaft 1108 may have along its length, one or more generally hollow cylindrical tubular, concentrically positioned, well casings 1120*a*, 1120*b*, 1120*c*, including an inner-most production casing 1120*a* that may extend for substantially the entire length of the well shaft 1108. Intermediate casing 1120*b* may extend concentrically outside of production casing 1120*a* for a substantial length of the well shaft 1108, but not to the same depth as production casing 1120*a*. Surface casing 1120*c* may extend concentrically around both production casing 1120*a* and intermediate casing 1120*b*, but may only extend from proximate the surface of the ground level, down a relatively short distance of the well shaft 1108.

Natural gas may exit well shaft 1108 into piping 1124 whilst liquid may exit well shaft 1108 through a well head 1102 to an oil flow line 1133. Oil flow line 1133 may carry the liquid to piping 1124, which in turn carries the combined gas and oil to inlet manifold 351*c* of compressor 1106. Compressor 1106 may operate substantially as described above to compress gas and liquid supplied by piping 1124. Compressed fluid that has been compressed by compressor 1106 may exit though outlet manifold 353*c* and flow via piping 1130 to interconnect to pipeline 1132.

In another embodiment, a plurality of compressors may be connected in series in order to provide a pressure boost to a fluid. An advantage to this approach is that less energy is required to compress fluid, such as gas, in multiple stages.

In an example embodiment, a first compressor may be connected to a second compressor such that fluid flows through the first compressor to the second compressor. Fluid at a first pressure P1 may have its pressure boosted to a second pressure P2 (that is greater than P1) by the first compressor. Fluid may then flow to the second compressor, where the pressure of the fluid will be boosted to a third pressure P3 (that is greater than P2).

The first and second compressors may be interconnected in a number of suitable configurations in order for fluid that has been compressed in compression chamber sections 308*a*, 308*b* of the first compressor to flow to the second compressor. For example, when the first and second compressors are both similar to compressor 300, second flanges 386*a*, 386*b* (with blanking plates 388*a*, 388*b* removed) on the first compressor may be interconnected to manifold inlet 351*c* or second flanges 382*a*, 382*b* of the second compressor.

In one embodiment, the first and second compressors may have different specifications. For example, the second compressor may be configured to handle fluid at a higher pressure and have hydraulic cylinders and a piston with a larger diameter than the first compressor.

For example, in an embodiment, the first compressor may have an inlet pressure of 50 psi and an outlet pressure of 250 psi and the second compressor may have an inlet pressure of 250 psi and an outlet pressure of 500 psi.

The compressors may also be employed in other oilfield and other non-oilfield environments to transfer gas and multi-phase fluids efficiently and quietly.

Whilst the illustrated embodiments depict compressors with two inlet ports and two outlet ports on each cylinder head, other variations are contemplated with different numbers of inlet and/or outlet ports on each cylinder head.

Turning to FIGS. 9A to 9J, another embodiment of a compressor 600 is shown, which is another example embodiment of compressor 200 shown in FIG. 2A.

Figure 9A:
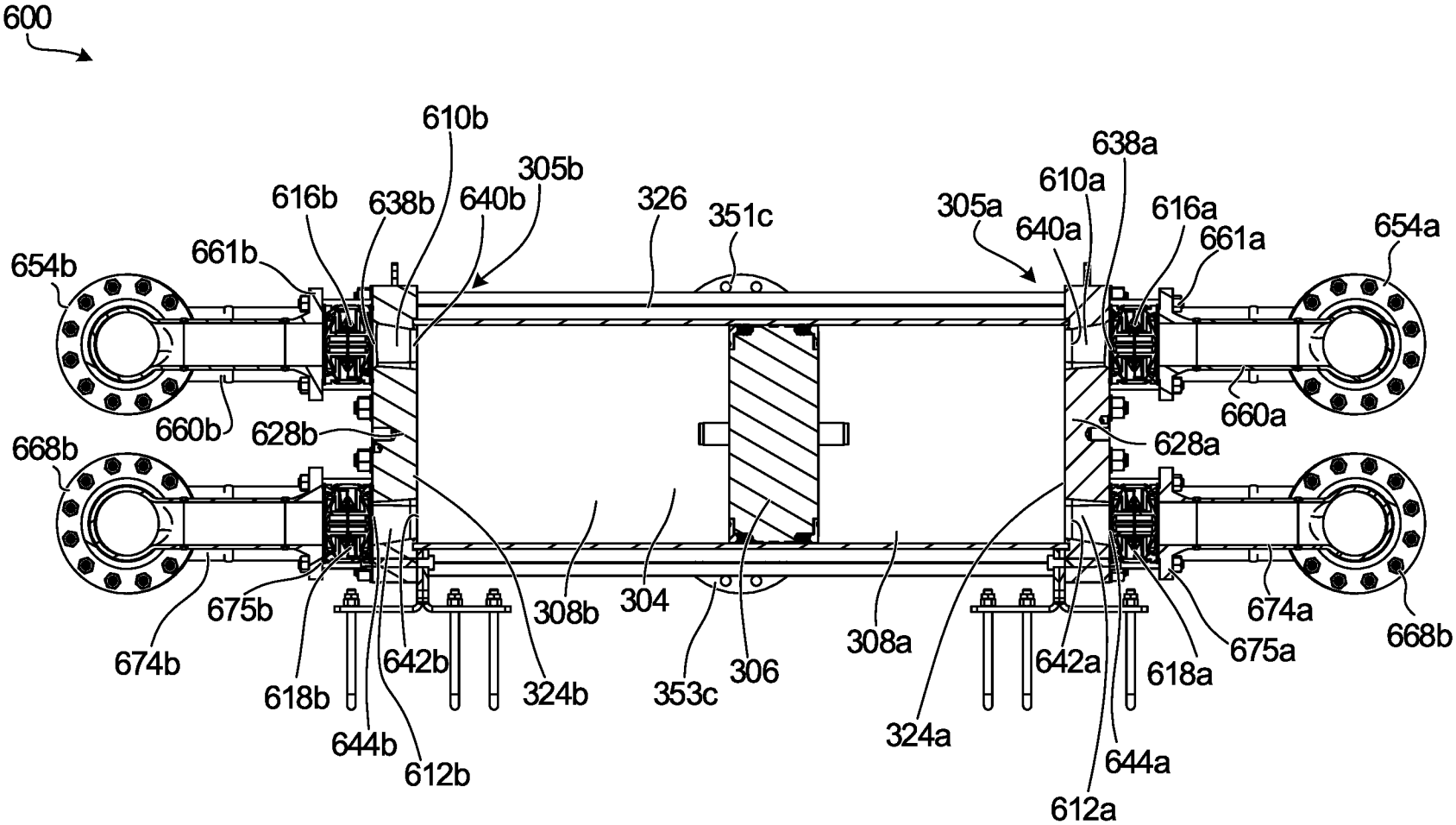
FIG. 9A is a cross-sectional rear view of a compressor according to a further embodiment.

Compressor 600 may include a first head plate (also known as an end plate) 628*a*, which may be generally similar to first head plate 328*a* and may have a generally square or rectangular shape and may be configured with a pair of first inlet ports 610*a* horizontally spaced from each other at an upper end of first head plate 628*a*. Similar to first inlet ports 310*a*, first inlet ports 610*a* may extend through first head plate 628*a* and are configured to receive fluid at an outer, first end 638*a* and communicate fluid to an inner, second end 640*a* inside first chamber section 308*a* (FIG. 9A). First head plate 628*a* may also be configured with a pair of first outlet ports 612*a*, horizontally spaced from each other at the opposite end of first head plate 628*a* to first inlet ports 610*a*. Similar to first outlet ports 312*a*, first outlet ports 612*a* may extend through first head plate 628*a* and are configured to receive fluid at an inner, first end 642*a* inside first chamber section 308*a* and communicate fluid to an outer, second end 644*a*.

Second head plate (also known as an end plate) 628*b* may be generally similar to first head plate 328*b* and may be configured with a pair of second inlet ports 610*b* horizontally spaced from each other at an upper end of second head plate 628*b*. Similar to second inlet ports 310*b*, second inlet ports 610*b* may extend through second head plate 628*b* and are configured to receive fluid at an outer, first end 638*b* and communicate fluid to an inner, second end 640*b* inside second chamber section 308*b* (FIG. 9A). Second head plate 628*b* may also be configured with a pair of first outlet ports 612*b*, horizontally spaced from each other at the opposite end of second head plate 628*b* to first inlet ports 610*b*. Similar to second outlet ports 312*b*, second outlet ports 612*b* may extend through second head plate 628*b* and are configured to receive fluid at an inner, first end 642*b* inside second chamber section 308*b* and communicate fluid to an outer, second end 644*b*.

Connected to each of first ends 638*a*, 638*b* of inlet ports 610*a*, 610*b* may be respective inlet check valves 616*a*, 616*b* configured to ensure that fluid may flow into compression chamber 304 from inlet ports 610*a*, 610*b* (i.e., fluid only travels from first ends 638*a*, 638*b* to second ends 640*a*, 640*b*). Inlet check valves 616*a*, 616*b* may be generally similar to inlet check valves 316*a*, 316*b* described above.

Similarly, connected to each of the second ends 644*a*, 644*b* of outlet ports 612*a*, 612*b* may be respective outlet check valves 618*a*, 618*b* configured to ensure that fluid may only flow from compression chamber 304 into outlet ports 612*a*, 612*b*, (i.e., fluid only travels in the direction from first ends 642*a*, 642*b* to second ends 644*a*, 644*b*). Outlet check valves 618*a*, 618*b* may be generally similar to outlet check valves 318*a*, 318*b* described above.

In a specific embodiment, check valves 616*a*, 616*b*, 618*a*, 618*b* may be 888VFD flange valves made by Flomatic Valves.

First and second inlet ports 610*a*, 610*b* may be connected to suction intake manifold 350 through inlet connectors 656*a*, 656*b* and inlet check valves 616*a*, 616*b* for supplying fluid to compression chamber 304.

Check valves 616*a*, 616*b*, 618*a*, 618*b* may be directly connected to their respective port by any suitable method. As can be appreciated, by directly connecting each check valve to its respective port, the check valve is positioned closer to the port, reducing the path volume between the end of the piston and the check valve. This will beneficially reduce the dead volume (i.e., the volume of compressed fluid retained within the compressor at the end of each stroke) of the compressor. With a smaller dead volume, the compressor will be able to draw in, compress and expel a larger volume of liquid on each stroke, and provide a higher compression ratio on each stroke.

As can be appreciated, when the elbow connector between the check valve and the port is eliminated or replaced with a straight connector, the check valve can be positioned closer to the port, reducing the path volume between the end of the piston and the check valve. This will beneficially reduce the dead volume (i.e., the volume of compressed fluid retained within the compressor at the end of each stroke) of the compressor. With a smaller dead volume, the compressor will be able to draw in, compress and expel a larger volume of liquid on each stroke, and provide a higher compression ratio on each stroke.

Figure 9B:
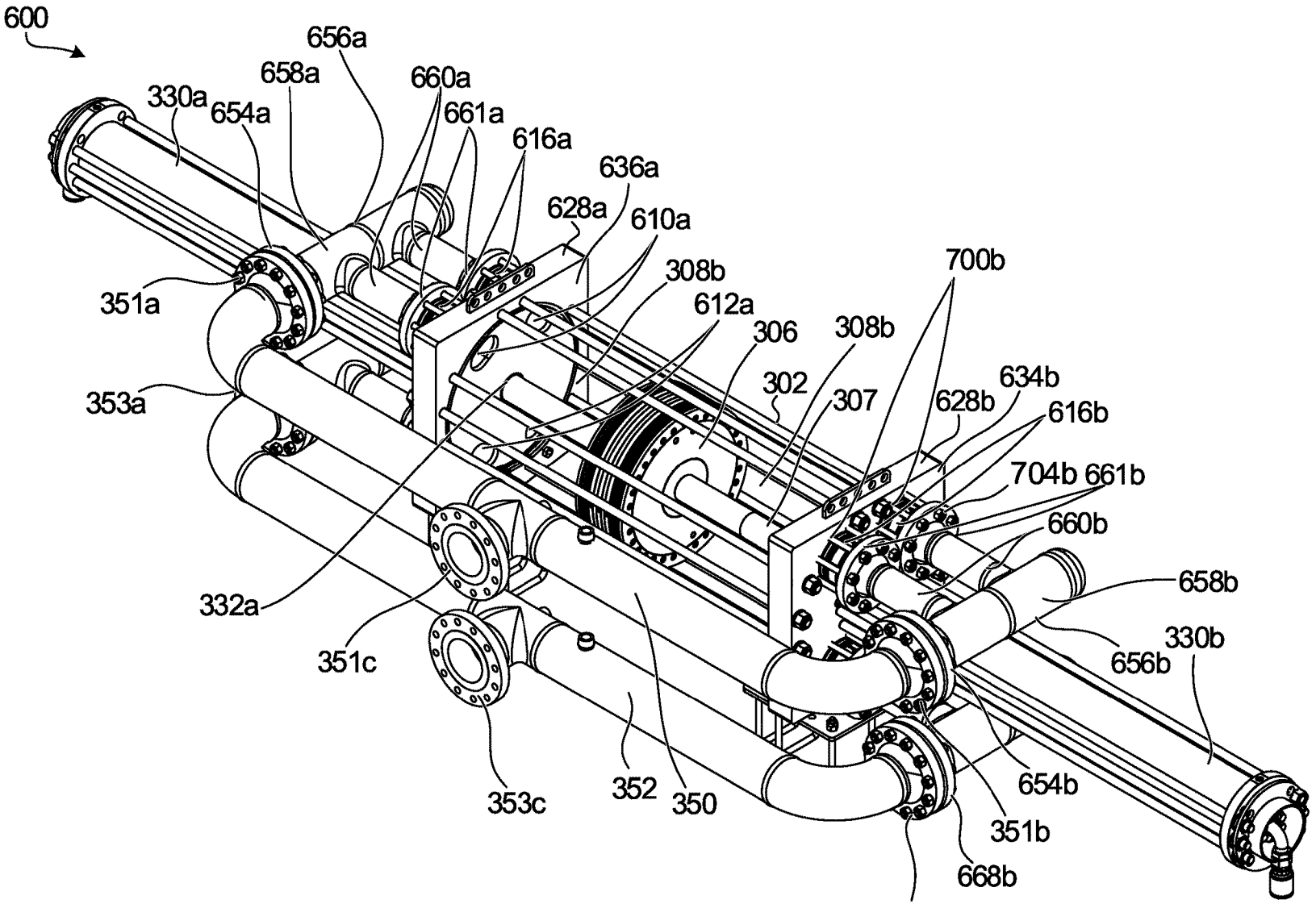
FIGS. 9B and 9C are partially transparent front perspective views of the compressor of FIG. 9A.

With reference to FIG. 9B, inlet connectors 656*a*, 656*b* may be generally similar to inlet connectors 356*a*, 356*b* described above. A flange associated with outlet 351*a* of suction intake manifold 350 is connected to first flange 654*a* of inlet connector 656*a*. Inlet connector 656*a* may include primary conduit 658*a*, which may have the same interior channel diameter as manifold 350, and a pair of smaller, spaced apart secondary conduits 660*a* extending orthogonally from primary conduit 658*a* (FIG. 9B). The opposite end of primary conduit 658*a* to first flange 654*a* may be sealed and/or welded closed. With reference to FIG. 9K, flanges 661*a* associated with secondary conduits 660*a* are each attached and affixed to first head plate 628*a* with bolts 700*a* and nuts 704*a*. The bolts 700*a* are received and mounted in bolt openings 702*a* (see FIG. 10A) in first head plate 628*a*. Each inlet check valve 616*a* is sandwiched and compressed between the head plate 628*a* and the corresponding flange 661*a*. In this manner, inlet check valves 616*a*, the gasket between first head plate 628*a* and each of the inlet check valves 616*a*, the gasket between each of the inlet check valves 616*a* and each of the flanges 661*a* are securely held together to provide a fluid tight seal. As such, inlet connector 656*a* may provide fluid communication from outlet 351*a* of suction intake manifold 350 to inlet check valves 616*a*.

Similarly, a flange associated with outlet 351*b* of suction intake manifold 350 is connected to first flange 654*b* of inlet connector 656*b*. Inlet connector 656*b* may include primary conduit 658*b*, which may have the same interior channel diameter as manifold 350, and a pair of smaller, spaced apart secondary conduits 660*b* extending orthogonally from primary conduit 658*b* (FIG. 9B). The opposite end of primary conduit 658*b* to first flange 654*b* may be sealed and/or welded closed. Flanges 661*b* associated with secondary conduits 660*b* are each attached and affixed to second head plate 628*b* with bolts 700*b* and nuts 704*b* (FIG. 9F). The bolts 700*b* are received and mounted in bolt openings 702*b* (see FIG. 9H) in second head plate 628*b*. Each inlet check valve 616*b* is sandwiched and compressed between the head plate 628*b* and the corresponding flange 661*b*. In this manner, inlet check valves 616*b*, the gasket between second head plate 628*b* and each of the inlet check valves 616*b*, the gasket between each of the inlet check valves 616*b* and each of the flanges 661*b* are securely held together to provide a fluid tight seal. As such, inlet connector 656*b* may provide fluid communication from outlet 351*b* of suction intake manifold 350 to inlet check valves 616*b*.

Figure 9C:
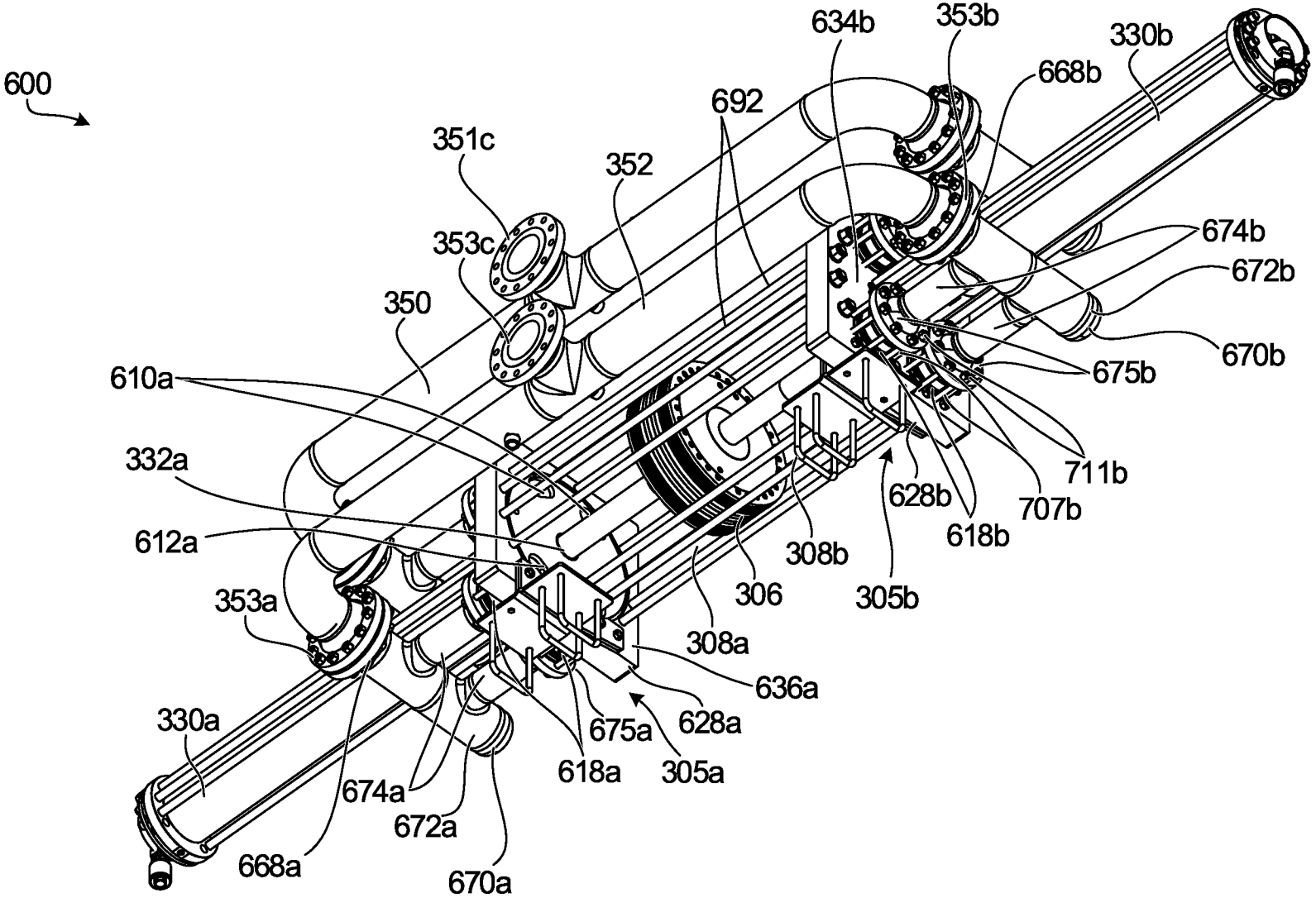
Figure 9D:
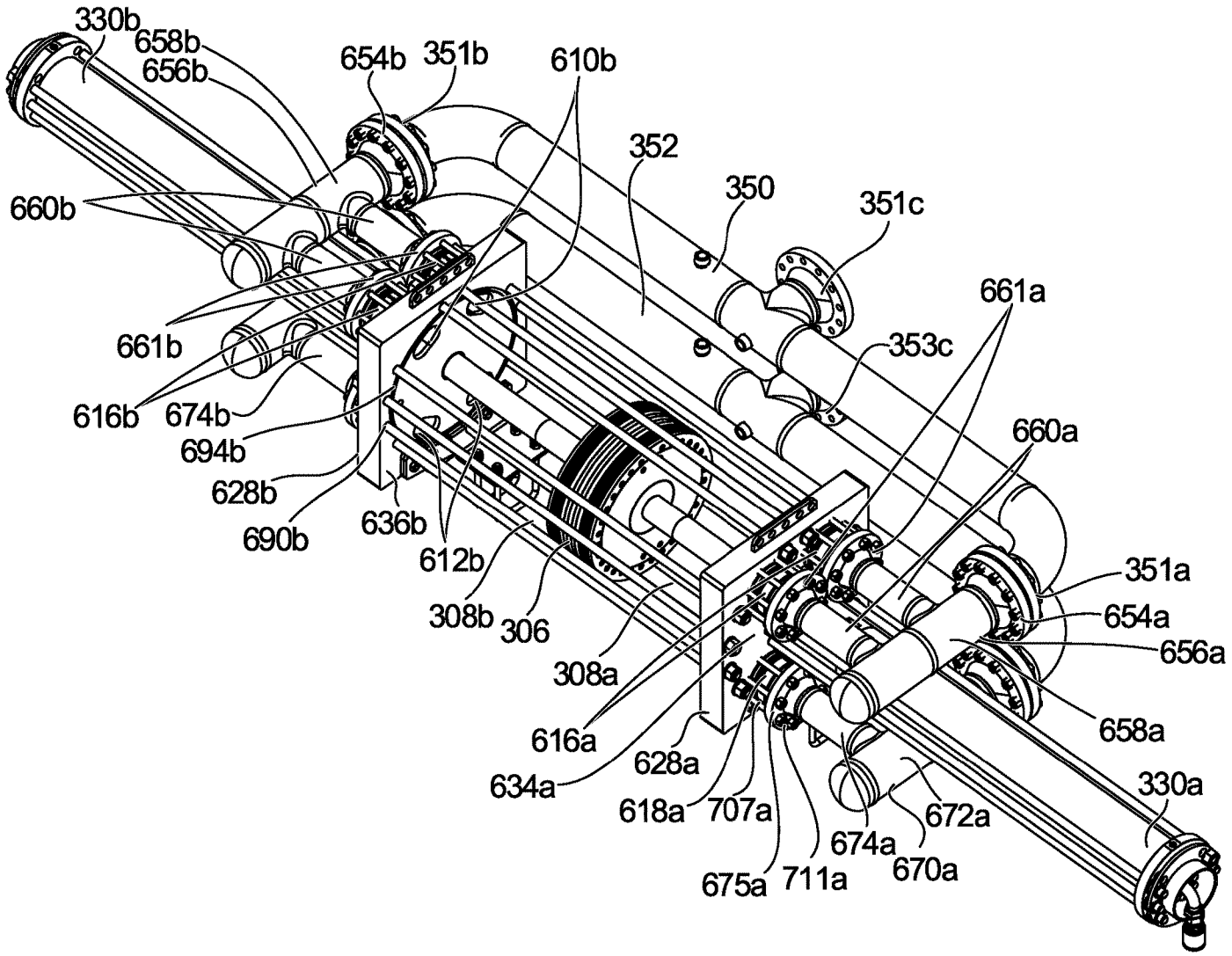
FIG. 9D is a partially transparent rear perspective view of the compressor of FIG. 9A.
Figure 9E:
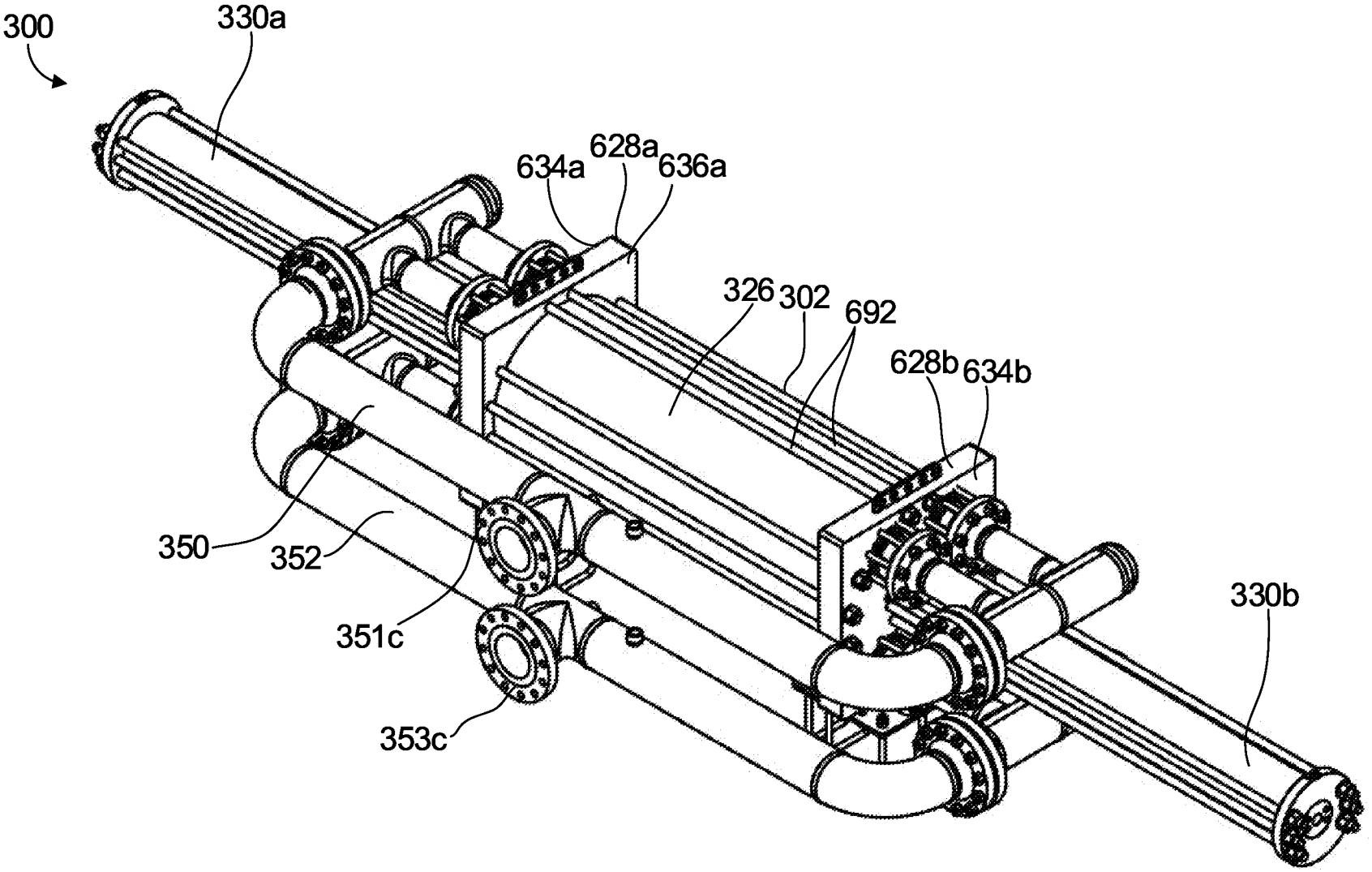
FIG. 9E is front perspective view of the compressor of FIG. 9A.
Figure 9F:
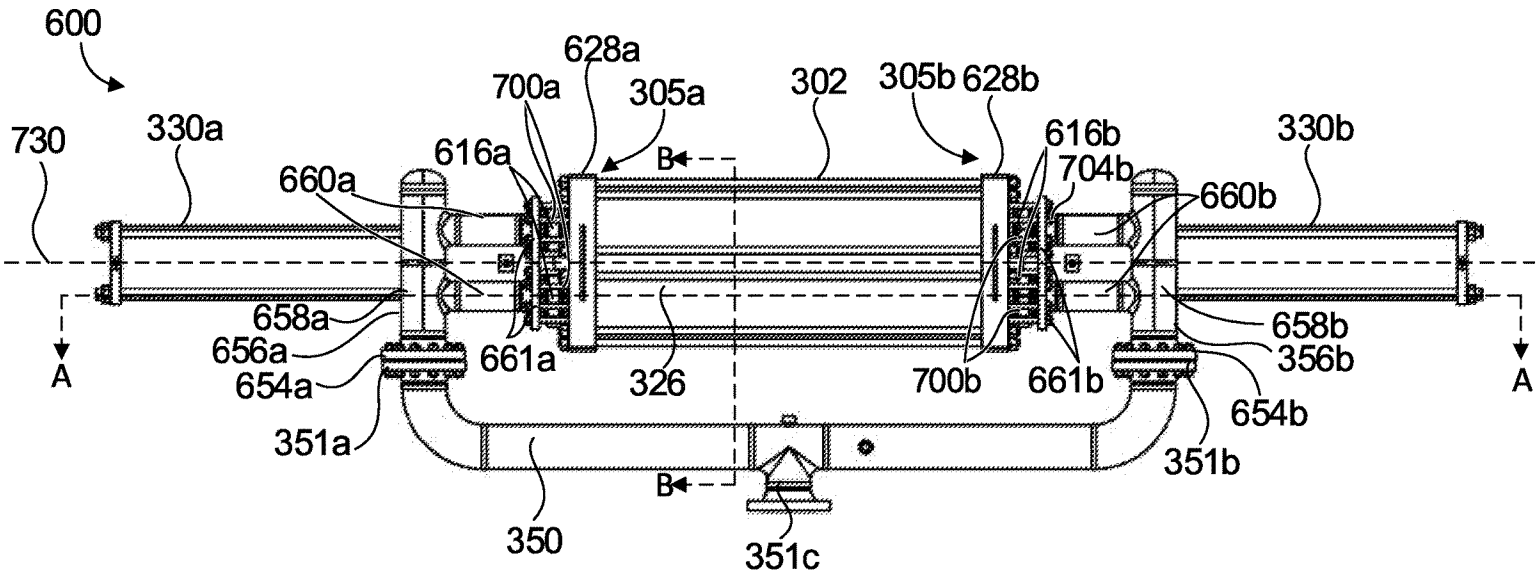
FIGS. 9F and 9G are top plan and front views of the compressor of FIG. 9A.
Figure 9G:
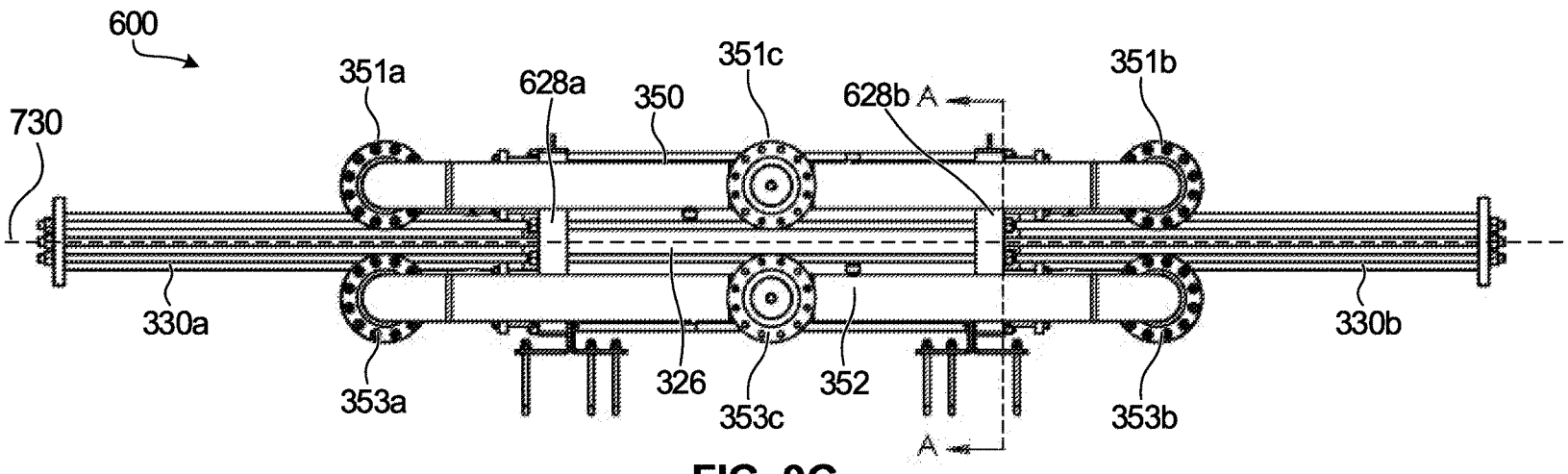

With reference to FIG. 9C, on the fluid pressure discharge side of compressor 600, first and second outlet ports 612*a*, 612*b* may be connected to pressure discharge manifold 352 through outlet connectors 670*a*, 670*b* and outlet check valves 618*a*, 618*b* for receiving fluid from compression chamber 304.

Outlet connectors 670*a*, 670*b* may be generally similar to outlet connectors 370*a*, 370*b* described above. A flange associated with inlet 353*a* of pressure discharge manifold 352 is connected to first flange 668*a* of inlet connector 670*a*. Inlet connector 670*a* may include primary conduit 672*a*, which may have the same interior channel diameter as manifold 352, and a pair of smaller, spaced apart secondary conduits 674*a* extending orthogonally from primary conduit 670*a* (FIG. 9C). The opposite end of primary conduit 670*a* to first flange 668*a* may be sealed and/or welded closed. Flanges 675*a* associated with secondary conduits 674*a* are each attached and affixed to first head plate 628*a* with bolts 707*a* and nuts 711*a* (FIG. 9K). The bolts 707*a* are received and mounted in bolt openings 708*a* (see FIG. 10A) in first head plate 628*a*. Each outlet check valve 618*a* is sandwiched and compressed between the head plate 628*a* and the corresponding flange 675*a*. In this manner, outlet check valves 618*a*, the gasket between first head plate 628*a* and each of the outlet check valves 618*a*, the gasket between each of the outlet check valves 618*a* and each of the flanges 675*a* are securely held together to provide a fluid tight seal. As such, inlet connector 670*a* may provide fluid communication from outlet check valves 618*a* to inlet 353*a* of pressure discharge manifold 352.

Similarly, a flange associated with outlet 353*b* of pressure discharge manifold 352 is connected to first flange 668*b* of inlet connector 670*b*. Inlet connector 670*b* may include primary conduit 672*b*, which may have the same interior channel diameter as manifold 352, and a pair of smaller, spaced apart secondary conduits 674*b* extending orthogonally from primary conduit 670*b* (FIG. 9C). The opposite end of primary conduit 670*b* to first flange 668*b* may be sealed and/or welded closed. Flanges 675*b* associated with secondary conduits 674*b* are each attached and affixed to second head plate 628*b* with bolts 707*b* and nuts 711*b* (FIG. 9C). The bolts 707*b* are received and mounted in bolt openings 708*b* (see FIG. 9H) in second head plate 628*b*. Each outlet check valve 618*b* is sandwiched and compressed between the head plate 628*b* and the corresponding flange 675*b*. In this manner, outlet check valves 618*b*, the gasket between second head plate 628*b* and each of the outlet check valves 618*b*, the gasket between each of the outlet check valves 618*b* and each of the flanges 675*b* are securely held together to provide a fluid tight seal. As such, outlet connector 670*b* may provide fluid communication from outlet check valves 618*b* to inlet 353*b* of pressure discharge manifold 352.

In other embodiments, connections between ports 610*a*, 610*b*, 612*a*, 612*b*, check valves 616*a*, 616*b*, 618*a*, 618*b* and flanges 661*a*, 661*b*, 675*a*, 675*b* may be facilitated by any suitable method, such as welding.

Figure 10A:
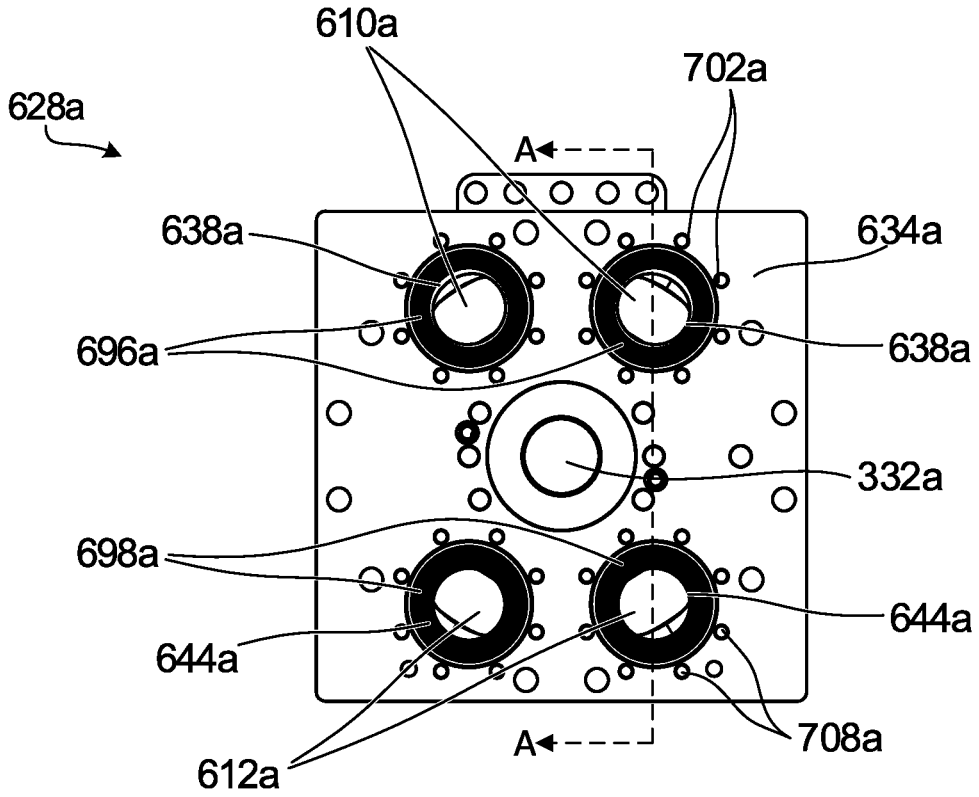
FIG. 10A is a front view of the head plate of the compressor of FIG. 9A.

First head plate 628*a* is shown in isolation in FIGS. 10A-E. As shown in FIG. 10A, at the outer face 634*a* of first head plate 628*a*, first inlet ports 610*a* may be generally circular (i.e., at their first ends 638*a*). Similarly, at outer face 634*a*, first outlet ports 612*a* may be generally circular (i.e., at their second ends 644*a*).

In order to provide a seal between each inlet or outlet port and first head plate 628*a*, gaskets may be positioned between first head plate 628*a*, each check valve 616*a*, 618*a* and each respective flange 661*a*, 675*a* to provide a seal between the respective ports, check valves and flanges. With reference to FIG. 9K, gaskets 718*a* may be positioned between first inlet ports 610*a* and each of the inlet check valves 616*a* and gaskets 720*a* may be positioned between inlet check valves 616*a* and each of the flanges 661*a*. Similarly, gaskets 722*a* may be positioned between first outlet ports 612*a* and each of the outlet check valves 618*a* and gaskets 724*a* may be positioned between each of the outlet check valves 618*a* and each of the flanges 675*a*.

Similarly, gaskets 718*b* (not shown in FIGS.) may be positioned between second inlet ports 610*b* and each of the inlet check valves 616*b* and gaskets 720*b* (not shown in FIGS.) may be positioned between inlet check valves 616*b* and each of the flanges 661*b*. Similarly, gaskets 722*b* (not shown in FIGS.) may be positioned between second outlet ports 612*b* and each of the outlet check valves 618*b* and gaskets 724*b* (not shown in FIGS.) may be positioned between each of the outlet check valves 618*b* and each of the flanges 675*b*.

The peripheral area around first inlet ports 610*a* and first outlet ports 612*a* provides gasket contact surfaces 696*a*, 698*a* respectively (FIG. 10A). Gasket contact surfaces 696*a*, 698*a* may generally have a complimentary size and shape to the respective gasket and may have a roughened surface such that an improved seal is formed between gasket contact surfaces 696*a*, 698*a* and gaskets 718*a*, 722*a*. In some embodiments, the gasket contact surfaces 696*a*, 698*a* comprise a continuous spiral groove (which is sometimes referred to as a phonographic groove). In some embodiments, the gasket contact surfaces 696*a*, 698*a* may have an arithmetic average roughness (Ra) between about 3.2 and about 12.5.

Figure 9H:
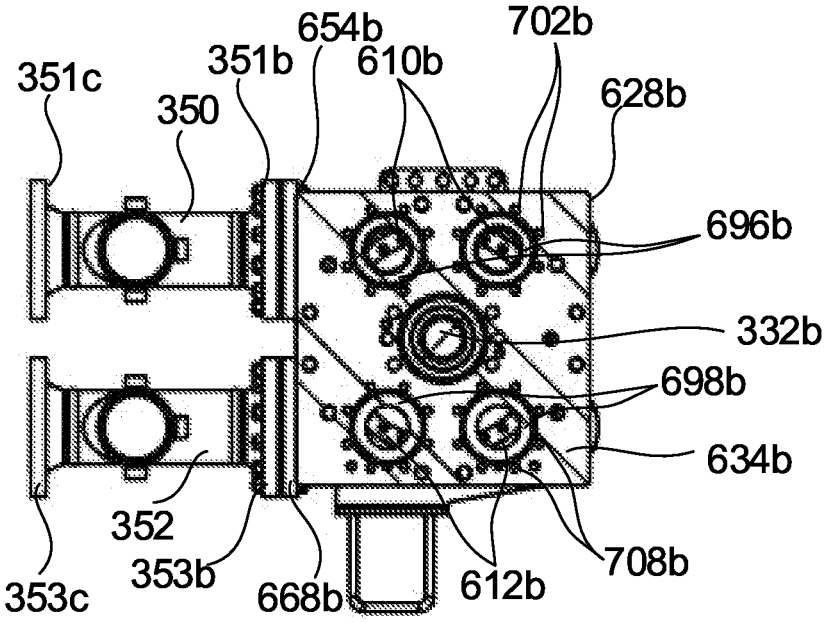
FIG. 9H is a cross sectional end view of the compressor of FIG. 9A, along the line A-A in FIG. 9G.
Figure 9I:
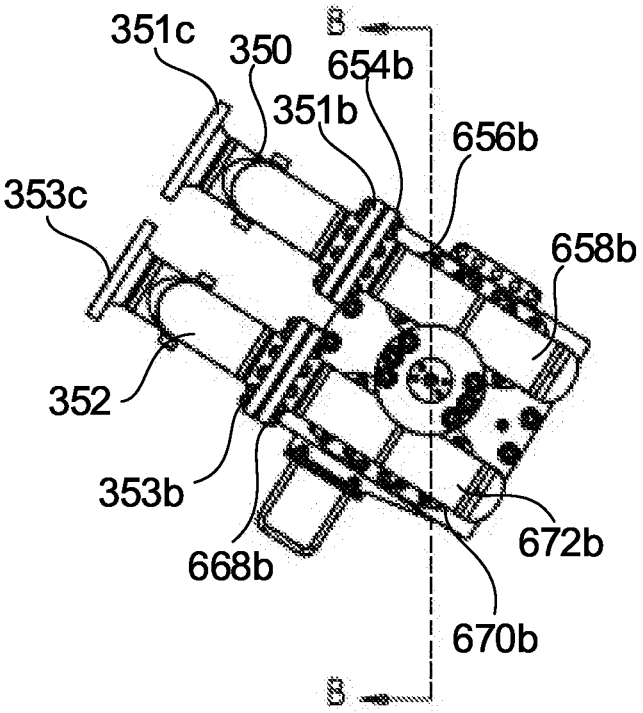
FIG. 9I is an end view of the compressor of FIG. 9A.

Similarly, as shown in FIG. 9H, at the outer face 634*b* of second head plate 628*b*, second inlet ports 610*b* may be generally circular (i.e., at their first ends 638*b*). Similarly, at outer face 634*b*, second outlet ports 612*b* may be generally circular (i.e., at their second ends 644*b*). The peripheral area around second inlet ports 610*b* and second outlet ports 612*b* provides gasket contact surfaces 696*b*, 698*b* respectively, which may be similar to gasket contact surfaces 696*a*, 698*a* described above.

Each of check valves 616*a*, 616*b*, 618*a*, 618*b* may include an area of roughened surface (similar to gasket contact surfaces 696*a*, 698*a* described above) at a region of each end of the respective check valve where an end of the check valve contacts the respective gasket. The roughened surfaces may comprise a continuous spiral groove as described above.

Flanges 661*a*, 661*b* associated with secondary conduits 660*a*, 660*b* respectively may also include an area of roughened surface (similar to gasket contact surfaces 696*a*, 698*a* described above) such that an improved seal is formed with the gasket that is positioned between flanges 661*a*, 661*b* and their respective check valve. The roughened surfaces may comprise a continuous spiral groove as described above.

Similarly, flanges 675*a*, 675*b* associated with secondary conduits 674*a*, 674*b* respectively may also include an area of roughened surface (similar to gasket contact surfaces 696*a*, 698*a* described above) such that an improved seal is formed with the gasket that is positioned between flanges 675*a*, 675*b* and their respective check valve. The roughened surfaces may comprise a continuous spiral groove as described above.

Figure 10B:
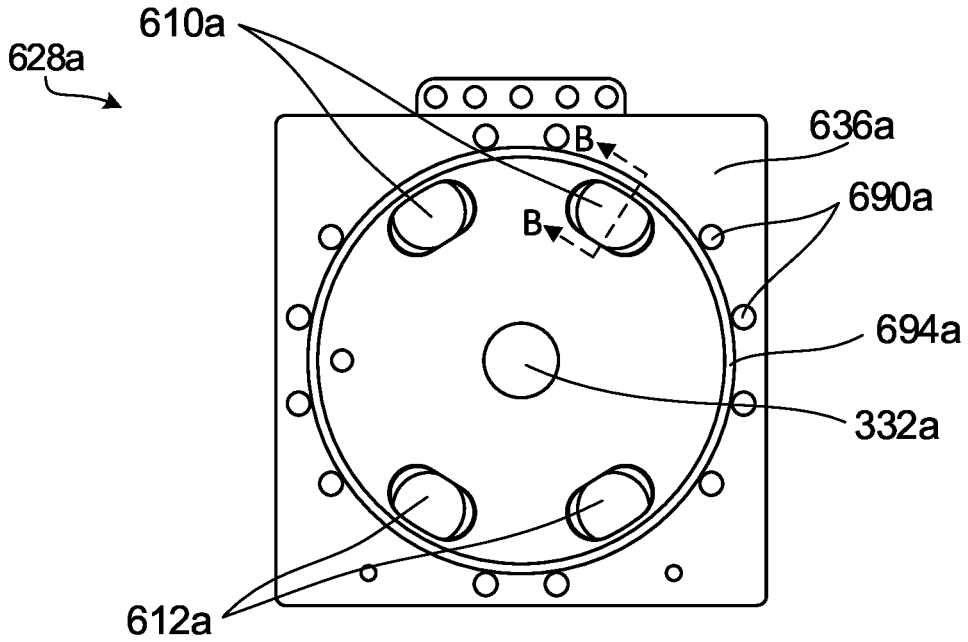
FIG. 10B is rear view of the head plate of FIG. 10A.

In an embodiment, the gaskets 718*a*, 718*b*, 720*a*, 720*b*, 722*a*, 722*b*, 724*a*, 724*b* be ANSI (American National Standards Institute) 300 # stainless steel spiral wound gaskets With reference to FIG. 10B, inner face 636*a* of first head plate 628*a* is depicted. First head plate 628*a* may include a plurality of openings 690*a* (FIG. 10B) therethrough in a generally circular arrangement for receiving a plurality of tie rods 692 (FIG. 9C) therethrough. Similarly, second head plate 628*b* includes a plurality of openings 690*b* (FIG. 9D) for receiving the opposite end of tie rods 692. Tie rods 692 are secured by nuts and function to tie together the head plates 628*a* and 628*b* with gas cylinder barrel 326 (FIG. 9E).

The inner face 636*a* of first head plate 628*a* may include a circular groove 694*a* for receiving and retaining an O-ring (not shown in FIGS.) to provide a seal between head plate 628*a* and gas cylinder barrel 326 at first end 305*a* of compression chamber 304. Similarly, the inner face 636*b* of second head plate 628*b* may include a circular groove 694*b* (FIG. 9D) for receiving and retaining an O-ring (not shown in FIGS.) to provide a seal between second head plate 628*b* and gas cylinder barrel 326 at second end 305*b* of compression chamber 304.

As shown in FIG. 10B, at the inner face 636*a* of first head plate 628*a*, first inlet ports 610*a* may be generally oval in shape (i.e., at their second ends 640*a*) with the long axis of the oval perpendicular to the radius of the compression chamber such that the second ends 640*a* of ports 610*a* are circumferentially elongated with respect to a central axis 730 of compressor 600 (FIG. 9F). The second ends 640*a* may be positioned proximal to the internal side walls of compression chamber 304, i.e., proximal to the inner surface of cylinder barrel/tubular wall 326. Further, the outer edge of the port at the second ends 640*a*, i.e., edge 695*a* as shown in FIG. 10A may be curved to generally follow the internal side walls of compression chamber 304. This ensures that a larger portion of the ports may be placed as close as possible to the internal side walls of compression chamber 304. The generally oval shape of first inlet ports 610*a* enables a constant cross sectional area of the port to be maintained across throughout the flow path of the port whilst allowing the port to define a flow path that is slanted (as will be explained in greater detail below).

In some embodiments the second ends may be between 0 and about ⅜ inch from the inner surface of cylinder barrel/tubular wall 326.

In comparison, at the outer face 634*a* of first head plate 628*a*, first outlet ports 610*a* may be generally circular. As will be described below, the inner profile of first inlet ports 610*a* may be profiled to transition in shape whilst still maintaining optimal fluid flow through first inlet ports 610*a*. Similarly, at the inner face 636*a* of first head plate 628*a*, first outlet ports 612*a* may be generally oval in shape (i.e., at their first ends 642*a*) and the outer face 634*a* of first head plate 628*a*, first outlet ports 612*a* may be generally circular. First outlet ports 612*a* may be profiled in a similar manner to first inlet ports 610*a*.

Figure 9J:
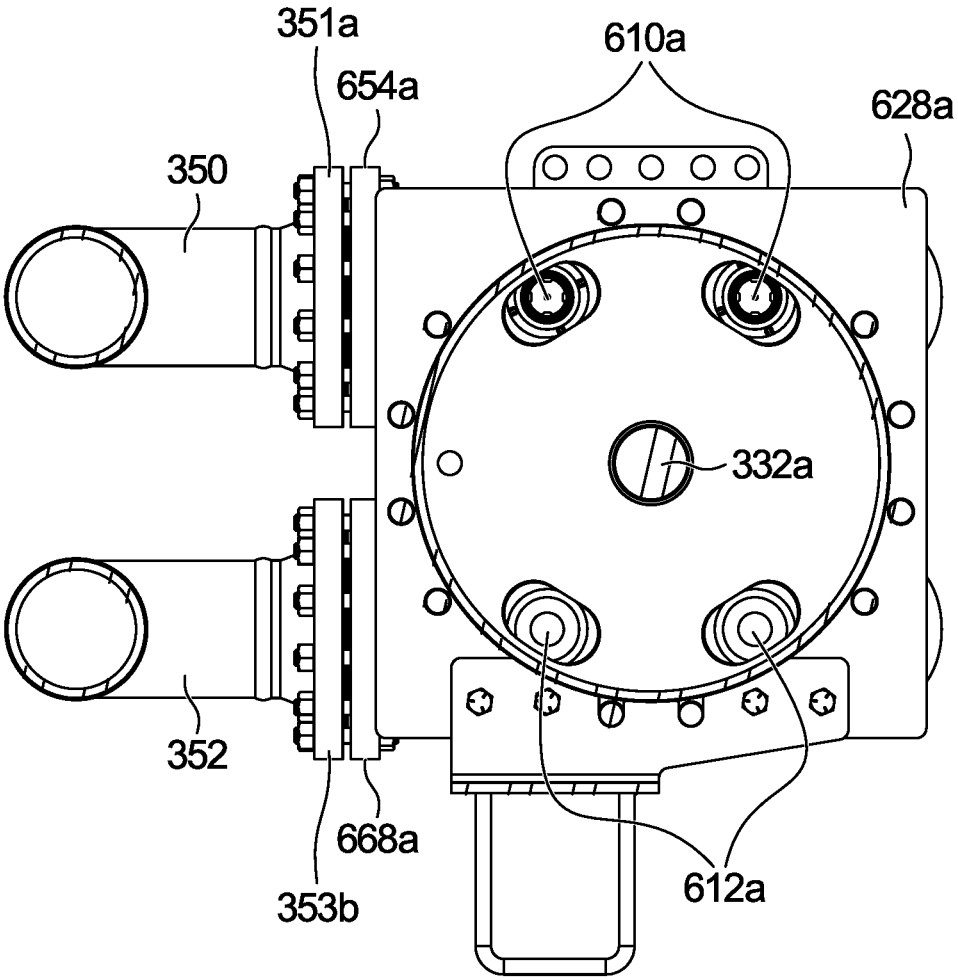
FIG. 9J is a cross sectional end view of the compressor of FIG. 9A, along the line B-B in FIG. 9F.
Figure 9K:
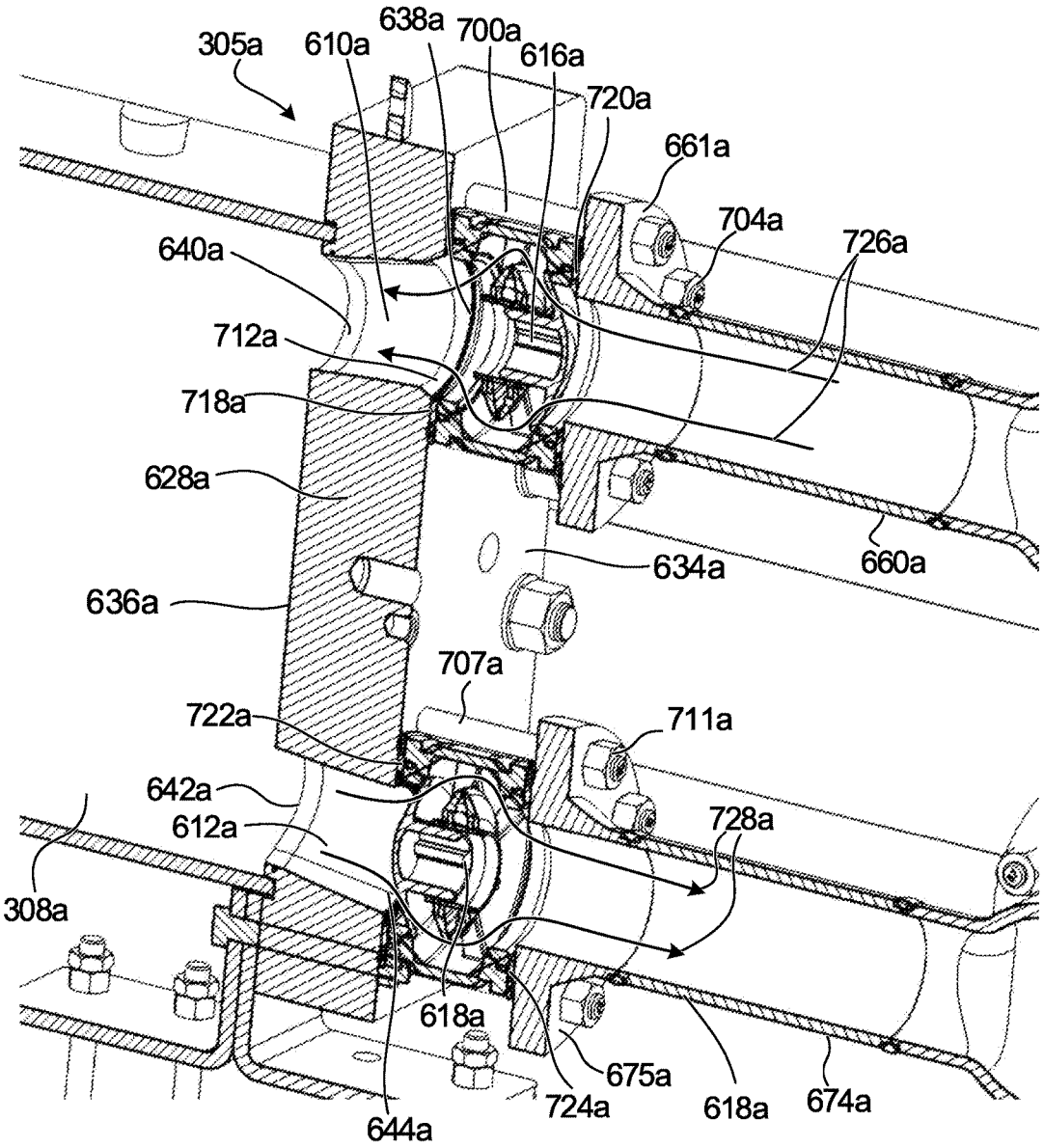
FIG. 9K is a partial cross-sectional front perspective view of the compressor of FIG. 9A, along the line A-A in FIG. 9F.

With reference to FIGS. 9H and 9J, the second inlet and outlet ports 610*b*, 612*b* of second head plate 628*b* may be configured similarly to first inlet and outlet ports 610*a*, 612*a* of first head plate 628*a*.

The ends of the inlet ports and outlet ports on first and second head plates 628*a*, 628*b* may be offset such that each port defines a flow path that is slanted (or inclined) with respect to central axis 730 of compressor 600 (FIG. 100). This means the first ends 638*a* of first inlet ports 610*a* will be positioned further from central axis 730 than the second ends 640*a*. Similarly, the second ends 644*a* of the first outlet ports 612*a* will be positioned radially further from central axis 730 than the first ends 642*a*.

Similarly, the first ends 638*b* of second inlet ports 610*b* may also be positioned further from central axis 730 than the second ends 640*b* and second ends 644*b* of the second outlet ports 612*b* may also be positioned further from central axis 730 than the first ends 642*b*.

For example, with reference to FIG. 100, the mid-point of the first end 638*a* of first inlet port 610*a* may be spaced a distance D1 from central axis 730 and the mid-point of the second end 640*a* of first inlet port 610*a* may be spaced a distance D2 from central axis 730, where the distance D1 is greater than the distance D2. The same may be applicable for the other inlet and outlet ports of first and second head plates 628*a* and 628*b*.

In some embodiments, the openings of ports 610*a*, 610*b*, 612*a*, 612*b* at the outer faces 634*a*, 634*b* of head plates 628*a*, 628*b* are further away from central axis 730 than the openings of ports 610*a*, 610*b*, 612*a*, 612*b* at the inner faces 636*a*, 636*b* of head plates 628*a*, 628*b* by a distance of between about 0.5 and 2 inches.

As a result, the ends of the inlet ports and outlet ports on the outer faces 634*a*, 634*b* of first and second head plates 628*a*, 628*b* (and therefore the connected check valves) will be located a greater distance from the centre of each head plate (i.e. further from piston rod openings 332*a*, 332*b*). As such, the ports and each attached check valve are further offset from the hydraulic cylinder at each end of each head plate. This configuration may advantageously increases space at each end of the compressor for additional components to be accommodated. For example, compressor 600 may be able to accommodate a larger hydraulic cylinders without reducing or limiting the size of the inlet and outlet ports, which would limit the pumping throughput of compressor 600.

In some embodiments, the compressor may be able to accommodate larger check valves, larger inlet/outlet conduits (and their associated flanges) and/or inlet or outlet ports having a larger internal diameter.

With reference to FIG. 100, the extent to which the ends of inlet and outlet ports 610*a*, 612*a* are slanted/inclined may be sufficient such that first end 638*a* of first inlet port 610*a* and a portion of second end 644*a* of first outlet port 612*a* may extend beyond the circumference of compression chamber 304 (as defined by inner surface cylinder barrel/tubular wall 326 in FIG. 100).

With reference to FIGS. 100 and 10D, the internal profiles of first inlet and outlet ports 610*a*, 612*a* of first head plate 628*a* are depicted. Second inlet and outlet ports 610*b*, 612*b* of second head plate 628*b* may be configured with a similar profile as will be described below for first inlet and outlet ports 610*a*, 612*a*.

In order to achieve the desired slanted flowpath of first inlet and outlet ports 610*a*, 612*a*, the inner walls of the ports are angled, rather than perpendicular to outer face 634*a*/inner face 636*a* of first head plate 628*a*. An example of the angle of the inner walls of a first inlet port 610*a* is shown in FIG. 10D, which may be similar to the profile of first outlet ports 612*a*.

The inner wall of first inlet port 610*a* may include a first portion 714*a* and a second, opposed portion 716*a*. As depicted in FIG. 10D, the angles described below for first and second portions 714*a*, 714*b* represent the angle relative to the outer face 634*a* of first head plate (which is in turn perpendicular to central axis 730). First portion 714*a*, located at a lower end of the inner wall of first inlet port 610*a*, may be angled relative to outer face 634*a* at an angle $\theta_1$. In some embodiments the angle $\theta_1$ as indicated in FIG. 10D may be between about 80 degrees and about 100 degrees. In an embodiment the angle $\theta_1$ is about 89 degrees. Second portion 716*a*, located at an upper end of the inner wall of first inlet port 610*a*, may be angled relative to outer face 634*a* at an angle $\theta_2$. In some embodiments the angle $\theta_2$ as indicated in FIG. 10D may be between about 70 degrees and about 90 degrees. In an embodiment the angle $\theta_2$ is about 78 degrees. First outlet ports 612*a* may be profiled in a similar manner to as described above for first inlet ports 610*a*.

The angle of the inner wall of first inlet port 610*a* between first portion 714*a* and second portion 716*a* may be varied to smoothly transition between the differing angles of first and second portions 714*a*, 716*a*.

The angles $\theta_1$ and $\theta_2$ may be selected from any angle to achieve the desired flowpath of first inlet ports 610*a* and to maximise fluid throughput through the ports.

First inlet ports 610*a* may have a generally constant cross sectional area from second end 640*a* to the first end 642*a*. For example, the cross sectional area of first inlet ports 610*a* may be between 11 and 13 $in^2$. In an embodiment the cross sectional area is 12.56 $in^2$. As shown in FIG. 10D, due to the oval shape of ports 610*a* at second end 640*a* and the round shape at first end 638, the diameter of first inlet ports 610*a* may gradually increase from second end 640*a* to the first end 642*a* in order to maintain the cross sectional area of the port. For example, the second end 640*a* of first ports 610*a* may have a diameter of between about 3 inches and about 7 inches whilst the first end 638*a* may have a diameter of between about 3 inches and about 5 inches. In an embodiment, the second end 640*a* of first ports 610*a* may have a diameter of about 5 inches. In an embodiment the first end 638*a* may have a diameter of about 4 inches.

Similarly, the diameter of first outlet ports 612*a* may gradually increase from the first end 642*a* to the second end 644*a*.

The first ends 638*a* of first inlet ports 610*a* may each include chamfered portions 712*a*, shown in greater detail in FIG. 10E. In some embodiments the chamfer angle ($\theta_c$), (which is the angle of the chamfered portions 912*a* of the inner wall relative to an axis perpendicular to outer face 634*a*, as indicated in FIG. 10E) may be between about 20 degrees and about 40 degrees. In an embodiment the chamfer angle is about 30 degrees.

With reference to FIG. 9K, the fluid flowpath through inlet check valve 616*a* and first inlet port 610*a* is indicated by arrows 726*a*. As depicted, fluid may flow through conduit 660*a* and, when the pressure differential across check valve 616*a* has reached the threshold pressure such that check valve 616*a* is an open configuration, fluid may flow through check valve 616*a* as indicated and into first inlet port 610*a* at first end 638*a*. Fluid may then flow through port 610*a* to second end 640*a* and into first compression chamber section 308*a*. As shown in FIG. 9K, the internal diameter of check valve 616*a* at the inner end of check valve 616*a* (i.e., the end adjacent to first end 638*a* of first inlet port 610*a*) is larger than the diameter of first inlet port 610*a*. The larger internal diameter of check valve 616*a* combined with the chamfered portions 712*a* of first inlet ports 610*a* may improve the fluid flow (and therefore allow a higher flow rate) into inlet ports 610*a*, such as by providing a wider entry into inlet ports 610*a* and/or by reducing turbulent fluid flow around the second ends 640*a* of inlet ports 610*a*.

The fluid flowpath through outlet check valve 618*a* and first outlet port 612*a* is indicated by arrows 728*a*. As depicted, fluid may flow through from first compression chamber section 308*a* and through first outlet port 618*a* from first end 642*a* to second end 644*a*. When the pressure differential across check valve 618*a* has reached the threshold pressure such that check valve 618*a* is an open configuration, fluid may flow through check valve 618*a* as indicated and into conduit 674*a*. In comparison to first inlet ports 610*a*, outlet ports 612*a* may not include a chamfered portion at second end 644*a* and end 644*a* may thus have a relatively narrow internal diameter (when comparing first end 638*a* of port 610*a* with second end 644*a* of port 612*a*). However, a high flow rate may still be achieved through first outlet ports 612*a* and outlet check valves 616*a* due to the higher pressure of the fluid as a result of the compression of fluid within compression chamber 304 by piston 306.

The placement and profile of first inlet and outlet ports 610*a*, 612*a* on first head plate 628*a* may be influenced by factors such as the internal diameter of compression chamber 304, the size (diameter) of hydraulic barrel 330*a*, the size (diameters) of check valves 616*a*, 618*a* and the sizes of flanges 661*a*, 675*a*.

In operation, compressor 600 may operate in a similar manner to as previously described for compressor 200. Similar to as described above for compressor 200, check valves 616*a*, 616*b*, 618*a*, 618*b* are operable to move between open and closed configurations depending on the pressure differential across each check valve. When in a closed configuration, fluid is not permitted to flow in either direction through the check valve. When in an open configuration, fluid is permitted to flow in one direction only through the check valve. As shown in FIG. 9A, check valves 616*a*, 616*b*, 618*a*, 618*b* are all in a closed configuration and fluid may not enter or leave compression chamber 304.

Figure 9L:
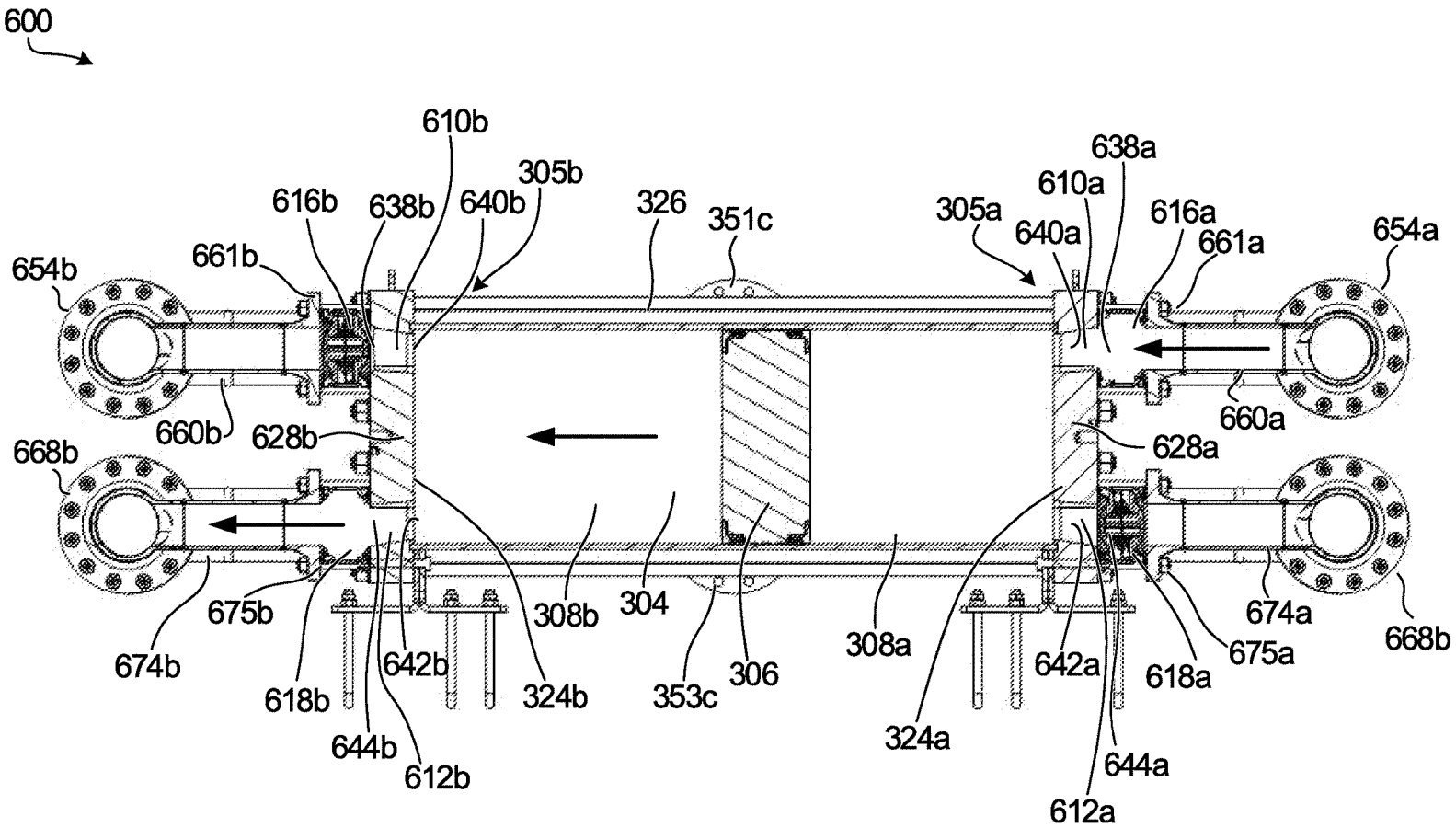
FIG. 9L is a cross-sectional rear view of the compressor of FIG. 9A along the line A-A in FIG. 9F, with some check valves in an open configuration.

With reference to FIG. 9L, inlet check valve 616*a* and outlet check valve 618*b* are shown in the open configuration. This configuration is similar to as shown in FIG. 2C for compressor 200 and may occur when piston 306 (note piston rod 307 is not shown in FIG. 9L) is moving from first end of stroke position 324*a* to second end of stroke position 324*b* and the pressure differential across check valves 616*a*, 618*b* has reached the threshold pressure of the valves. With inlet check valves 616*a* in an open configuration, fluid can flow as indicated through secondary conduits 660*a*, inlet check valves 516*a*, and into first compression chamber section 308*a* through first inlet ports 610*a*. With outlet check valves 618*b* in an open configuration, fluid can flow as indicated from second compression chamber section 308*b*, through second outlet ports 612*b*, outlet check valves 518*b*, and into conduits 674*b*.

Figure 9M:
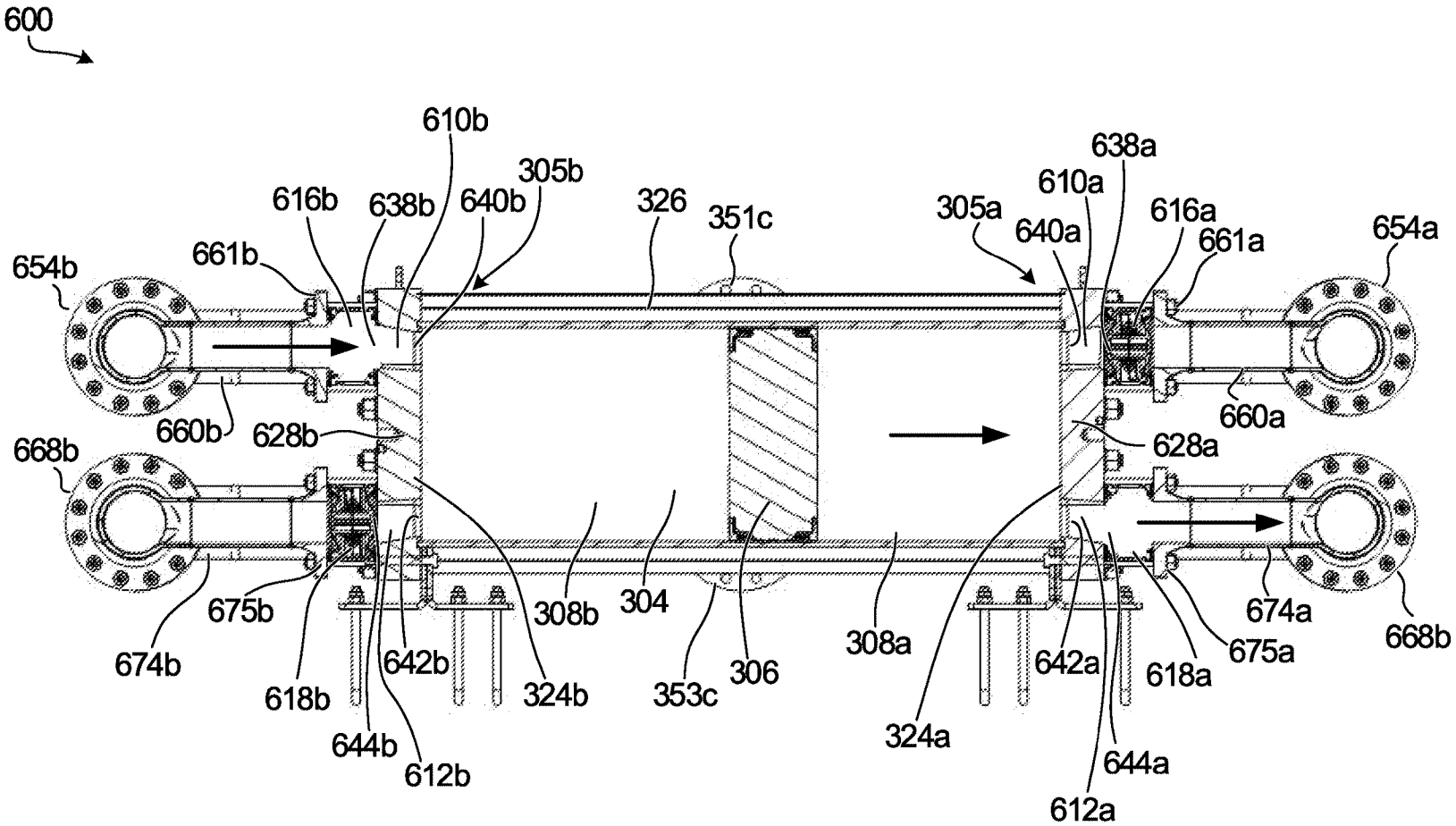
FIG. 9M is a cross-sectional rear view of the compressor of FIG. 9A along the line A-A in FIG. 9F, with some check valves in an open configuration.

With reference to FIG. 9M, inlet check valve 616*b* and outlet check valve 618*a* are shown in the open configuration. This configuration is similar to as shown in FIG. 2E for compressor 200 and may occur when piston 306 (note piston rod 307 is not shown in FIG. 9L) is moving from second end of stroke position 324*b* to first end of stroke position 324*a* and the pressure differential across check valves 616*b*, 618*a* has reached the threshold pressure of the valves. With inlet check valves 616*b* in an open configuration, fluid can flow as indicated through secondary conduits 660*b*, inlet check valves 616*b*, and into second compression chamber section 308*b* through first inlet ports 610*b*. With outlet check valves 618*a* in an open configuration, fluid can flow as indicated from first compression chamber section 308*a*, through first outlet ports 612*a*, outlet check valves 618*a*, and into conduits 674*a*.

Turning to FIGS. 11A to 11E, another embodiment of a first head plate 828*a* is shown, which is another example embodiment of head plate that may be used with a compressor, such as compressor 600. When used with a compressor a second head plate 828*b* may also be used which may similarly configured to first head plate 828*a*.

First head plate 828*a* may be similar to first head plate 628*a* described above and may have a generally square or rectangular shape with a pair of first inlet ports 810*a* horizontally spaced from each other at an upper end of first head plate 828*a* and a pair of first outlet ports 812*a*, horizontally spaced from each other at the opposite end of first head plate 828*a* to first inlet ports 810*a*.

Similar to first inlet and outlet ports 610*a*, 612*a*, first inlet and outlet ports 810*a*, 812*b* are each configured to be connected to a check valve, such as inlet check valves 616*a* and outlet check valves 618*a* respectively.

Figure 11A:
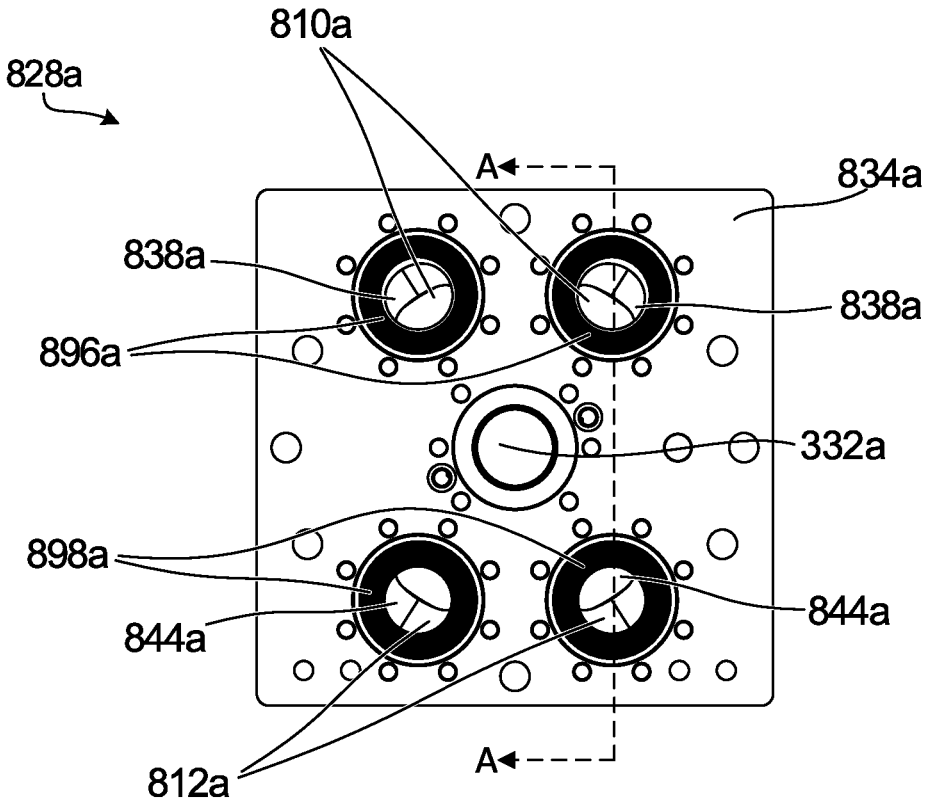
FIG. 11A is a front view of a head plate according to a further embodiment.

With reference to FIG. 11A, at the outer face 834*a* of first head plate 828*a*, first inlet ports 810*a* may be generally circular (i.e., at their first ends 838*a*). Similarly, at outer face 834*a*, first outlet ports 612*a* may be generally circular (i.e., at their second ends 844*a*).

Similar to first head plate 628*a*, the peripheral area around first inlet ports 610*a* and first outlet ports 612*a* provide gasket contact surfaces 896*a*, 898*a* respectively (FIG. 10A) which may be similar to gasket contact surfaces 696*a*, 698*a* described above.

Figure 11B:
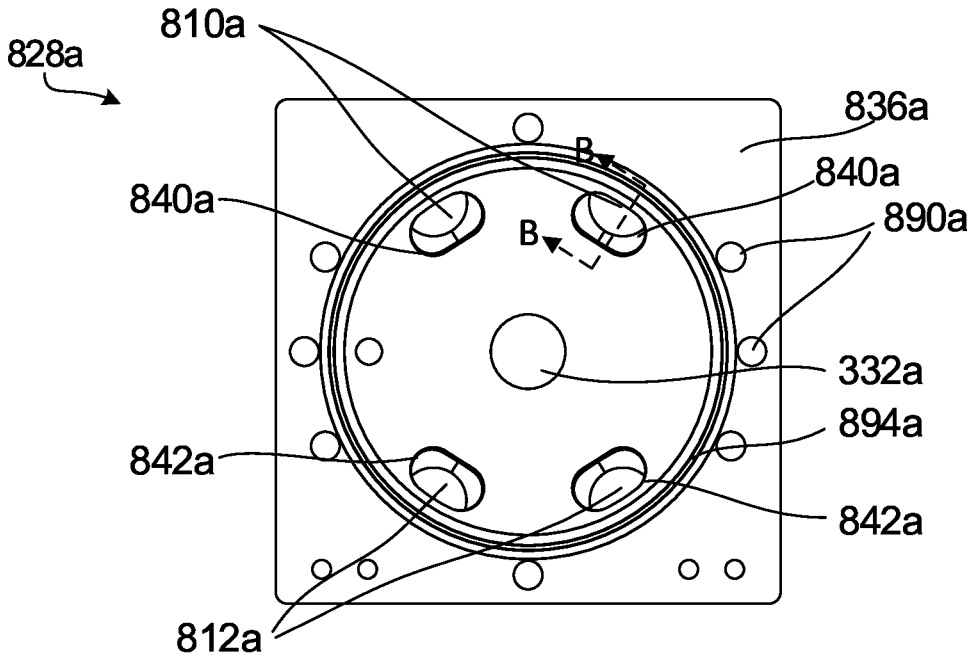
FIG. 11B is rear view of the head plate of FIG. 11A.

With reference to FIG. 11B, inner face 836*a* of first head plate 828*a* is depicted. Similar to first head plate 628*a*, first head plate 828*a* may include a plurality of openings 890*a* therethrough in a generally circular arrangement for receiving a plurality of tie rods which perform a similar function to tie rods 692 described above for compressor 600. First head plate 828*a* also includes a circular groove 894*a* for receiving and retaining an O-ring (not shown in FIGS.) to provide a seal between head plate 828*a* and a gas cylinder barrel.

As shown in FIG. 11B, at the inner face 836*a* of first head plate 828*a*, first inlet ports 810*a* may be generally oval in shape (i.e., at their second ends 840*a*). At the outer face 834*a* of first head plate 628*a*, first outlet ports 812*a* may be generally oval in shape (i.e., at their first ends 842*a*).

Figures 11C, 11D, 11E:
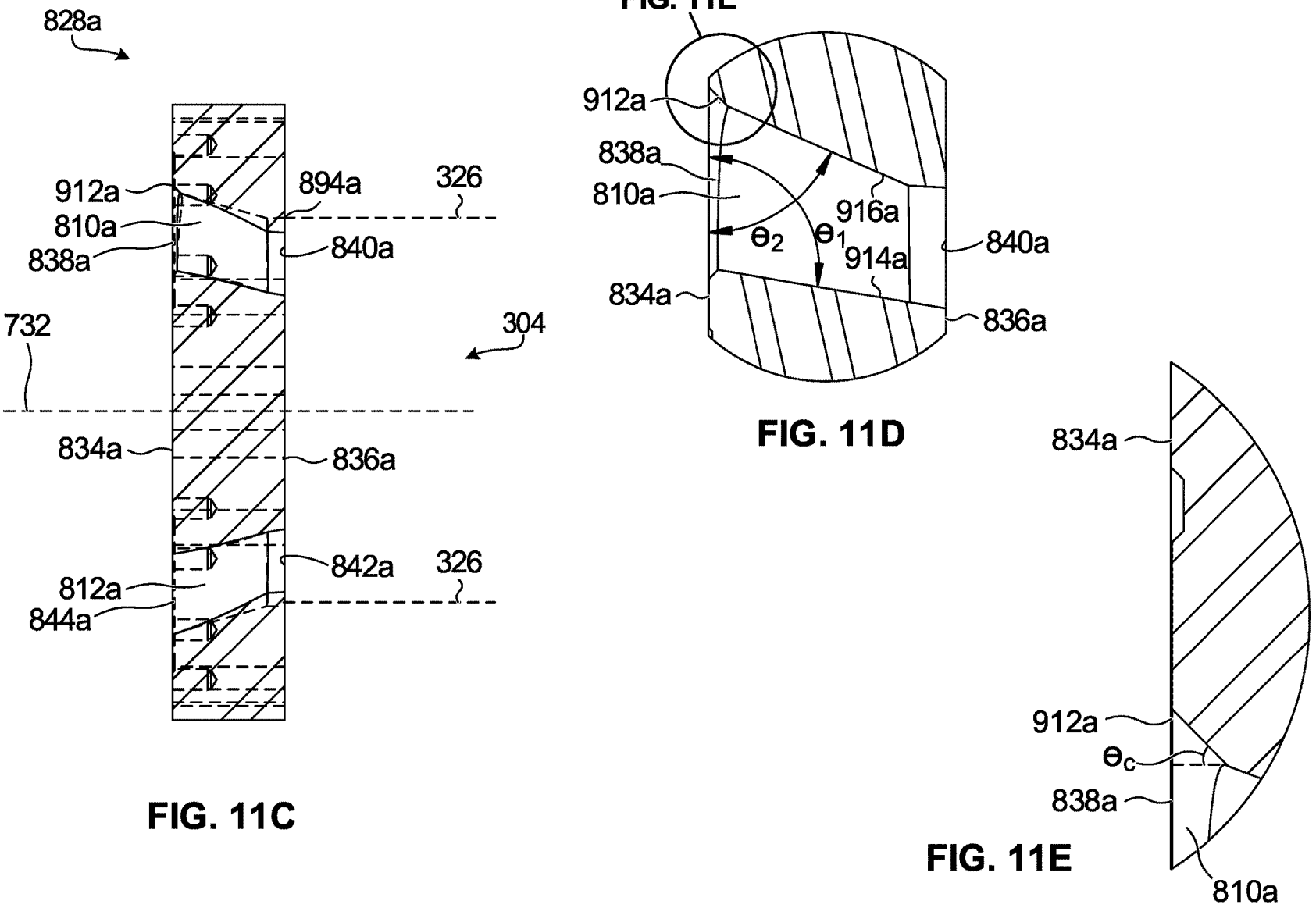
FIG. 11C is a cross sectional end view of the head plate of FIG. 11A, along the line A-A in FIG. 11A.
FIG. 11D is an enlarged view of a portion of FIG. 11C.
FIG. 11E is an enlarged view of a portion of FIG. 11D.

With reference to FIGS. 11C and 11D, the internal profiles of first inlet and outlet ports 810*a*, 812*a* of first head plate 828*a* are depicted. Similar to first and second head plates 628*a*, 628*b*, the ends of the inlet ports and outlet ports on first head plate 628*a* may be offset such that each port defines a flow path that is slanted (or inclined) with respect to central axis 732 (FIG. 11C) from the inner face 836*a* to the outer face 834*a* of first head plate 628*a*. This means the first ends 838*a* of first inlet ports 810*a* will be positioned further from central axis 732 than the second ends 840*a*. Similarly, the second ends 844*a* of the first outlet ports 812*a* will be positioned radially further from central axis 732 than the first ends 842*a*.

Similar to first inlet and outlet ports 610*a*, 612*a*, in order to achieve the inclined/slanted flow path of first inlet and outlet ports 810*a*, 812*a*, the inner walls of the ports are angled, rather than perpendicular to outer face 834*a*/inner face 836*a* of first head plate 828*a*. An example of the angle of the inner walls of a first inlet port 810*a* is shown in FIG. 11D, which may also be similar to the profile to the first outlet ports 812*a*.

The inner wall of first inlet port 810*a* may include a first portion 914*a* and a second opposed portion 916*a*. First portion 914*a*, located at a lower end of the inner wall of first inlet port 810*a*, may be angled relative to outer face 834*a* at an angle $\theta_1$. In some embodiments the angle $\theta_1$, as indicated in FIG. 11D may be between about 90 degrees and about 110 degrees. In an embodiment $\theta_1$ is about 100 degrees.

Second portion 916*a*, located at an upper end of the inner wall of first inlet port 810*a*, may be angled relative to outer face 834*a* at an angle $\theta_2$. In some embodiments the angle $\theta_2$ as indicated in FIG. 11D may be between about 55 degrees and about 75 degrees. In an embodiment $\theta_2$ is about 66 degrees.

The angle of the inner wall of first inlet port 810*a* between first portion 914*a* and second portion 916*a* may be varied to smoothly transition between the differing angles of first and second portions 914*a*, 916*a*. The angles $\theta_1$ and $\theta_2$ may be selected from any angle to achieve the desired flowpath of first inlet ports 810*a* and to maximise fluid throughput through the ports.

With reference to FIG. 11E, similar to first inlet ports 610*a* of first head plate 628*a*, the first ends 838*a* of first inlet ports 810*a* may each include chamfered portions 912*a*. In some embodiments the chamfer angle ($\theta_c$), (which is the angle of the chamfered portions 912*a* of the inner wall relative to an axis perpendicular to outer face 834*a*, as indicated in FIG. 11E) may be between about 35 degrees and about 55 degrees. In an embodiment the chamfer angle is about 45 degrees. The chamfer angle may be selected, for example, based on the specific type/configuration of check valve that is attached to the port.

In some embodiments, outlet ports 812*a* may also have a chamfered portion similar to chamfered portion 912*a* at first end 842*a*.

When first head plate 828*a* is incorporated into a compressor, in comparison to first inlet and outlet ports 610*a* 612*a* of first head plate 628*a*, due to the greater value for angle $\theta_1$ and smaller value for angle $\theta_2$, the first end 838*a* of inlet port 810*a* and second end 844*a* of first outlet port 812 may extend a greater distance beyond the circumference of compression chamber 304 (as defined by inner surface cylinder barrel/tubular wall 326 indicated FIG. 11C). This arrangement may provide additional space in the vicinity around piston rod opening 332*a* for accommodation of hydraulic cylinders, check valves and/or larger ports.

Figure 12A:
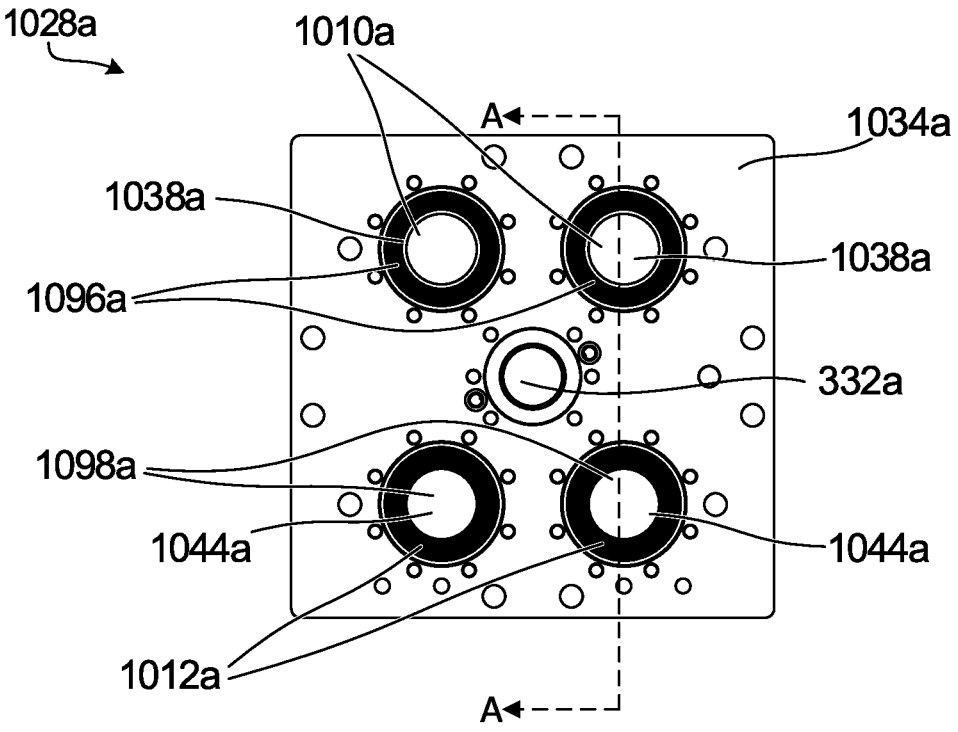
FIG. 12A is a front view of a head plate according to a further embodiment.
Figure 12B:
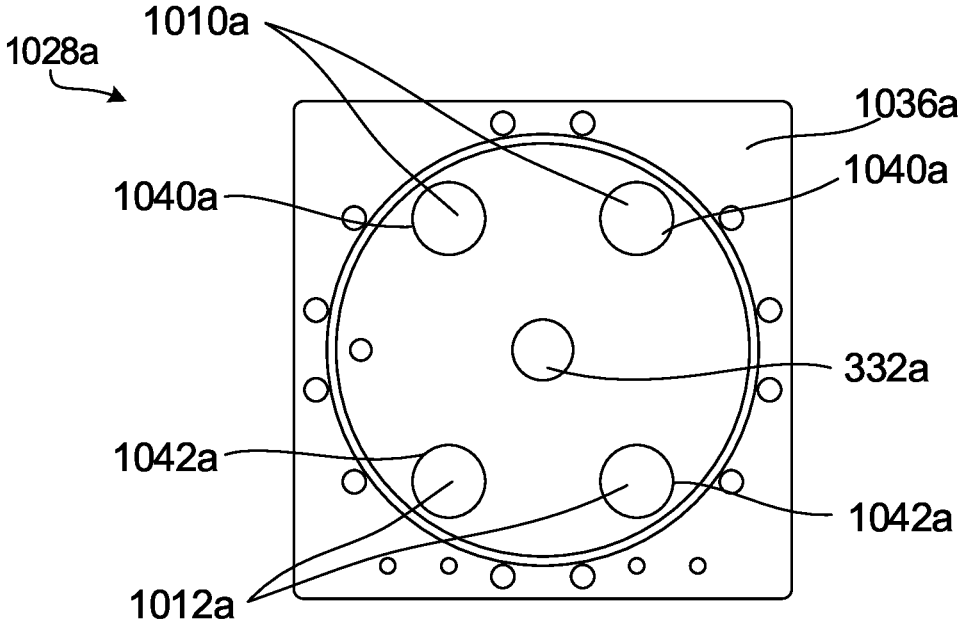
FIG. 12B is rear view of the head plate of FIG. 12A.
Figure 12C:
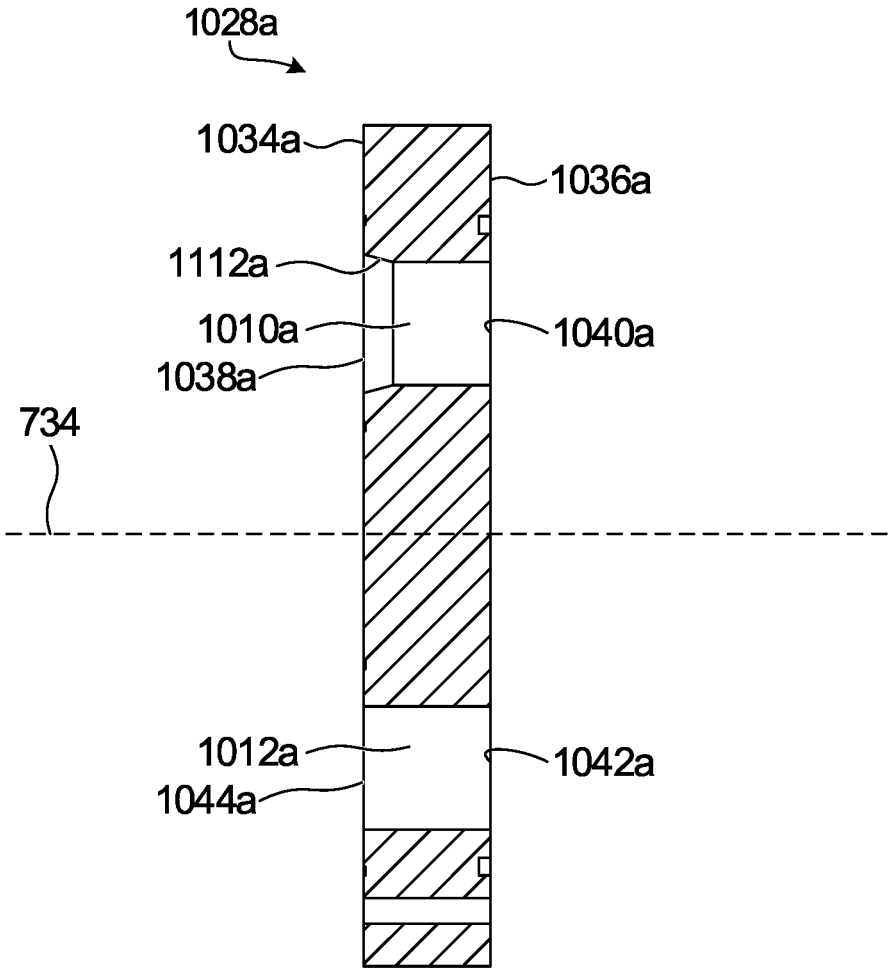
FIG. 12C is a cross sectional end view of the head plate of FIG. 12A, along the line A-A in FIG. 12A.

Turning to FIGS. 12A to 12C, another embodiment of a first head plate 1028*a* is shown, which is another example embodiment of head plate that may be used with a compressor, such as compressor 600. When used with a compressor a second head plate 1028*b* may also be used which may similarly configured to first head plate 1028*a*.

First head plate 1028*a* may be similar to first head plate 628*a* described above and may have a generally square or rectangular shape with a pair of first inlet ports 1010*a* horizontally spaced from each other at an upper end of first head plate 1028*a* and a pair of first outlet ports 1012*a*, horizontally spaced from each other at the opposite end of first head plate 1028*a* to first inlet ports 1010*a*.

First inlet and outlet ports 1010*a*, 1012*b* are each configured to be connected to a check valve, similar to as described above for first inlet and outlet ports 610*a*, 612*a*.

First inlet ports 1010*a* may be generally circular in cross section and define a straight fluid flowpath (i.e., generally perpendicular to central axis 734 shown in FIG. 12C) through first head plate 1028*a* from first end 1038*a* (at outer face 1034*a*) to second end 1040*a* (at inner face 1036*a*). First outlet ports 1012*a* may be generally circular in cross section and define a straight fluid flowpath (i.e., generally perpendicular to central axis 734 shown in FIG. 12C) through first head plate 1028*a* from first end 1042*a* (at inner face 1036*a*) to second end 1044*a* (at outer face 1034*a*).

Similar to first head plate 628*a*, the peripheral area around first inlet ports 1010*a* and first outlet ports 1012*a* provide gasket contact surfaces 1096*a*, 1098*a* respectively (FIG. 10A) which may be similar to gasket contact surfaces 696*a*, 698*a* described above.

With reference to FIG. 12C, similar to first inlet ports 610*a* of first head plate 628*a*, the first ends 1038*a* of first inlet ports 1010*a* may each include chamfered portions

1112*a*. In some embodiments, outlet ports 1012*a* may also have a chamfered portion similar to chamfered portion 1012*a* at first end 1042*a*.

According to another embodiment, the present disclosure relates to a compressor comprising a compression chamber. The compression chamber comprises a tubular wall extending between first and second ends along a central axis and an end plate attached to each one of the first and second ends. The end plate comprises an inner surface, an external surface, and a central opening and a plurality of peripheral fluid ports extending from the inner surface to the external surface. Each one of the peripheral fluid ports comprises an inner opening at the inner surface and an outer opening at the external surface and is inclined with respect to the central axis such that the outer opening is farther away from the central axis than the inner opening. The compressor further comprises a piston movably housed in the compression chamber and a piston rod for driving the piston to move within the compression chamber, the piston rod connected to the piston through the central opening of the end plate and extending along the central axis.

In some embodiments, the end plate has a thickness of about 4 inches, and the outer opening is farther away from the central axis than the inner opening by between about 0.5 and 2 inches.

In some embodiments, the plurality of the peripheral fluid ports comprises four ports.

In some embodiments, the inner opening is located 0 to about ⅜ inches from the tubular wall.

In some embodiments, the inner opening is circumferentially elongated with respect to the central axis.

In some embodiments, the inner opening is smaller than the outer opening.

In some embodiments, the outer opening comprises a chamfered edge.

In some embodiments, the compressor further comprises a plurality of valves, each connected to one of the peripheral fluid ports. In some embodiments, the valves comprise check valves. In some embodiments, the compressor further comprises a plurality of conduits connecting the valves to an input line and an output line respectively. In some embodiments, each one of the conduits comprises a flange connected to a corresponding one of the valves, wherein the flange is spaced away from the piston rod due to inclination of the peripheral fluid port connected to the corresponding valve.

When introducing elements of the present invention or the embodiments thereof, the articles "a," "an," "the," and "said" are intended to mean that there are one or more of the elements. The terms "comprising," "including," and "having" are intended to be inclusive and mean that there may be additional elements other than the listed elements.

Of course, the above described embodiments are intended to be illustrative only and in no way limiting. The described embodiments of carrying out the invention are susceptible to many modifications of form, arrangement of parts, details, and order of operation. The invention, therefore, is intended to encompass all such modifications within its scope.

What is claimed is:

1. A compressor for compressing a multiphase fluid comprising a mixture of gas and liquid, wherein the multiphase fluid is fluid produced from an oil and gas well, the compressor comprising:

a first cylinder for compressing a fluid, comprising:

a chamber configured and operable to receive the multiphase fluid;

a piston reciprocally movable in the chamber operable for compressing the multi-phase fluid towards a first end of the chamber;

a centrally located opening at the first end of the chamber;

four ports at the first end of the chamber, comprising two inlet ports and two outlet ports, wherein each of the four ports comprises a first end located proximal to the chamber, and a second end located distal to the chamber;

a plurality of check valves each associated with one of the four ports for controlling fluid flow of the multi-phase fluid through the ports, including two inlet check valves connected to the two inlet ports and two outlet check valves connected to the two outlet ports, wherein an axial direction of each of the check valves is aligned with an axial direction of a central axis of the first cylinder;

a centrally located second cylinder at the first end of the chamber, the second cylinder connected and configured and operable to drive movement of the piston in the first cylinder through the centrally located opening;

an inlet conduit connected to each one of the inlet check valves operable to supply the multi-phase fluid from a fluid source to the chamber through the inlet ports;

an outlet conduit connected to each one of the outlet check valves operable for receiving the multi-phase fluid from the chamber through the outlet ports;

wherein each of the four ports is slanted such that plurality of check valves and inlet and outlet conduits are spaced apart from the second cylinder; and wherein each one of the inlet ports are flared towards the second ends of each one of the inlet ports.

2. The compressor of claim 1, wherein each of the inlet and outlet conduits comprises a first end comprising a first flange; and a plurality of second ends each comprising a second flange, each of the second flanges of the inlet conduit operable for connecting the respective second end to the inlet check valves and each of the second flanges of the outlet conduit for connecting the respective second end to the outlet check valves.

3. The compressor of claim 1, wherein the first ends of each of the four ports are also located proximal to an edge of an internal side wall of the chamber.

4. The compressor of claim 3, wherein the first ends of each of the four ports are oval.

5. The compressor of claim 3, wherein the second ends of each of the four ports are circular.

6. The compressor of claim 1, wherein the second ends of each one of the inlet ports comprises a chamfered edge.

7. The compressor of claim 1, wherein the first ends of the chamber comprises a head plate, and each one of the check valves is secured to the head plate.

8. The compressor of claim 1, wherein the multiphase fluid comprises a solid material.

9. A compressor operable for compressing a multiphase fluid comprising a mixture of gas and liquid, wherein the multiphase fluid is fluid produced from an oil and gas well, the compressor comprising:

a compression chamber comprising:

a tubular wall extending between first and second ends along a central axis, and an end plate attached to each one of the first and second ends, the end plate comprising an inner surface, an external surface, and a central opening and a plurality of peripheral fluid ports extending from the inner surface to the external surface, wherein each one of the peripheral fluid ports comprises an inner opening at the inner surface and, an outer opening at the external surface, an inner wall, and is inclined with respect to the central axis such that the outer opening is farther away from the central axis than the inner opening, wherein at least two of the plurality of peripheral fluid ports are flared towards the outer openings of the respective ports;

wherein for the at least two of the plurality of peripheral ports that are flared, a flare angle of the inner wall of the respective port, proximal to the tubular wall of the chamber, is greater than a flare angle of the inner wall of the respective port distal to the tubular wall of the chamber;

a plurality of valves each connected to one of the peripheral fluid ports, wherein an axial direction of each of the valves is parallel to the central axis;

a piston movably housed in the compression chamber;

a piston rod for driving the piston operable to move within the compression chamber, the piston rod connected to the piston through the central opening of the end plate and extending along the central axis.

10. The compressor of claim 9, wherein the end plate has a thickness of about 4 inches, and the outer opening is farther away from the central axis than the inner opening by between about 0.5 and about 2 inches.

11. The compressor of claim 9, wherein the plurality of the peripheral fluid ports comprises four ports.

12. The compressor of claim 9, wherein the inner opening is located 0 to about ⅜ inches from the tubular wall.

13. The compressor of claim 9, wherein a circumferential extent of the inner opening is longer than a radial extent of the inner opening.

14. The compressor of claim 9, wherein the inner opening is smaller than the outer opening.

15. The compressor of claim 9, wherein the outer openings of at least two of the plurality of peripheral fluid ports comprises a chamfered edge.

16. The compressor of claim 9, wherein the valves comprise check valves.

17. The compressor of claim 9, comprising a plurality of conduits connecting the valves to an input line and an output line respectively.

18. The compressor of claim 17, wherein each one of the conduits comprises a flange connected to a corresponding one of the valves, wherein the flange is spaced away from the piston rod due to inclination of the peripheral fluid port connected to the corresponding valve.

19. The compressor of claim 18, wherein the valves comprise check valves each compressed between a corresponding one of the head plates and a corresponding one of the flanges.

* * * * *